US005360459A

United States Patent [19]

Kolp et al.

[11] Patent Number: 5,360,459

[45] Date of Patent: * Nov. 1, 1994

[54] COPPER-CONTAINING ORGANOMETALLIC COMPLEXES AND CONCENTRATES AND DIESEL FUELS CONTAINING SAME

[75] Inventors: Christopher J. Kolp, Euclid; Daniel T. Daly, Shaker Hts.; Nai Z. Huang, Mayfield Hts.; Scott T. Jolley, Mentor; Frederick W. Koch, Willoughby Hills; Stephen H. Stoldt, Concord Township, Ashtabula County; Reed H. Walsh, Mentor; Richard A. Denis, Auburn Township, Ashtabula County, all of Ohio

[73] Assignee: The Lubrizol Corporation, Cleveland, Ohio

[ * ] Notice: The portion of the term of this patent subsequent to May 13, 2008 has been disclaimed.

[21] Appl. No.: 699,051

[22] Filed: May 13, 1991

[51] Int. Cl.[5] ..... C10L 1/30

[52] U.S. Cl. ..... 44/358; 44/367; 44/415

[58] Field of Search ..... 44/358, 367, 415

[56] References Cited

U.S. PATENT DOCUMENTS

| | | | |
|---|---|---|---|
| Re. 29,488 | 12/1977 | Gautreaux | 44/68 |
| 2,151,432 | 3/1939 | Lyons et al. | 44/9 |
| 2,203,374 | 6/1940 | Andreas et al. | 44/9 |
| 2,301,861 | 11/1942 | Downing et al. | 260/566 |
| 2,336,598 | 12/1943 | Downing et al. | 44/73 |
| 2,343,756 | 3/1944 | Downing et al. | 252/37 |
| 2,420,122 | 5/1947 | Chenicek | 44/71 |

(List continued on next page.)

FOREIGN PATENT DOCUMENTS

| | | |
|---|---|---|
| 1018688 | 1/1988 | Australia . |
| 4572189 | 1/1989 | Australia . |
| 5003290 | 2/1990 | Australia . |
| 671137 | 9/1963 | Canada . |
| 699862 | 12/1964 | Canada . |

(List continued on next page.)

OTHER PUBLICATIONS

PCT/US92/03233–Search Report Nov. 1992.
PCT/US92/03180–Search Report Oct. 1992.
PCT/US92/03178–Search Report Oct. 1992.
Stiglic et al, "Emission Testing of Two Heavy Duty Diesel engines Equipped With Exhaust Aftertreatment", SAE Technical Paper Series, 900919, 41st Annual Earthmoving Industry Conference, Peoria, Ill., Apr. 3–5, 1990.

(List continued on next page.)

*Primary Examiner*—Ellen M. McAvoy
*Attorney, Agent, or Firm*—Frederick D. Hunter

[57] ABSTRACT

This invention relates to copper-containing organometallic complexes, and to concentrates and diesel fuels containing said complexes. The diesel fuels are useful with diesel engines equipped with exhaust system particulate traps. The copper-containing organometallic complex is used for lowering the ignition temperature of exhaust particles collected in the trap. The copper-containing organometallic complex is soluble or stably dispersible in the diesel fuel and is derived from (i) an organic compound containing at least two functional groups attached to a hydrocarbon linkage, and (ii) a copper-containing metal reactant capable of forming a complex with the organic compound (i). The functional groups are $=X$, $-XR$, $-NR_2$, $-NO_2$, $=NR$, $=NXR$, $=N-R^*-XR$, $$-\underset{\underset{R}{|}}{N}-(R^*\underset{\underset{R}{|}}{N})_a-R,\ -\underset{\underset{XR}{|}}{P}(X)XR,\ -\underset{\underset{R}{|}}{P}(X)XR$$

$-CN$, $-N=NR$ or $-N=CR_2$; wherein X is O or S, R is H or hydrocarbyl, R* is hydrocarbylene or hydrocarbylidene, and a is a number (e.g., zero to about 10). The copper can be combined with one or more metals selected from the group consisting Na, K, Mg, Ca, Sr, Ba, V, Cr, Mo, Fe, Co, Zn, B, Pb, Sb, Ti, Mn and Zr. This invention is also directed to methods of operating a diesel engine equipped with an exhaust system particulate trap using the foregoing diesel fuel.

38 Claims, No Drawings

U.S. PATENT DOCUMENTS

| | | | |
|---|---|---|---|
| 2,560,542 | 7/1951 | Bartleson et al. | 252/32.7 |
| 2,643,262 | 6/1953 | Bosturick | 260/429 |
| 2,824,115 | 2/1958 | Beacham et al. | 260/429.5 |
| 2,891,853 | 6/1959 | Niedgielaki | 52/0.5 |
| 2,913,469 | 11/1959 | Russell | 260/429.5 |
| 2,966,453 | 12/1960 | Gleim et al. | 208/206 |
| 2,967,824 | 1/1961 | Ouiquerly et al. | 208/289 |
| 3,004,070 | 10/1961 | Hastle | 260/590 |
| 3,033,865 | 5/1962 | Fronmuller et al. | 260/270 |
| 3,056,666 | 10/1962 | Fische et al. | 44/66 |
| 3,071,451 | 1/1963 | Schmerling | 44/73 |
| 3,082,071 | 3/1963 | Hartle et al. | 44/68 |
| 3,134,737 | 5/1964 | Kay | 252/42.7 |
| 3,198,817 | 8/1965 | Langer | 260/429.1 |
| 3,254,025 | 5/1966 | LeSuer | 252/32.7 |
| 3,346,493 | 10/1967 | LeSuer | 252/32.5 |
| 3,348,932 | 10/1967 | Kukin | 44/4 |
| 3,355,270 | 11/1967 | Amick et al. | 44/68 |
| 3,398,170 | 8/1968 | Cyba | 260/439 |
| 3,415,781 | 12/1968 | Block et al. | 260/47 |
| 3,428,449 | 2/1969 | Swanson | 75/117 |
| 3,493,508 | 2/1970 | Andreas | 252/42.7 |
| 3,502,452 | 3/1970 | Patinkin | 44/69 |
| 3,574,837 | 4/1971 | Pocreco et al. | 424/248 |
| 3,624,115 | 11/1971 | Otto et al. | 260/429.9 |
| 3,652,241 | 3/1972 | Bialy et al. | 44/71 |
| 3,663,525 | 5/1972 | Witterhatt et al. | 260/149 |
| 3,697,400 | 10/1972 | Pang | 204/106 |
| 3,753,670 | 8/1973 | Strang et al. | 44/72 |
| 3,762,890 | 10/1973 | Collins | 44/66 |
| 3,808,131 | 4/1974 | Otto et al. | 252/32.5 |
| 3,843,536 | 10/1974 | Johnston | 252/51.5 R |
| 3,875,200 | 4/1975 | Eplattenier et al. | 260/439 R |
| 3,884,949 | 5/1975 | Eicke et al. | 260/429.3 |
| 3,925,472 | 12/1975 | Swanson | 260/566 A |
| 3,926,581 | 12/1975 | Plonsker | 44/68 |
| 3,933,879 | 1/1976 | Langer et al. | 260/448 R |
| 3,948,618 | 4/1976 | Niebylski | 44/66 |
| 3,950,145 | 4/1976 | Niebylski | 44/68 |
| 3,958,955 | 5/1976 | Guthreaux | 44/68 |
| 3,966,429 | 6/1976 | Sprague et al. | 44/68 |
| 3,975,244 | 8/1976 | Hunter | 204/108 |
| 3,976,439 | 8/1976 | Loder et al. | 44/68 |
| 3,976,440 | 8/1976 | Loder et al. | 44/68 |
| 3,980,569 | 9/1976 | Pinder et al. | 252/51.5 R |
| 3,981,966 | 9/1976 | Baucom | 423/104 |
| 3,988,323 | 10/1976 | Eplattenier et al. | 260/240 G |
| 3,991,091 | 11/1976 | Driscoll et al. | 260/429.7 |

(List continued on next page.)

FOREIGN PATENT DOCUMENTS

| | | |
|---|---|---|
| 0078249 | 9/1982 | European Pat. Off. . |
| 0073615 | 3/1983 | European Pat. Off. . |
| 0092755 | 11/1983 | European Pat. Off. . |
| 0092756 | 11/1983 | European Pat. Off. . |
| 0104783 | 4/1984 | European Pat. Off. . |
| 0113856 | 7/1984 | European Pat. Off. . |
| 0261795 | 3/1988 | European Pat. Off. . |
| 0283294 | 9/1988 | European Pat. Off. . |
| 8911877 | 12/1989 | European Pat. Off. . |
| 0821211 | 11/1937 | France . |
| 1159705 | 2/1958 | France . |
| 1179418 | 12/1958 | France . |
| 1194036 | 5/1959 | France . |
| 1545132 | 11/1968 | France . |
| 1546216 | 11/1968 | France . |
| 2207904 | 6/1974 | France . |
| 2443017 | 3/1975 | Germany . |
| 254738 | 3/1988 | Germany . |
| 1182880 | 3/1970 | United Kingdom . |
| 1566106 | 4/1980 | United Kingdom . |
| 2064547 | 6/1981 | United Kingdom . |
| 2116583 | 9/1983 | United Kingdom . |
| 2248068 | 3/1992 | United Kingdom . |
| 794015 | 1/1981 | U.S.S.R. . |
| WO8701720 | 3/1987 | WIPO . |
| 8802392 | 4/1988 | WIPO . |

OTHER PUBLICATIONS

"An Analysis of Possible Health Effects Due to the Use of a Copper Diesel Fuel Additive" (with appendices A–I), published May 7, 1990.

"Experimental Evaluation to Determine the Effect of an Organometallic Fuel Additive on Particulate Trap Regeneration" published Apr. 3–5, 1990.

"Inhibition of Deterioration of Cracked Gasoline During Storage", Petersen, C. J., Industrial and Engineering Chemistry, vol. 41 (1949), pp. 924–928.

Hunter et al, "The Azo-group as a Chelating Group, Part V. Metallic Derivatives of Arylazo-oximes and of Formazyl Compounds". J. Chem. Soc., 1944, pp. 820–823.

Hunter et al, "The Associating Effect of the Hydrogen Atom, Part IX. The N-H-N Bond. Virtual Tautomerism of the Formazyl Compounds". J. Chem. Soc., 1941, pp. 823–826.

(List continued on next page.)

U.S. PATENT DOCUMENTS

| | | | |
|---|---|---|---|
| 3,993,835 | 11/1976 | Miedaner | 428/378 |
| 4,005,992 | 2/1977 | Niebylski et al. | 44/68 |
| 4,005,993 | 2/1977 | Niebylski et al. | 44/68 |
| 4,020,106 | 4/1977 | Ackuley et al. | 260/566 A |
| 4,028,065 | 6/1977 | Sprague et al. | 44/68 |
| 4,028,390 | 6/1977 | Rubina et al. | 260/429.3 |
| 4,029,683 | 6/1977 | Aratini et al. | 260/438.1 |
| 4,043,882 | 8/1977 | Skarlo et al. | 204/106 |
| 4,044,036 | 8/1977 | Hari et al. | 260/438.1 |
| 4,067,699 | 1/1978 | Lukasiewicz | 44/66 |
| 4,073,626 | 2/1978 | Simmons | 44/57 |
| 4,077,941 | 3/1978 | Stephen et al. | 260/45.75 N |
| 4,089,945 | 5/1978 | Brinkman et al. | 424/164 |
| 4,093,614 | 6/1978 | Chibnik et al. | 260/299 |
| 4,104,359 | 8/1978 | Dains et al. | 423/139 |
| 4,130,432 | 12/1978 | Wehner et al. | 106/15 R |
| 4,131,433 | 12/1978 | Scott | 44/51 |
| 4,131,554 | 12/1978 | Steckel | 252/33.6 |
| 4,133,648 | 1/1979 | Deffner | 44/68 |
| 4,140,491 | 2/1979 | Allain et al. | 44/56 |
| 4,141,693 | 2/1979 | Feldman et al. | 44/68 |
| 4,142,952 | 3/1979 | Dalton | 204/106 |
| 4,151,201 | 4/1979 | Casniti et al. | 260/562 A |
| 4,152,401 | 5/1979 | Langer et al. | 423/286 |
| 4,162,986 | 7/1979 | Alkaitis et al. | 252/33.2 |
| 4,189,306 | 2/1980 | Sandy | 44/68 |
| 4,198,303 | 4/1980 | Braid | 252/42.7 |
| 4,202,671 | 5/1980 | Diehl et al. | 44/68 |
| 4,207,078 | 6/1980 | Sweeney et al. | 44/68 |
| 4,215,997 | 8/1980 | Sandy | 44/68 |
| 4,222,746 | 9/1980 | Sweeney et al. | 44/68 |
| 4,233,035 | 11/1980 | Allen et al. | 44/73 |
| 4,248,720 | 2/1981 | Conplain et al. | 252/42.7 |
| 4,251,233 | 2/1981 | Sievers et al. | 44/68 |
| 4,264,335 | 4/1981 | Billo et al. | 44/68 |
| 4,265,639 | 5/1981 | Scholtz | 44/57 |
| 4,266,945 | 5/1981 | Karn | 44/68 |
| 4,283,203 | 8/1981 | Zimmerman | 44/62 |
| 4,286,969 | 9/1981 | Medcalf | 44/53 |
| 4,289,501 | 9/1981 | Medcalf | 44/56 |
| 4,292,186 | 9/1981 | Chibnik et al. | 252/49.7 |
| 4,297,110 | 10/1981 | Feldman | 44/66 |
| 4,313,851 | 2/1982 | Barfuth et al. | 252/431 R |
| 4,328,005 | 5/1982 | Frankel et al. | 44/57 |
| 4,347,062 | 8/1982 | Bain et al. | 44/68 |
| 4,356,002 | 10/1982 | Knepper et al. | 44/62 |
| 4,370,147 | 1/1983 | Kenny et al. | 44/68 |
| 4,378,973 | 4/1983 | Sweeney | 44/56 |
| 4,380,456 | 4/1983 | Taylor | 44/68 |
| 4,389,220 | 6/1983 | Kracklauer | 44/57 |
| 4,404,002 | 9/1983 | Feldman | 44/68 |
| 4,404,408 | 9/1983 | Wirth et al. | 568/680 |
| 4,414,122 | 11/1983 | West et al. | 252/49.7 |
| 4,425,278 | 1/1984 | Wirth et al. | 260/429 R |
| 4,436,535 | 3/1984 | Erdmannsdorfer et al. | 55/96 |
| 4,452,937 | 6/1984 | Keogh | 524/398 |
| 4,474,579 | 10/1984 | Wilderson et al. | 44/57 |
| 4,474,580 | 10/1984 | Mackenzie et al. | 44/68 |
| 4,486,326 | 12/1984 | Gutierrey et al. | 252/49.7 |
| 4,495,156 | 1/1985 | Rohowitz | 427/384 |
| 4,500,439 | 2/1985 | West et al. | 252/46.4 |
| 4,503,672 | 3/1985 | Stack et al. | 60/286 |
| 4,505,718 | 3/1985 | Dorer | 44/66 |
| 4,507,268 | 3/1985 | Kordasky et al. | 423/24 |
| 4,509,956 | 4/1985 | Braid et al. | 44/68 |
| 4,516,990 | 5/1985 | Erdmannsdorfer et al. | 55/96 |
| 4,522,631 | 6/1985 | Mourao et al. | 44/57 |
| 4,536,192 | 10/1985 | Braid et al. | 44/68 |
| 4,552,677 | 11/1985 | Hopkins | 252/33.6 |
| 4,563,256 | 1/1986 | Sudderth et al. | 204/108 |
| 4,568,357 | 2/1986 | Simon | 44/57 |
| 4,612,880 | 9/1986 | Brass et al. | 123/1 A |
| 4,617,408 | 10/1986 | Nestler et al. | 556/40 |
| 4,647,288 | 3/1987 | Dillon | 44/52 |
| 4,655,037 | 4/1987 | Rao | 60/274 |
| 4,664,677 | 5/1987 | Dorer et al. | 44/68 |
| 4,666,458 | 5/1987 | Ueki | 44/56 |
| 4,670,020 | 6/1987 | Rao | 44/57 |
| 4,673,412 | 6/1987 | Stoldt et al. | 44/68 |
| 4,675,027 | 6/1987 | Chibnik | 44/57 |

(List continued on next page.)

OTHER PUBLICATIONS

Chemical Abstract 112:182741d, CA Selects: Fuel and Lubricant Additives, Issue 11, 1990, p. 2.

Federal Register, vol. 55, No. 162, Aug. 21, 1990, Rules and Regulations, pp. 34120–34151.

Stiglic et al, "Emission Testing of Two Heavy Duty Diesel Engines Equipped with Exhaust Aftertreatment", Garrett Automotive Group, Allied Signal Inc., 41st Annual Earthmoving Industry Conference, Apr. 1990.

Wiedemann et al, "Application of Particulate Traps and Fuel Additives for Reduction of Exhaust Emissions", SAE Paper No. 840078, Feb. 27–Mar. 2, 1984.

(List continued on next page.)

U.S. PATENT DOCUMENTS

| | | | |
|---|---|---|---|
| 4,695,293 | 9/1987 | Kessler | 44/68 |
| 4,697,038 | 9/1987 | Tyman | 564/265 |
| 4,705,896 | 11/1987 | Van Der Ply et al. | 564/265 |
| 4,752,302 | 6/1988 | Bowers et al. | 44/68 |
| 4,759,918 | 7/1988 | Homeier et al. | 423/213.5 |
| 4,775,389 | 10/1988 | Sung et al. | 44/63 |
| 4,778,480 | 10/1988 | Mourao et al. | 44/57 |
| 4,810,397 | 3/1989 | Dvoracek | 252/35 |
| 4,813,233 | 3/1989 | Vergur et al. | 60/286 |
| 4,816,038 | 3/1989 | Koch et al. | 44/68 |
| 4,828,733 | 5/1989 | Farng et al. | 252/42.7 |
| 4,836,830 | 6/1989 | Gradeff et al. | 44/57 |
| 4,867,890 | 9/1989 | Colclough et al. | 252/327 E |
| 4,891,050 | 1/1990 | Bowers et al. | 44/67 |
| 4,892,562 | 1/1990 | Bowers et al. | 44/67 |
| 4,908,045 | 3/1990 | Farrer | 44/68 |
| 4,960,895 | 10/1990 | Ohkawa | 546/257 |
| 4,978,788 | 12/1990 | Dalton et al. | 564/265 |
| 5,034,020 | 7/1991 | Epperly et al. | 44/358 |
| 5,087,268 | 2/1992 | Parish | 44/312 |
| 5,113,803 | 5/1992 | Hollrah et al. | 123/1 A |
| 5,124,464 | 6/1992 | Rosenblum et al. | 556/138 |

OTHER PUBLICATIONS

Simon et al, "Diesel Particulate Trap Regeneration Using Ceramic Wall-Flow Traps, Fuel Additives, and Supplemental Electrical Igniters", SAE Paper No. 850016, Feb. 25-Mar. 1, 1985.

Covitch, "Oil Thickening in the Mack T-7 Engine Test. II-Effects of Fuel Composition on Soot Chemistry", SAE Paper No. 880259, Feb. 29-Mar. 4, 1988.

Levin et al, "An Experimental Evaluation to Determine the Effect of an Organometallic Fuel Additive on Particulate Trap Regeneration", SAE Paper No. 900920, Apr. 3-5, 1990.

Pistillo et al, "Lubrication of Low Emission Diesel Engines, Part 3", SAE Paper No. 902178, Oct. 22-25, 1990.

International Search Report for PCT/US92/03179 mailed Oct. 21, 1992.

COPPER-CONTAINING ORGANOMETALLIC COMPLEXES AND CONCENTRATES AND DIESEL FUELS CONTAINING SAME

TECHNICAL FIELD OF THE INVENTION

This invention relates to copper-containing organometallic complexes, and to concentrates and diesel fuels containing said complexes. The diesel fuels are useful with diesel engines equipped with exhaust system particulate traps. The copper-containing organometallic complex is used to lower the ignition temperature of exhaust particles collected in the trap. The copper-containing organometallic complex is soluble or stably dispersible in the diesel fuel and is derived from (i) an organic compound containing at least two functional groups attached to a hydrocarbon linkage, and (ii) a copper-containing metal reactant capable of forming a complex with the organic compound (i). The copper can be combined with one or more metals selected from the group consisting of Na, K, Mg, Ca, Sr, Ba, V, Cr, Mo, Fe, Co, Zn, B, Pb, Sb, Ti, Mn and Zr.

BACKGROUND OF THE INVENTION

Diesel engines have been employed as engines for over-the-road vehicles because of relatively low fuel costs and improved mileage. However, because of their operating characteristics, diesel engines discharge a larger amount of carbon black particles or very fine condensate particles or agglomerates thereof as compared to the gasoline engine. These particles or condensates are sometimes referred to as "diesel soot", and the emission of such particles or soot results in pollution and is undesirable. Moreover, diesel soot has been observed to be rich in condensed, polynuclear hydrocarbons, and some of these have been recognized as carcinogenic. Accordingly, particulate traps or filters have been designed for use with diesel engines that are capable of collecting carbon black and condensate particles.

Conventionally, the particulate traps or filters have been composed of a heat-resistant filter element which is formed of porous ceramic or metal fiber and an electric heater for heating and igniting carbon particulates collected by the filter element. The heater is required because the temperatures of the diesel exhaust gas under normal operating conditions are insufficient to burn off the accumulated soot collected in the filter or trap. Generally, temperatures of about 450°–600° C. are required, and the heater provides the necessary increase of the exhaust temperature in order to ignite the particles collected in the trap and to regenerate the trap. Otherwise, there is an accumulation of carbon black, and the trap is eventually plugged causing operational problems due to exhaust back pressure buildup. The above-described heated traps do not provide a complete solution to the problem because the temperature of the exhaust gases is lower than the ignition temperature of carbon particulates while the vehicle runs under normal conditions, and the heat generated by the electric heater is withdrawn by the flowing exhaust gases when the volume of flowing exhaust gases is large. Alternatively, higher temperatures in the trap can be achieved by periodically enriching the air/fuel mixture burned in the diesel engine thereby producing a higher exhaust gas temperature. However, higher temperatures can cause run-away regeneration leading to high localized temperatures which can damage the trap.

It also has been suggested that the particle build-up in the traps can be controlled by lowering the ignition temperature of the particulates so that the particles begin burning at the lowest possible temperatures. One method of lowering the ignition temperature involves the addition of a combustion improver to the exhaust particulate, and the most practical way to effect the addition of the combustion improver to the exhaust particulate is by adding the combustion improver to the fuel. Copper compounds have been suggested as combustion improvers for fuels including diesel fuels.

The U.S. Environmental Protection Agency (EPA) estimates that the average sulfur content of on-highway diesel fuel is approximately 0.25% by weight and has required this level be reduced to no more than 0.05% by weight by Oct. 1, 1993. The EPA has also required that this diesel fuel have a minimum cetane index specification of 40 (or meet a maximum aromatics level of 35%). The objective of this rule is to reduce sulfate particulate and carbonaceous and organic particulate emissions. See, Federal Register, Vol. 55, No. 162, Aug. 21, 1990, pp. 34120–34151. Low-sulfur diesel fuels and technology for meeting these emission requirements have not yet been commercially implemented. One approach to meeting these requirements is to provide a low-sulfur diesel fuel additive that can be effectively used in a low-sulfur diesel fuel environment to reduce the ignition temperatures of soot that is collected in the particulate traps of diesel engines.

U.S. Pat. No. 3,346,493 discloses lubricating compositions containing metal complexes made of the reaction products of hydrocarbon-substituted succinic acid (e.g., polyisobutylene-substituted succinic anhydride) compounds and alkylene amines (e.g., polyalkylene polyamines), the complexes being formed by reacting at least about 0.1 equivalent of a complex-forming metal compound with the reaction products. The metals are those having atomic numbers from 24 to 30 (i.e., Cr, Mn, Fe, Co, Ni, Cu and Zn).

U.S. Pat. No. 4,673,412 discloses fuel compositions (e.g., diesel fuels, distillate fuels, heating oils, residual fuels, bunker fuels) containing a metal compound and an oxime. The reference indicates that fuels containing this combination are stable upon storage and effective in reducing soot formation in the exhaust gas of an internal combustion engine. A preferred metal compound is a transition metal complex of a Mannich base, the Mannich base being derived from (A) an aromatic phenol, (B) an aldehyde or a ketone, and (C) a hydroxyl- and/or thiol-containing amine. Desirable metals are identified as being Cu, Fe, Zn, Co, Ni and Mn.

U.S. Pat. No. 4,816,038 discloses fuel compositions (e.g., diesel fuels, distillate fuels, heating oils, residual fuels, bunker fuels) containing the reaction product of a transition metal complex of a hydroxyl- and/or thiol-containing aromatic Mannich with a Schiff base. The reference indicates that fuels containing this combination are stable upon storage and effective in reducing soot formation in the exhaust gas of an internal combustion engine. The Mannich is derived from (A) a hydroxyl- and/or thiol-containing aromatic, (B) an aldehyde or a ketone, and (C) a hydroxyl- and/or thiol-containing amine. Desirable metals are identified as being Cu, Fe, Zn and Mn.

International Publication No. WO 88/02392 discloses a method for operating a diesel engine equipped with an exhaust system particulate trap to reduce the build-up of exhaust particles collected in the trap. The method comprises operating the diesel engine with a fuel containing an effective amount of a titanium or zirconium compound or complex to lower the ignition temperature of the exhaust particulates collected in the trap.

SUMMARY OF THE INVENTION

This invention relates to copper-containing organometallic complexes, and to concentrates and diesel fuels containing said complexes. The diesel fuels are useful with diesel engines equipped with exhaust system particulate traps. The copper-containing organometallic complex is used for lowering the ignition temperature of exhaust particles collected in the trap. The copper-containing organometallic complex is soluble or stably dispersible in the diesel fuel and is derived from (i) an organic compound containing at least two functional groups attached to a hydrocarbon linkage, and (ii) a copper-containing metal reactant capable of forming a complex with the organic compound (i). The functional groups are =X, —XR, —$NR_2$, —$NO_2$, =NR, =NXR, =N—R*—XR, $$-\underset{\underset{R}{|}}{N}-\underset{\underset{R}{|}}{(R^*N)_a}-R,\ -\underset{\underset{XR}{|}}{P(X)}XR,\ -\underset{\underset{R}{|}}{P(X)}XR$$

—CN, —N=NR or —N=$CR_2$; wherein X is O or S, R is H or hydrocarbyl, R* is hydrocarbylene or hydrocarbylidene, and a is a number (e.g., zero to about 10). The copper can be combined with one or more metals selected from the group consisting Na, K, Mg, Ca, Sr, Ba, V, Cr, Mo, Fe, Co, Zn, B, Pb, Sb, Ti, Mn and Zr. This invention is also directed to methods of operating a diesel engine equipped with an exhaust system particulate trap using the foregoing diesel fuel.

DESCRIPTION OF THE PREFERRED EMBODIMENTS

The term "hydrocarbyl" and cognate terms such as "hydrocarbylene", "hydrocarbylidene", "hydrocarbon-based", etc, denote a chemical group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based", "aryl-based", and the like have meanings analogous to the above with respect to alkyl groups, aryl groups and the like.

The term "lower" as used herein in conjunction with terms such as hydrocarbyl, alkyl, alkenyl, alkoxy, and the like, is intended to describe such groups which contain a total of up to 7 carbon atoms.

The aromatic groups which are referred to in this specification and in the appended claims relative to the structure of the organometallic complexes of this invention, and in some instances are represented by "Ar" in formulae that are provided herein, can be mononuclear, such as phenyl, pyridyl, thienyl, or polynuclear. The polynuclear groups can be of the fused type wherein an aromatic nucleus is fused at two points to another nucleus such as found in naphthyl, anthranyl, azanaphthyl, etc. The polynuclear group can also be of the linked type wherein at least two nuclei (either mononuclear or polynuclear) are linked through bridging linkages to each other. These bridging linkages can be chosen from the group consisting of carbon-to-carbon single bonds, ether linkages, keto linkages, sulfide linkages, polysulfide linkages of 2 to about 6 sulfur atoms, sulfinyl linkages, sulfonyl linkages, alkylene linkages, alkylidene linkages, lower alkylene ether linkages, alkylene keto linkages, lower alkylene sulfur linkages, lower alkylene polysulfide linkages of 2 to about 6 carbon atoms, amino linkages, polyamino linkages and mixtures of such divalent bridging linkages. In certain instances, more than one bridging linkage can be present between two aromatic nuclei; for example, a fluorene nucleus having two benzene nuclei linked by both a methylene linkage and a covalent bond. Such a nucleus may be considered to have three nuclei but only two of them are aromatic. Normally, however, the aromatic group will contain only carbon atoms in the aromatic nuclei per se (plus any alkyl or alkoxy substituent present).

The aromatic group can be a single ring aromatic group represented by the formula $$ar(Q)_m$$

wherein ar represents a single ring aromatic nucleus (e.g., benzene) of 4 to 10 carbons, each Q independently represents a lower alkyl group, lower alkoxy group or nitro group, and m is 0 to 4. Specific examples of when the aromatic group is a single ring aromatic group include the following:

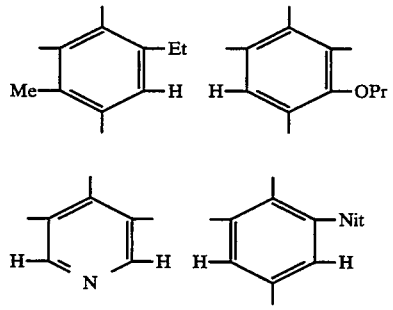

-continued

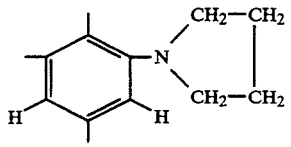

etc., wherein Me is methyl, Et is ethyl, Pr is propyl, and Nit is nitro.

When the aromatic group is a polynuclear fused-ring aromatic group, it can be represented by the general formula $$ar\langle ar\rangle_{m'},(Q)_{mm'}$$

wherein ar, Q and m are as defined hereinabove, m' is 1 to 4 and ⊂ represent a pair of fusing bonds fusing two rings so as to make two carbon atoms pan of the rings of each of two adjacent rings. Specific examples of when the aromatic group is a fused ring aromatic group include:

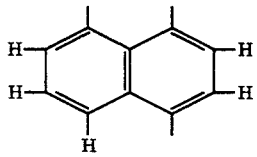

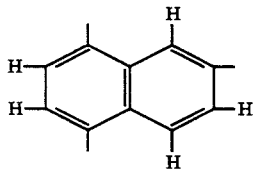

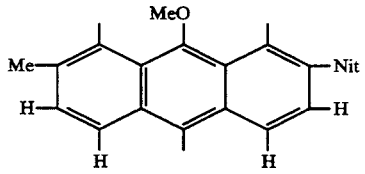

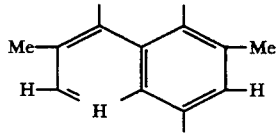

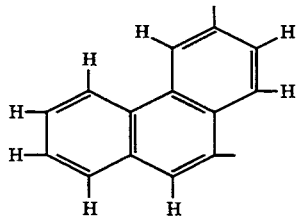

-continued

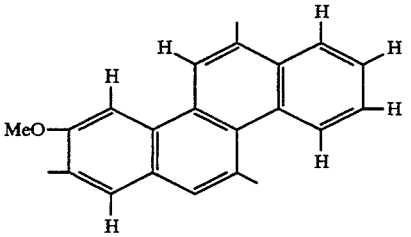

When the aromatic group is a linked polynuclear aromatic group it can be represented by the general formula $$ar\langle Lng\text{-}ar\rangle_{w}(Q)_{mw}$$

wherein w is a number of 1 to about 20, ar is as described above with the proviso that there are at least two unsatisfied (i.e., free) valences in the total of ar groups, Q and m are as defined hereinbefore, and each Lng is a bridging linkage individually chosen from the group consisting of carbon-to-carbon single bonds, ether linkages (e.g., —O—), keto linkages (e.g., $$-\overset{O}{\overset{\|}{C}}-),$$

sulfide linkages (e.g., —S—), polysulfide linkages of 2 to 6 sulfur atoms (e.g., $-S-_{2\text{-}6}$), sulfinyl linkages (e.g., —S(O)—), sulfonyl linkages (e.g., $-S(O)_2-$), lower alkylene linkages (e.g., $$-CH_2-,\ -CH_2-CH_2-,\ -CH_2-\underset{R^\circ}{CH}-,$$

etc.), di(lower alkyl)-methylene linkages (e.g., $CR_{2\cdot}$—), lower alkylene ether linkages (e.g., $$-CH_2O-,\ -CH_2O-CH_2-,\ -CH_2-CH_2-O-,$$

$$-CH_2CH_2OCH_2CH_2-,\ -CH_2\underset{R^\circ}{CH}OCH_2\underset{R^\circ}{CH}-$$

$$-CH_2\underset{R^\circ}{CH}O\underset{R^\circ}{CH}CH_2-,$$

etc.), lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $-S-_{2\text{-}6}$ group), amino linkages (e.g., $$-\underset{H}{N}-,\ -\underset{R^\circ}{N}-,\ -CH_2N-,\ -CH_2NCH_2-,\ -alk-\underset{|}{N}-,$$

where alk is lower alkylene, etc.), polyamino linkages (e.g., $$-\underset{|}{N}(alk\ \underset{|}{N})_{1\text{-}10}$$

where the unsatisfied free N valences are taken up with H atoms or R· groups), and mixtures of such bridging linkages (each R· being a lower alkyl group). It is also possible that one or more of the ar groups in the above-linked aromatic group can be replaced by fused nuclei such as ar{ar}m'. Specific examples of when the aromatic group is a linked polynuclear aromatic group include:

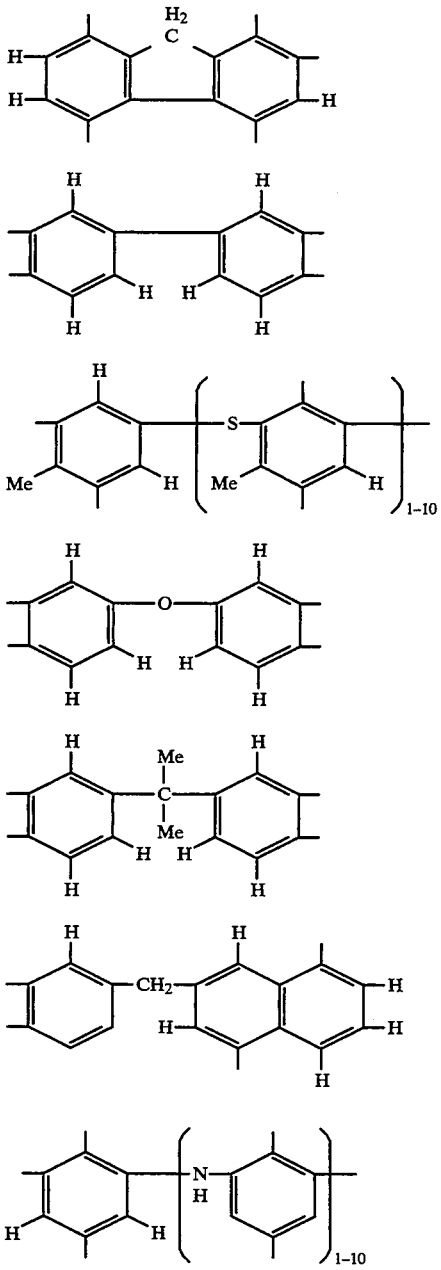

For such reasons as cost, availability, performance, etc., the aromatic group is normally a benzene nucleus, lower alkylene bridged benzene nucleus, or a naphthalene nucleus.

Organometallic Complexes

The organometallic complexes of the invention are derived from (i) an organic compound containing at least two functional groups attached to a hydrocarbon linkage, and (ii) a metal reactant capable of forming a complex with component (i). These complexes are soluble or stably dispersible in diesel fuel. The complexes that are soluble in diesel fuel are soluble to the extent of at least one gram per liter at 25° C. The complexes that are stably dispersible or stably dispersed in diesel fuel remain dispersed in said diesel fuel for at least about 24 hours at 25° C.

Component (i)

The organic compound (i) can be referred to as a "metal chelating agent" which is the accepted terminology for a well-known class of chemical compounds which have been described in several texts including *Chemistry of the Metal Chelate Compounds*, by Martell and Calvin, Prentice-Hall, Inc., N.Y. (1952). Component (i) is an organic compound that contains a hydrocarbon linkage and at least two functional groups. The same or different functional groups can be used in component (i). These functional groups include =X, —XR, $$-NR_2,\ -NO_2,\ =NR,\ =NXR,\ =N-R^*-XR,$$

$$-\underset{R}{\underset{|}{N}}-(R^*\underset{R}{\underset{|}{N}})_a-R,\ -\underset{R}{\underset{|}{P}}(X)XR,\ -\underset{XR}{\underset{|}{P}}(X)XR,\ -N=CR_2,$$

$$-CN \text{ and } -N=NR,$$

wherein

X is O or S,

R is H or hydrocarbyl,

R* is hydrocarbylene or hydrocarbylidene, and a is a number preferably ranging from zero to about 10.

Preferred functional groups are =X, —OH, —$NR_2$, —$NO_2$, =NR, =NOH, $$-\underset{R}{\underset{|}{N}}-(R^*\underset{R}{\underset{|}{N}})_aR$$

and —CN. In one embodiment the functional groups are on different carbon atoms of the hydrocarbon linkage. In one embodiment the functional groups are in vicinal or beta position relative to each other.

Component (i) is other than a monocarboxylic acid or a dicarboxylic acid unless said acid also contains one or more of the above-indicated functional groups other than the =O and —OH of the acid groups (i.e., —COOH) of said acids.

Component (i) is other than an aromatic Mannich derived from a hydroxyl- and/or thiol-containing aromatic compound, an aldehyde or ketone, and a hydroxyl- and/or thiol-containing amine.

Component (i) is other than a high temperature aromatic Mannich prepared from a phenol, an aldehyde, and a polyamine at a temperature above about 130° C.

Component (i) is other than the product made by the reaction of a hydrocarbon-substituted succinic acid compound having at least 50 aliphatic carbon atoms in the hydrocarbon substituent with an alkylene amine.

Component (i) is other than a salicylaldehyde, a hydroxyaromatic Schiff base, a malonaldehyde-dinitroanil, or a beta-diketone.

The inventive organometallic complex is other than copper dihydrocarbyl thiophosphate, copper dihydrocarbyl dithiophosphate, copper dithiocarbamate, copper sulphonate, copper phenate or copper acetyl acetonate.

In one embodiment component (i) is a compound represented by the formula:

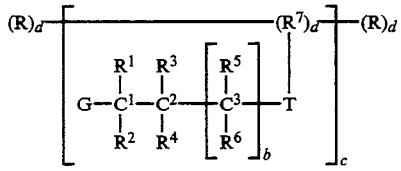

(I)

wherein in Formula (I):

b is a number ranging from zero to about 10, preferably zero to about 6, more preferably zero to about 4, more preferably zero to about 2;

c is a number ranging from 1 to about 1000, or 1 to about 500, or 1 to about 250, or preferably 1 to about 100, or 1 to about 50;

d is zero or one;

when c is greater than 1, d is 1;

each R is independently H or a hydrocarbyl group;

$R^1$ is a hydrocarbyl group or G;

$R^2$ and $R^4$ are, independently, H, hydrocarbyl groups, or can together form a double bond between $C^1$ and $C^2$;

$R^3$ is H, a hydrocarbyl group or G;

$R^1$, $R^2$, $R^3$ and $R^4$ can together form a triple bond between $C^1$ and $C^2$;

$R^1$ and $R^3$ can together with $C^1$ and $C^2$ form an alicyclic, aromatic, heterocyclic, alicyclic-heterocyclic, alicyclic-aromatic, heterocyclic-aromatic, heterocyclic-alicyclic, aromatic-alicyclic or aromatic-heterocyclic group; or a hydrocarbyl-substituted alicyclic, hydrocarbyl-substituted aromatic, hydrocarbyl-substituted heterocyclic, hydrocarbyl-substituted alicyclic-heterocyclic, hydrocarbyl-substituted alicyclic-aromatic, hydrocarbyl-substituted heterocyclic-aromatic, hydrocarbyl-substituted heterocyclic-alicyclic, hydrocarbyl-substituted aromatic-alicyclic or hydrocarbyl-substituted aromatic-heterocyclic group;

each $R^5$ and each $R^6$ is, independently, H, a hydrocarbyl group or G;

$R^7$ is a hydrocarbylene or hydrocarbylidene group;

each G is, independently, =X, —XR, —$NR_2$, —$NO_2$, —$R^8$XR, —$R^8NR_2$, —$R^8NO_2$, —C(R)=X, —$R^8$C(R)=X, —C(R)=NR, —$R^8$C=NR, —C=NXR, —$R^8$C(R)=NXR, —C(R)=N—$R^9$—XR, —$R^8$—C(R)=N—$R^9$—XR, —N(R)—$(R^9N)_e$—R, —$R^8$—N(R)—$(R^9N)_e$—R,

—P(X)(R)XR, —P(X)(XR)XR, —$R^8$—P(X)(R)XR,

—$R^8$—P(X)(XR)XR, —N=$CR_2$, —$R^8$N=$CR_2$,

—CN, —$R^8$CN, —N=NR or —$R^8$N=NR;

when d is zero, T is =X, —XR, —$NR_2$, —$NO_2$, —C(R)=X, —C(R)=NR, —C(R)=NXR, —C(R)=N—$R^9$—XR, —N(R)—$(R^9N)_e$—R, —P(X)(R)XR, —P(X)(XR)XR, —N=$CR_2$, =NXR, —N($R^{10}$)—Q, —CN, —N=NR or —N(R)—$(R^9N)_e$—Q;

when d is one, T is —X—, —NR—,

—C(X)—, —C(NR)—, —C(N—)R, —C(NXR)—, —C(NX—)R, —C(N—$R^9$—XR)—,

—C(N—$R^9$—X—)R, —N(R)—$(R^9N)_e$R, —N(R)—$(R^9N)_e$—, —P(X)(R)XR,

—P(X)(R)X—, —P(X)(XR)X— or —P(X)(XR)XR;

G and T together with $C^1$ and $C^2$ can form the group

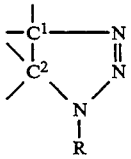

X is O or S;

each e is independently a number ranging from zero to about 10, preferably 1 to about 6, more preferably 1 to about 4;

each $R^8$ is a hydrocarbylene or hydrocarbylidene group, hydroxy-substituted hydrocarbylene or hydrocarbylidene group, or amine-substituted hydrocarbylene or hydrocarbylidene group;

each $R^9$ is hydrocarbylene or hydrocarbylidene group;

$R^{10}$ is H, a hydrocarbyl group or a hydroxy-substituted hydrocarbyl group;

Q is a group represented by the formula

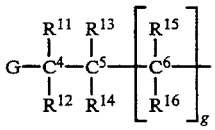

g is a number ranging from zero to about 10, preferably zero to about 6, more preferably zero to about 4, more preferably zero to about 2;

$R^{11}$ is a hydrocarbyl group or G;

$R^{12}$ and $R^{14}$ are, independently, H, hydrocarbyl groups, or can together form a double bond between $C^4$ and $C^5$;

$R^{13}$ is H, a hydrocarbyl group or G;

$R^{11}$, $R^{12}$, $R^{13}$ and $R^{14}$ can together form a triple bond between $C^4$ and $C^5$;

$R^{11}$ and $R^{13}$ can together with $C^4$ and $C^5$ form an alicyclic, aromatic, heterocyclic, alicyclic-heterocyclic, alicyclic-aromatic, heterocyclic-aromatic, heterocyclic-alicyclic, aromatic-alicyclic or aromatic-heterocyclic group; or a hydrocarbyl-substituted alicyclic, hydrocarbyl-substituted aromatic, hydrocarbyl-substituted heterocyclic, hydrocarbyl-substituted alicyclic-heterocyclic, hydrocarbyl-substituted alicyclic-aromatic, hydrocarbyl-substituted heterocyclic-aromatic, hydrocarbyl-substituted heterocyclic-alicyclic, hydrocarbyl-substituted aromatic-alicyclic or hydrocarbyl-substituted aromatic-heterocyclic group; and each $R^{15}$ and each $R^{16}$ is, independently, H, a hydrocarbyl group or G.

R, $R^1$, $R^3$, $R^{11}$ and $R^{13}$ are independently hydrocarbyl groups of preferably up to about 250 carbon atoms, more preferably up to about 200 carbon atoms, more preferably up to about 150 carbon atoms, more preferably up to about 100 carbon atoms, more preferably up to about 50 carbon atoms, more preferably up to about 30 carbon atoms. R, $R^3$ and $R^{13}$ Call also be H. Either or both of $R^1$ and $R^3$ can be G.

$R^2$, $R^4$, $R^5$, $R^6$, $R^{12}$, $R^{14}$, $R^{15}$ and $R^{16}$ are independently H or hydrocarbyl groups of preferably up to about 20 carbon atoms, more preferably up to about 12 carbon atoms, more preferably up to about 6 carbon atoms.

$R^7$, $R^8$ and $R^9$ are independently hydrocarbylene or hydrocarbylidene groups, preferably alkylene or alkylidene groups, more preferably alkylene groups of preferably up to about 40 carbon atoms, more preferably up to about 30 carbon atoms, more preferably up to about 20 carbon atoms, more preferably up to about 10 carbon atoms, more preferably from about 2 to about 6 carbon atoms, more preferably from about 2 to about 4 carbon atoms.

$R^{10}$ is H, or a hydrocarbyl group or a hydroxy-substituted hydrocarbyl group of preferably up to about 200 carbon atoms, more preferably up to about 100 carbon atoms, more preferably up to about 50 carbon atoms, more preferably up to about 30 carbon atoms, more preferably up to about 10 carbon atoms.

G is preferably $=X$, $-XR$, $-NR_2$, $-NO_2$, $-C(R)=X$, $-C(R)=NR$, $-C(R)=NXR$, $-N=CR_2$ or $-R^8N=CR_2$.

When d is zero, T is preferably $=X$, $-XR$, $-NR_2$, $-NO_2$, $-C(R)=X$, $-C(R)=NR$, $-C(R)=NXR$, $-N=CR_2$, $-N(R^{10})-Q$ or $$-\underset{\underset{R}{|}}{N}(R^9\underset{\underset{R}{|}}{N})_eR.$$

When d is one, T is preferably —X—, —NR—, $$-\underset{\underset{X}{\|}}{C}-,\quad -\underset{\underset{NR}{\|}}{C}-,\quad -\underset{\underset{N-}{\|}}{CR},\quad -\underset{\underset{NXR}{\|}}{C}-,\quad -\underset{\underset{NX-}{\|}}{CR},$$

$$-\underset{\underset{R}{|}}{N}(R^9\underset{\underset{R}{|}}{N})_eR \quad \text{or} \quad -\underset{\underset{R}{|}}{N}(R^9\underset{\underset{R}{|}}{N})_e-.$$

In one embodiment $R^9$ is other than ethylene when G is —OH. In one embodiment G and T are other than $-NO_2$. In one embodiment component (i) is other an N, N'-di-(3-alkenyl salicylidene)-diaminoalkane. In one embodiment component (i) is other than N,N'-disalicylidene-1,2-ethanediamine.

In one embodiment, component (i) is a compound represented by the formula

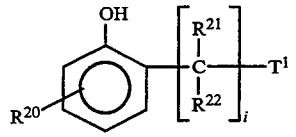

(II)

In Formula (II), i is a number ranging from zero to about 10, preferably 1 to about 8. $R^{20}$ is H or a hydrocarbyl group of preferably up to about 200 carbon atoms, more preferably up to about 150 carbon atoms, more preferably up to about 100 carbon atoms, more preferably from about 10 to about 60 carbon atoms. $R^{21}$ and $R^{22}$ are independently H or hydrocarbyl groups of up to about 40 carbon atoms, more preferably up to about 20 carbon atoms, more preferably up to about 10 carbon atoms. $T^1$ is $-XR$, $-NR_2$, $-NO_2$, $-CN$, $-C(R)=X$, $-C(R)=NR$, $-C(R)=NXR$, $-N=CR_2$, $-N(R^{10})-Q$ or $$-\underset{\underset{R}{|}}{N}(R^9\underset{\underset{R}{|}}{N})_eR.$$

R, X, Q, $R^9$, $R^{10}$ and e are as defined above with respect to Formula (I).

Component (i) can be selected from a wide variety of organic compounds containing two or more of the functional groups discussed above. These include aromatic Mannichs, hydroxyaromatic ketoximes, Schiff bases, calixarenes, β-substituted phenols, α-substituted phenols, carboxylic acid esters, acylated amines, hydroxyazylenes, benzotriazoles, amino acids, hydroxamic acids, linked phenolic compounds, aromatic difunctional compounds, xanthates, formazyls, pyridines, borated acylated amines, phosphorus-containing acylated amines, pyrrole derivatives, porphyrins, and EDTA derivatives.

(1) Aromatic Mannichs

In one embodiment component (i) is an aromatic Mannich derived from a hydroxy and/or thiol containing aromatic compound, an aldehyde or ketone, and an amine. These aromatic Mannichs are preferably the reaction product of (A-1) a hydroxy and/or thiol-containing aromatic compound having the formula $$(R^1)_n-\overset{\overset{R^2}{|}}{Ar}-(XH)_m \qquad \text{(A-1)}$$

wherein in Formula (A-1) Ar is an aromatic group; m is 1, 2 or 3; n is a number from 1 to about 4; each $R^1$ independently is H or a hydrocarbyl group having from 1 to about 100 carbon atoms; and $R^2$ is H, amino or carboxyl; and X is O, S, or both when m is 2 or greater;

(A-2) an aldehyde or ketone having the formula $$R^3-\overset{\overset{O}{\|}}{C}-R^4 \qquad \text{(A-2)}$$

or a precursor thereof; wherein in Formula (A-2) $R^3$ and $R^4$ independently are H, saturated hydrocarbyl groups having from 1 to about 18 carbon atoms, and $R^4$ can also be a carbonyl-containing hydrocarbyl group having from 1 to about 18 carbon atoms; and (A-3) an amine which contains at least one primary or secondary amino group, said amine being characterized by the absence of hydroxyl and/or thiol groups, said reaction between components (A-1), (A-2) and (A-3) being conducted at a temperature below about 120° C.

In Formula (A-1) Ar can be a benzene or a naphthalene nucleus. Ar can be a coupled aromatic compound, the coupling agent preferably being O, S, $CH_2$, a lower alkylene group having from 1 to about 6 carbon atoms, NH, and the like, with $R^1$ and XH generally being pendant from each aromatic nucleus. Examples of specific coupled aromatic compounds include diphenylamine, diphenylmethylene and the like. m is usually from 1 to 3, desirably 1 or 2, with 1 being preferred. n is usually from 1 to 4, desirably 1 or 2, with 1 being preferred. X is 0 and/or S with 0 being preferred. If m is 2, X can be both 0, both S, or one 0 and one S. $R^1$ is a hydrocarbyl group of preferably up to about 250 carbon atoms, more preferably up to about 150 carbon atoms, more preferably up to about 100 carbon atoms, more preferably up to about 50 carbon atoms, more preferably up to about 30 carbon atoms. $R^1$ can be an alkyl group containing up to about 100 carbon atoms, more preferably about 4 to about 20 carbon atoms, more preferably about 7 to about 12 carbon atoms. $R^1$ can be a mixture of alkyl groups, each alkyl group having from 1 to about 70 carbon atoms, more preferably from about 4 to about 20 carbon atoms. $R^1$ can be an alkenyl group preferably having from 2 to about 30 carbon atoms, more preferably from about 8 to about 20 carbon atoms. $R^1$ can be a cycloalkyl group having from 4 to about 10 carbon atoms, an aromatic group having from about 6 to about 30 carbon atoms, an aromatic-substituted alkyl group or alkyl-substituted aromatic group having a total of from about 7 to about 30 carbon atoms, preferably from about 7 to about 12 carbon atoms. $R^1$ is preferably an alkyl group preferably having from about 4 to about 20 carbon atoms, preferably about 7 to about 12 carbon atoms. Examples of suitable hydrocarbyl-substituted hydroxyl-containing aromatics (A-1) include the various naphthols, and more preferably, the various alkyl-substituted catechols, resorcinols, and hydroquinones, the various xylenols, the various cresols, aminophenols, and the like. Specific examples include heptylphenol, octylphenol, nonylphenol, decylphenol, dodecylphenol, propylene tetramerphenol, eicosylphenol, and the like. Dodecylphenol, propylene tetramerphenol and heptylphenol are preferred. Examples of suitable hydrocarbyl-substituted thiol-containing aromatics include heptylthiophenol, octylthiophenol, nonylthiophenol, dodecylthiophenol, propylene tetramerthiophenol, and the like. Examples of suitable thiol and hydroxyl-containing aromatics include dodecylmonothioresorcinol.

In Formula (A-2) $R^3$ and $R^4$ are independently H, hydrocarbyl groups, preferably alkyl, containing preferably up to about 18 carbon atoms, more preferably up to about 6 carbon atoms, more preferably 1 or 2 carbon atoms. $R^3$ and $R^4$ can be independently phenyl or alkyl-substituted phenyl having preferably up to about 18 carbon atoms, more preferably up to about 12 carbon atoms. Examples of suitable aldehydes and ketones (A-2) include formaldehyde, acetaldehyde, propionaldehyde, butyraldehyde, valeraldehyde, benzaldehyde, and the like, as well as acetone, methyl ethyl ketone, ethyl propyl ketone, butyl methyl ketone, glyoxal, glyoxylic acid, and the like. Precursors of such compounds which react as aldehydes under reaction conditions of the present invention can also be utilized and include paraformaldehyde, formalin, trioxane and the like. Formaldehyde and its polymers, for example, paraformaldehyde are preferred. Mixtures of the various (A-2) reactants can be utilized.

The third reactant used in preparing the aromatic Mannich is (A-3) an amine which contains at least one primary or secondary group. Thus the amine is characterized by the presence of at least one >N—H group. The remaining valences of the above nitrogen atom preferably are satisfied by hydrogen, amino, or organic groups bonded to said nitrogen atom through direct carbon-to-nitrogen linkages. The amine (A-3) may be represented by the formula

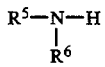

(A-3-1)

In Formula (A-3-1), $R^5$ is a hydrocarbyl group, amino-substituted hydrocarbyl, or alkoxy-substituted hydrocarbyl group. $R^6$ is H or $R^5$. Thus, the compounds from which the nitrogen-containing group may be derived include principally ammonia, aliphatic amines, aromatic amines, heterocyclic amines, or carboxylic amines. The amines may be primary or secondary amines and may also be polyamines such as alkylene amines, arylene amines and cyclic polyamines. Examples include methylamine, N-methyl-ethylamine, N-methyloctylamine, N-cyclohexylaniline, dibutylamine, cyclohexylamine, aniline, di(p-methyl)amine, dodecylamine, octadecylamine, o-phenylenediamine, N, N'-di-n-butyl-p-phenylenediamine, morpholine, piperazine, tetrahydropyrazine, indole, hexahydro-1,3,5-triazine, 1-H-1,2,4-triazole, melamine, bis-(p-aminophenyl)methane, phenyl-methylenimine, menthanediamine, cyclohexamine, pyrrolidine, 3-amino-5,6-diphenyl-1,2,4triazine, quinonediimine, 1,3-indandiimine, 2-octadecylimidazoline, 2-phenyl-4methyl-imidazolidine, oxazolidine, and 2-heptyl-oxazolidine.

The amine (A-3) can be a polyamine represented by the formula

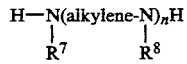

(A-3-2)

In Formula (A-3-2), n is a number in the range of zero to about 10, more preferably about 2 to about 7. $R^7$ and $R^8$ are independently H or hydrocarbyl groups, of up to about 30 carbon atoms. The "alkylene" group preferably contains up to about 10 carbon atoms, with methylene, ethylene and propylene being preferred. These alkylene amines include methylene amines, ethylene amines, butylene amines, propylene amines, pentylene amines, hexylene amines, heptylene amines, octylene amines, other polymethylene amines, and also the cyclic and the higher homologues of such amines such as piperazines and amino-alkyl-substituted piperazines. They are exemplified specifically by: ethylene diamine, triethylene tetramine, propylene diamine, decamethylene diamine, octamethylene diamine, di(heptamethylene)-triamine, tripropylene tetramine, tetraethylene pentamine, trimethylene diamine, pentaethylene hexamine, di(trimethylene)-triamine, 2-heptyl-3-(2-aminopropyl- )imidazoline, 4-methyl-imidazoline, 1,3-bis(2-aminoethyl)imidazoline, pyrimidine, 1-(2-aminopropyl)piperazine. 1,4-bis(2-aminoethyl)piperazine, and 2-methyl-1-(2-aminobutyl)piperazine. Higher homologues such as are obtained by condensing two or more of the above-illustrated alkylene amines likewise are useful.

Higher homologues such as are obtained by condensation of the above-illustrated alkylene amines through amino groups are likewise useful as the reactant (A-3). It will be appreciated that condensation through amino groups results in a higher amine accompanied with removal of ammonia.

The preparation of the aromatic Mannichs can be carried out by a variety of methods known in the art. One method involves adding the (A-1) hydroxyl and/or thiol-containing aromatic compound, the (A-2) aldehyde or ketone, and the (A-3) amine compound to a suitable vessel and heating to carry out the reaction. Reaction temperatures from about ambient up to about 120° C. can be utilized. During reaction, water is drawn off as by sparging. Desirably, the reaction is carried out in solvent such as an aromatic type oil. The amount of the various reactants utilized is desirably on a mole to mole basis of (A-1) and (A-2) for each (A-3) secondary amino group or on a two-mole basis of (A-1) and (A-2) for each (A-3) primary amino group, although larger or smaller amounts can also be utilized.

In another method of preparing the aromatic Mannichs, the hydroxyl and/or thiol-containing aromatic compound (A-1) and the amine compound (A-3) are added to a reaction vessel. The aldehyde or ketone (A-2) is generally rapidly added and the exothermic reaction generated is supplemented by mild heat such that the reaction temperature is from about 60° C. to about 90° C. Desirably the addition temperature is less than the boiling point of water, otherwise, the water will bubble off and cause processing problems. After the reaction is essentially complete, the water by-product is removed in any conventional manner as by evaporation thereof which can be achieved by applying a vacuum, applying a sparge, heating or the like. A nitrogen sparge is often utilized at a temperature of from about 100° C. to about 120° C. Lower temperatures can be utilized.

In one embodiment component (i) is an aromatic Mannich represented by the formula

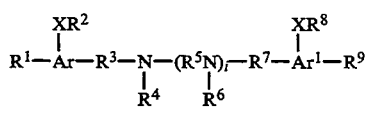

(III)

In Formula (III), Ar and $Ar^1$ are aromatic groups, preferably benzene nuclei or naphthalene nuclei, more preferably benzene nuclei. $R^1$, $R^2$, $R^4$, $R^6$, $R^8$ and $R^9$ are independently H or aliphatic hydrocarbyl groups of preferably up to about 250 carbon atoms, more preferably up to about 200 carbon atoms, more preferably up to about 150 carbon atoms, more preferably up to about 100 carbon atoms, more preferably to about 50 carbon atoms, more preferably up to about 30 carbon atoms. $R^4$ can be a hydroxy-substituted aliphatic hydrocarbyl group. $R^3$, $R^5$ and $R^7$ are independently hydrocarbylene or hydrocarbylidene groups, preferably alkylene or alkylidene groups, more preferably alkylene groups of preferably up to about 40 carbon atoms, more preferably up to about 30 carbon atoms, more preferably up to about 20 carbon atoms, more preferably up to about 10 carbon atoms, more preferably up to about 6 carbon atoms, more preferably up to about 4 carbon atoms. X is O or S, preferably O. i is a number that is 5 or higher, preferably ranging from 5 to about 10, more preferably 5 to about 7. In one embodiment, i is 5 or higher, Ar and $Ar^1$ are benzene nuclei, $XR^2$ and $XR^8$ are OH, and $R^5$ is ethylene.

In one embodiment component (i) is an aromatic Mannich represented by the formula:

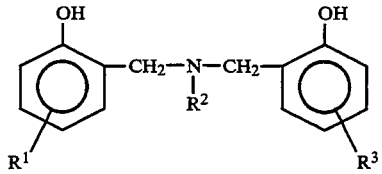

(IV)

In Formula (IV), $R^1$ and $R^3$ are independently H or aliphatic hydrocarbyl groups of preferably up to about 200 carbon atoms, more preferably up to about 100 carbon atoms, more preferably up to about 50 carbon atoms, more preferably up to about 30 carbon atoms, more preferably up to about 20 carbon atoms. $R^2$ is a hydrocarbyl of preferably up to about 40 carbon atoms, more preferably up to about 30 carbon atoms, more preferably up to about 20 carbon atoms, more preferably up to about 10 carbon atoms, more preferably up to about 6 carbon atoms, more preferably up to about 4 carbon atoms. In one embodiment, $R^1$ and $R^3$ are in the ortho position relative to the OH groups and are each alkyl groups of about 6 to about 18 carbon atoms, more preferably about 10 to about 14 carbon atoms, more preferably about 12 carbon atoms, and $R^2$ is butyl.

In one embodiment component (i) is an aromatic Mannich represented by the formula

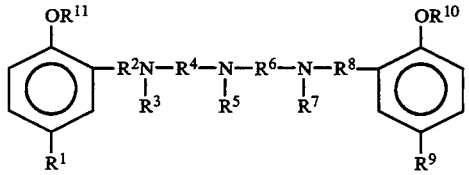

(V)

In Formula (V) , $R^1$, $R^3$, $R^5$, $R^7$, $R^9$, $R^{10}$ and $R^{11}$ are independently H or aliphatic hydrocarbyl groups of preferably up to about 200 carbon atoms, more preferably up to about 100 carbon atoms, more preferably up to about 50 carbon atoms, more preferably up to about 30 carbon atoms. $R^2$ and $R^8$ are independently hydrocarbylene or hydrocarbylidene groups, preferably alkylene or alkylidene groups, more preferably alkylene groups of up to about 20 carbon atoms, more preferably up to about 10 carbon atoms, more preferably up to about 6 carbon atoms, more preferably up to about 4 carbon atoms. $R^4$ and $R^6$ are independently hydrocarbylene or hydrocarbylidene groups, preferably alkylene or alkylidene groups, more preferably alkylene groups of 3 to about 20 carbon atoms, more preferably 3 to about 10 carbon atoms, more preferably 3 to about 6 carbon atoms. In one embodiment either or both $R^4$ and $R^6$ are alkylene groups of about 3 or about 4 carbon atoms, and preferably each is propylene. In one embodiment $R^2$ and $R^8$ are methylene; $R^4$ and $R^6$ are propylene; $R^5$ is methyl; $R^3$, $R^7$, $R^{10}$ and $R^{11}$ are H; and $R^1$ and $R^9$ are independently aliphatic hydrocarbyl groups, preferably alkyl groups, of up to about 30 carbon atoms, preferably about 2 to about 18 carbon atoms, more preferably about 4 to about 12 carbon atoms, more preferably about 6 to about 8 carbon atoms, more preferably about 7 carbon atoms.

In one embodiment component (i) is an aromatic Mannich represented by the formula

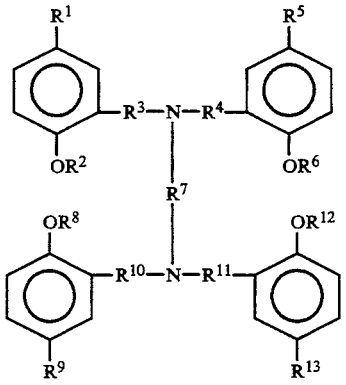

(VI)

In Formula (VI), $R^1$, $R^2$, $R^5$, $R^6$, $R^8$, $R^9$, $R^{12}$ and $R^{13}$ are independently H or aliphatic hydrocarbyl groups of preferably up to about 200 carbon atoms, more preferably up to about 100 carbon atoms, more preferably up to about 50 carbon atoms, more preferably up to about 30 carbon atoms. $R^3$, $R^4$, $R^7$, $R^{10}$ and $R^{11}$ are independently hydrocarbylene or hydrocarbylidene groups, preferably alkylene or alkylidene groups, more preferably alkylene groups of up to about 20 carbon atoms, more preferably up to about 10 carbon atoms, more preferably up to about 6 carbon atoms, more preferably up to about 4 carbon atoms. In one embodiment $R^3$, $R^4$, $R^{10}$ and $R^{11}$ are methylene; $R^7$ is ethylene or propylene, preferably ethylene; $R^2$, $R^6$, $R^8$ and $R^{12}$ are H; and $R^1$, $R^5$, $R^9$ and $R^{13}$ are independently aliphatic hydrocarbyl groups, preferably alkyl groups, of preferably up to about 30 carbon atoms, more preferably about 2 to about 18 carbon atoms, more preferably about 4 to about 12 carbon atoms, more preferably about 6 to about 8 carbon atoms, more preferably about 7 carbon atoms.

In one embodiment component (i) is an aromatic Mannich represented by the formula

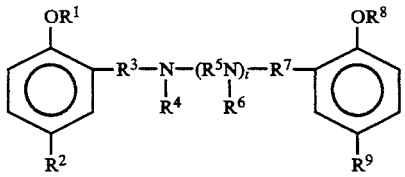

(VII)

In Formula (VII), $R^1$, $R^2$, $R^4$, $R^6$, $R^8$ and $R^9$ are independently H or aliphatic hydrocarbyl groups of preferably up to about 200 carbon atoms, more preferably up to about 100 carbon atoms, more preferably up to about 50 carbon atoms, more preferably up to about 30 carbon atoms. $R^3$, $R^5$ and $R^7$ are independently hydrocarbylene or hydrocarbylidene groups, preferably alkylene or alkylidene groups, more preferably alkylene groups of preferably up to about 20 carbon atoms, more preferably up to about 10 carbon atoms, more preferably up to about 6 carbon atoms, more preferably up to about 4 carbon atoms. i is a number ranging from zero to about 10, more preferably 1 to about 6, more preferably about 2 to about 6, with the proviso that i is 5 or higher, preferably from 5 to about 10, when $R^1$ and $R^8$ are H and $R^5$ is ethylene. In one embodiment $R^3$ and $R^7$ are methylene; $R^5$ is propylene; $R^4$ is H or methyl; $R^1$, $R^6$ and $R^8$ are H; $R^2$ and $R^9$ are aliphatic hydrocarbyl groups, preferably alkyl groups, of about 6 to about 30 carbon atoms, more preferably about 6 to about 12 carbon atoms; and i is 1 to about 6.

In one embodiment component (i) is an aromatic Mannich represented by the formula

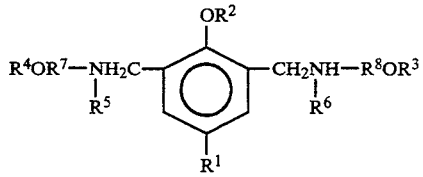

(VIII)

In Formula (VIII), $R^1$, $R^2$, $R^3$, $R^4$, $R^5$ and $R^6$ are independently H or hydrocarbyl groups of preferably up to about 200 carbon atoms, more preferably up to about 100 carbon atoms, more preferably up to about 50 carbon atoms, more preferably up to about 30 carbon atoms. $R^7$ and $R^8$ are independently hydrocarbylene or hydrocarbylidene groups, preferably alkylene or alkylidene groups, more preferably alkylene groups of preferably up to about 20 carbon atoms, more preferably up to about 10 carbon atoms, more preferably up to about 6 carbon atoms, more preferably up to about 3 carbon atoms, more preferably about 2 carbon atoms. In one embodiment. $R^1$ is an alkyl group of preferably about 3 to about 12 carbon atoms, more preferably about 6 to about 8 carbon atoms, more preferably about 7 carbon atoms; $R^2$, $R^3$ and $R^4$ are H; $R^5$ and $R^6$ are methyl; and $R^7$ and $R^8$ are each ethylene.

In one embodiment component (i) is an aromatic Mannich represented by the formula

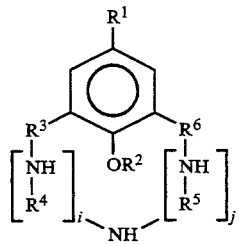

(IX)

In Formula (IX): $R^1$ and $R^2$ are independently H or hydrocarbyl groups of preferably up to about 200 carbon atoms, more preferably up to about 100 carbon atoms, more preferably up to about 50 carbon atoms, more preferably up to about 30 carbon atoms. $R^3$, $R^4$, $R^5$ and $R^6$ are independently alkylene or alkylidene groups of 1 to about 10 carbon atoms, more preferably 1 to about 4 carbon atoms, more preferably 1 or 2 carbon atoms. i and j are independently numbers in the range of 1 to about 6, more preferably 1 to about 4, more preferably about 2. In one embodiment. $R^1$ is an alkyl group of about 4 to about 12 carbon atoms, more preferably about 6 to about 8 carbon atoms, more preferably about 7 carbon atoms; $R^2$ is H; $R^3$ and $R^6$ are methylene; $R^4$ and $R^5$ are ethylene, and i and j are each 2.

In one embodiment component (i) is an aromatic Mannich represented by the formula:

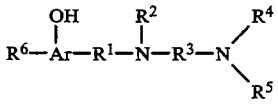

(X)

In Formula (X), Ar is an aromatic group, preferably a benzene nucleus or a naphthalene nucleus, more preferably a benzene nucleus. $R^1$ and $R^3$ are, independently, hydrocarbylene or hydrocarbylidene groups, preferably alkylene or alkylidene groups, more preferably alkylene groups of preferably up to about 20 carbon atoms, more preferably up to about 12 carbon atoms, more preferably up to about 6 carbon atoms. $R^2$ is H or a lower hydrocarbyl (preferably alkyl) group. $R^4$ and $R^5$ are, independently, H, aliphatic hydrocarbyl groups, hydroxy-substituted aliphatic hydrocarbyl groups, amine-substituted aliphatic hydrocarbyl groups or alkoxy-substituted aliphatic hydrocarbyl groups. $R^4$ and $R^5$ independently contain preferably up to about 200 carbon atoms, more preferably up to about 100 carbon atoms, more preferably up to about 50 carbon atoms, more preferably up to about 30 carbon atoms, more preferably up to about 20 carbon atoms, more preferably up to about 6 carbon atoms. $R^6$ is H or an aliphatic hydrocarbyl group of preferably up to about 200 carbon atoms, more preferably up to about 100 carbon atoms, more preferably up to about 50 carbon atoms, more preferably from about 6 to about 30 carbon atoms. In one embodiment the compound represented by Formula (X) has the following structure

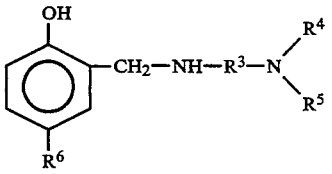

(X-1)

In Formula (X-1), $R^3$, $R^4$, $R^5$ and $R^6$ have the same meaning as in Formula (X). In one embodiment, component (i) has the structure represented by Formula (X-1) wherein $R^3$ is propylene, $R^4$ is H, $R^5$ is an alkyl or an alkenyl group containing about 16 to about 18 carbon atoms, and $R^6$ is heptyl. In one embodiment, component (i) has the structure represented by Formula (XI-1) wherein $R^3$ is propylene, $R^4$ and $R^5$ are methyl, and $R^6$ is heptyl. In one embodiment, component (i) has the structure indicated in Formula (X-1) wherein $R^2$ is methylene, $R^3$ is propylene, $R^4$ and $R^6$ are H, and $R^5$ is an alkyl or an alkenyl group of about 12 to about 24 carbon atoms, more preferably about 16 to about 20 carbon atoms, more preferably about 18 carbon atoms.

In one embodiment component (i) is an aromatic Mannich represented by the formula

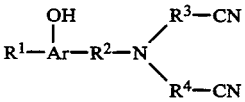

(XI)

In Formula (XI), Ar is an aromatic group, preferably a benzene or a naphthalene nucleus, more preferably a benzene nucleus. $R^1$ is H or aliphatic hydrocarbyl group of preferably up to about 200 carbon atoms, more preferably up to about 100 carbon atoms, more preferably up to about 50 carbon atoms, more preferably up to about 30 carbon atoms. $R^2$, $R^3$ and $R^4$ are independently hydrocarbylene or hydrocarbylidene groups, preferably alkylene or alkylidene groups, more preferably alkylene groups of up to about 20 carbon atoms, more preferably up to about 10 carbon atoms, more preferably up to about 6 carbon atoms, more preferably up to about 4 carbon atoms. In one embodiment, Ar is a benzene nucleus; $R^2$ is methylene; $R^3$ and $R^4$ are independently ethylene or propylene, preferably ethylene; and $R^1$ is an aliphatic hydrocarbyl group, preferably an alkyl group, of preferably up to about 30 carbon atoms, more preferably about 6 to about 18 carbon atoms, more preferably about 10 to about 14 carbon atoms, more preferably about 12 carbon atoms, and advantageously $R^1$ is propylene tetramer.

(2) Hydroxyaromatic Ketoximes

In one embodiment component (i) is a hydroxyaromatic ketoxime. These ketoximes include compounds represented by the formula

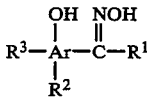

(XII)

In Formula (XII), Ar is an aromatic group which is preferably a benzene nucleus or a naphthalene nucleus, more preferably a benzene nucleus. $R^1$, $R^2$ and $R^3$ are independently hydrocarbyl groups of preferably up to about 200 carbon atoms, more preferably up to about 100 carbon atoms, more preferably up to about 50 carbon atoms, or $R^2$ and $R^3$ call independently be H. $R^1$ must be aliphatic and can contain up to about 20 carbon atoms. $R^2$ and $R^3$ independently can contain from about 6 to about 30 carbon atoms. $R^2$ and $R^3$ also independently can be $CH_2N(R^4)_2$ or $COOR^4$, wherein $R^4$ is H or an aliphatic hydrocarbyl group of preferably up to about 200 carbon atoms, more preferably up to about 100 carbon atoms, more preferably up to about 50 carbon atoms, more preferably from about 6 to about 30 carbon atoms. In one embodiment the compound represented by Formula (XII) is a ketoxime having the following structure

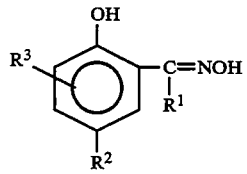

(XII-1)

In Formula (XII-1), $R^1$, $R^2$ and $R^3$ have the same meaning as in Formula (XII). In one embodiment component (i) is a compound represented by Formula (XII-1) wherein $R^1$ is a lower alkyl group, preferably methyl; $R^2$ is an alkyl group of from about 6 to about 18 carbon atoms and is preferably dodecyl or propylene tetramer; and $R^3$ is H or a lower alkyl group and is preferably H.

(3) Schiff Bases

In one embodiment one component (i) is a Schiff base which is a compound containing at least one group represented by the formula >C=NR. As indicated above, these Schiff bases are other than hydroxyaromatic Schiff bases. The Schiff base compounds that are useful as component (i) include compounds represented by the formula $$R^1—Ar—CH=N—R^2—N=CH—Ar^1—R^3 \quad (XIII)$$

In Formula (XIII), Ar and $Ar^x$ are independently aromatic groups preferably benzene or naphthalene nuclei, more preferably benzene nuclei. $R^1$ and $R^3$ are independently H or hydrocarbyl groups preferably containing up to about 200 carbon atoms, more preferably up to about 100 carbon atoms, more preferably up to about 50 carbon atoms, more preferably up to about 30 carbon atoms, more preferably up to about 20 carbon atoms. $R^2$ is a hydrocarbylene or hydrocarbylidene group, preferably an alkylene or alkylidene group, more preferably an alkylene group of preferably up to about 20 carbon atoms, more preferably up to about 10 carbon atoms, more preferably up to about 6 carbon atoms, more preferably up to about 3 carbon atoms. In one embodiment, Ar and $Ar^1$ are benzene nuclei; $R^1$ and $R^3$ are H; and $R^2$ is ethylene or propylene, preferably ethylene.

In one embodiment component (i) is a carbonyl-containing Schiff base represented by the formula $$R^1—N=CH—COOR^2 \quad (XIV)$$

In Formula (XIV), $R^1$ and $R^2$ are independently H or hydrocarbyl groups of preferably up to about 200 carbon atoms, more preferably up to about 100 carbon atoms, more preferably up to about 50 carbon atoms, more preferably up to about 30 carbon atoms. The total number of carbon atoms in $R^1$ and $R^2$ must be sufficient to render the resulting organometallic complex formed with this component soluble or stably dispersible in diesel fuel. Preferably, the total number of carbon atoms in $R^1$ and $R^2$ is at least about 6 carbon atoms, more preferably at least about 10 carbon atoms. $R^1$ can be an alkyl or an alkenyl group of from about 10 to about 20 carbon atoms, preferably about 12 to about 18 carbon atoms. In one embodiment $R^1$ is a mixture of alkyl or alkenyl groups containing about 12 to about 18 carbon atoms, and $R^2$ is H.

In one embodiment component (i) is an oxime-containing Schiff base represented by the formula $$R^1—N=CHCH=N—OH \quad (XV)$$

In Formula (XV), $R^1$ is a hydrocarbyl group of preferably about 6 to about 200 carbon atoms, more preferably about 6 to about 100 carbon atoms, more preferably about 6 to about 50 carbon atoms, more preferably about 6 to about 30 carbon atoms. $R^1$ can be an alkyl or an alkenyl group of from about 10 to about 20 carbon atoms, preferably about 12 to about 18 carbon atoms. In one embodiment $R^1$ is a mixture of alkyl or alkenyl groups containing about 12 to about 18 carbon atoms.

(4) Calixarenes

In one embodiment component (i) is a calixarene. These compounds typically have a basket- or cone-like geometry or partial basket- or cone-like geometry and are described by C. David Gutsche in "Calixarenes", Royal Society of Chemistry, 1989. In one embodiment component (i) is a calix[4]arene which can be represented by the formula

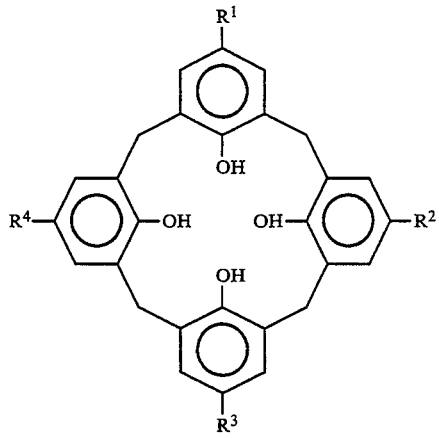

(XVI)

In Formula (XVI), $R^1$, $R^2$, $R^3$ and $R^4$ are independently H or hydrocarbyl groups of preferably up to about 200 carbon atoms, more preferably up to about 100 carbon atoms, more preferably up to about 50 carbon atoms, more preferably from about 6 to about 30 carbon atoms, more preferably about 6 to about 18 carbon atoms. In one embodiment, $R^1$, $R^2$, $R^3$ and $R^4$ are each alkyl groups of about 10 to about 14 carbon atoms, more preferably about 12 carbon atoms, more preferably each is propylene tetramer.

In one embodiment component (i) is a calix[5]arene which can be represented by the formula

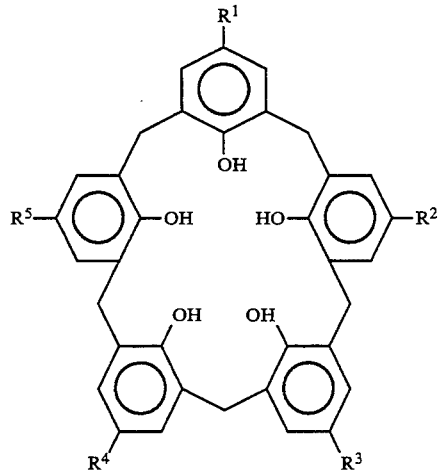

(XVII)

In Formula (XVII), $R^1$, $R^2$, $R^3$, $R^4$ and $R^5$ are independently H or hydrocarbyl groups of preferably up to about 200 carbon atoms, more preferably up to about 100 carbon atoms, more preferably up to about 50 carbon atoms, more preferably from about 6 to about 30 carbon atoms, more preferably about 6 to about 18 carbon atoms. In one embodiment each of $R^1$, $R^2$, $R^3$, $R^4$ and $R^5$ is an alkyl group of about 10 to about 14 carbon atoms, more preferably about 12 carbon atoms, more preferably each is propylene tetramer.

In one embodiment component (i) is a calix[6]arene which can be represented by the formula (XVIII)

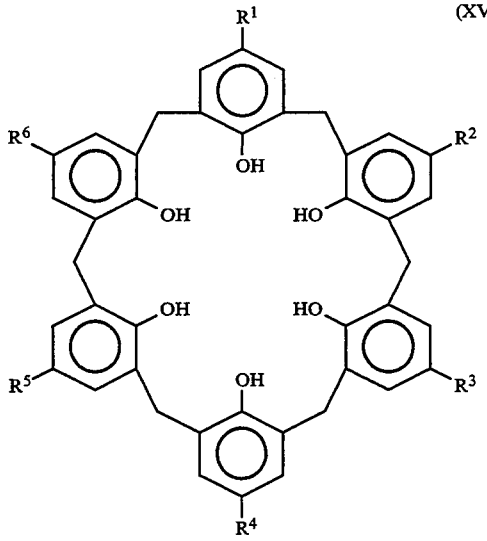

In Formula (XVIII), $R^1$, $R^2$, $R^3$, $R^4$, $R^5$ and $R^6$ are independently H or hydrocarbyl groups of up to about 200 carbon atoms, preferably up to about 100 carbon atoms, more preferably up to about 50 carbon atoms, more preferably from about 6 to about 30 carbon atoms, more preferably about 6 to about 18 carbon atoms. In one embodiment each of $R^1$, $R^2$, $R^3$, $R^4$, $R^5$ and $R^6$ is all alkyl group of about 10 to about 14 carbon atoms, more preferably about 12 carbon atoms, more preferably each is propylene tetramer.

(5) β-Substituted Phenol

In one embodiment component (i) is a β-substituted phenol represented by either of the formulae (XIX-1)

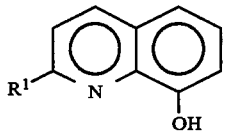

(XIX-2)

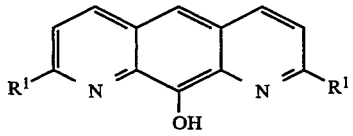

(XIX-3)

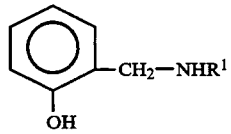

In Formulae (XIX-1), (XIX-2) and (XIX-3), each $R^1$ is independently H or a hydrocarbyl group of preferably up to about 200 carbon atoms, more preferably up to about 100 carbon atoms, more preferably up to about 50 carbon atoms, more preferably up to about 30 carbon atoms, more preferably up to about 20 carbon atoms. Derivatives of the above-indicated compounds wherein one or more of the ring carbon atoms are substituted with hydrocarbyl groups, preferably lower alkyl groups, are useful. In one embodiment, $R^1$ is an alkyl group of about 10 to about 14 carbon atoms, preferably about 12 carbon atoms. $R^1$ can also be a group represented by the formula $$R^2R^3NR^4—$$

wherein $R^2$ and $R^3$ are independently H or hydrocarbyl groups of preferably up to about 200 carbon atoms, more preferably up to about 100 carbon atoms, more preferably up to about 50 carbon atoms, more preferably up to about 30 carbon atoms, more preferably up to about 20 carbon atoms. $R^4$ is a hydrocarbylene or hydrocarbylidene group, preferably an alkylene or an alkylidene group, more preferably an alkylene group of preferably up to about 20 carbon atoms, more preferably up to about 10 carbon atoms, more preferably up to about 6 carbon atoms. In one embodiment, $R^2$ is an alkyl group of about 10 to about 20 carbon atoms, preferably about 12 to about 18 carbon atoms; $R^4$ is methylene; and $R^3$ is H.

(6) α-Substituted Phenol

In one embodiment component (i) is an α-substituted phenol represented by the formula (XX)

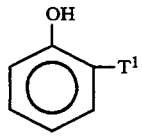

In Formula (XX), $T^1$ is $NR^1_2$, $SR^1$ or $NO_2$ wherein $R^1$ is H or a hydrocarbyl group of preferably up to about 200 carbon atoms, more preferably up to about 100 carbon atoms, more preferably up to about 50 carbon atoms, more preferably up to about 30 carbon atoms, more preferably up to about 20 carbon atoms. Derivatives of the above-indicated compounds wherein one or more of the ring carbon atoms are substituted with hydrocarbyl groups, preferably lower alkyl groups, are useful.

(7) Carboxylic Acid Esters

In one embodiment component (i) is a carboxylic acid ester. These compounds are characterized by the presence of at least one carboxylic acid ester group, —COOR, and at least one additional functional group, each group being on different carbon atoms of a hydrocarbon linkage. The other functional group can be a carboxylic acid ester group.

In one embodiment component (i) is a carboxylic acid ester represented by the formula $$R^1—\underset{\underset{CH_2—COOR^2}{|}}{CH}—CO(OR^3)_tOR^4 \qquad \text{(XXI)}$$

In Formula (XXI), $R^1$, $R^2$ and $R^4$ are independently H or hydrocarbyl groups of preferably up to about 200 carbon atoms, more preferably up to about 100 carbon atoms, more preferably up to about 50 carbon atoms, more preferably from about 6 to about 30 carbon atoms. $R^3$ is a hydrocarbylene or hydrocarbylidene group, preferably an alkylene or alkylidene group, more preferably an alkylene group of preferably up to about 20 carbon atoms, more preferably up to about 10 carbon atoms, more preferably up to about 6 carbon atoms, more preferably from about 2 to about 4 carbon atoms.

i is a number in the range of 1 to about 10, more preferably 1 to about 6, more preferably 1 to about 4, more preferably 1 or 2. In one embodiment $R^1$ is an alkyl group of about 6 to about 20 carbon atoms, more preferably about 10 to about 14 carbon atoms, more preferably about 12 carbon atoms; $R^2$ and $R^4$ are H; $R^3$ is ethylene or propylene, preferably ethylene; and i is 1 to about 4, preferably about 2.

In one embodiment component (i) is a carboxylic acid ester represented by the formula

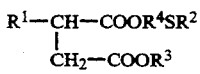

(XXII)

In Formula (XXII), $R^1$ is H or a hydrocarbyl group of preferably up to about 200 carbon atoms, more preferably up to about 100 carbon atoms, more preferably up to about 50 carbon atoms, more preferably from about 6 to about 30 carbon atoms. $R^2$ and $R^3$ are independently H or hydrocarbyl groups of preferably up to about 40 carbon atoms, more preferably up to about 20 carbon atoms. $R^4$ is a hydrocarbylene or hydrocarbylidene group, preferably an alkylene or alkylidene group, more preferably an alkylene group of preferably up to about 20 carbon atoms, more preferably up to about 10 carbon atoms, more preferably up to about 6 carbon atoms, more preferably up to about 4 carbon atoms, more preferably about 2 carbon atoms. In one embodiment, $R^1$ and $R^2$ are alkyl groups of about 6 to about 18 carbon atoms, more preferably about 12 carbon atoms, with $R^1$ preferably being dodecyl and $R^2$ preferably being dodecyl; $R^3$ is H; and $R^4$ methylethylene.

(8) Acylated Amines

In one embodiment component (i) is an acylated amine. These compounds are characterized by the presence of at least one acyl group, RCO—, and at least one amino group, $—NR_2$, on different carbon atoms of a hydrocarbon linkage. These acylated amines can also contain other functional groups of the type discussed above. As indicated above, these acylated amines are other than the product made by the reaction of a hydrocarbon-substituted succinic acid compound having at least 50 aliphatic carbon atoms in the hydrocarbon substituent with an alkylene amine.

In one embodiment component (i) is an acylated amine represented by the formula

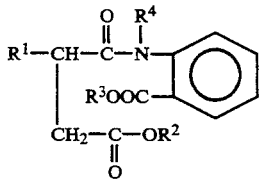

(XXIII)

In Formula (XXIII), $R^1$, $R^2$, $R^3$ and $R^4$ are independently H or hydrocarbyl groups of preferably up to about 40 carbon atoms, more preferably up to about 30 carbon atoms. $R^1$ preferably contains from about 6 to about 30 carbon atoms, more preferably about 6 to about 18 carbon atoms, more preferably about 10 to about 14 carbon atoms. $R^2$ and $R^3$ are preferably H or lower alkyl. In one embodiment, $R^1$ is an alkyl group of about 10 to about 14 carbon atoms, preferably about 12 carbon atoms; and $R^2$, $R^3$ and $R^4$ are H.

In one embodiment component (i) is an acylated amine represented by the formula

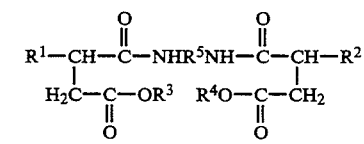

(XXIV)

In Formula (XXIV), $R^1$, $R^3$, $R^4$ and $R^5$ are independently H or hydrocarbyl groups of preferably up to about 40 carbon atoms, more preferably up to about 30 carbon atoms, more preferably up to about 20 carbon atoms. $R^2$ is a hydrocarbylene or hydrocarbylidene, preferably an alkylene or alkylidene, more preferably an alkylene group of preferably up to about 20 carbon atoms, more preferably up to about 10 carbon atoms, more preferably up to about 6 carbon atoms, more preferably from about 2 to about 4 carbon atoms. $R^1$ is preferably a hydrocarbyl group, more preferably an alkyl group, of from about 6 to about 20 carbon atoms, more preferably about 10 to about 14 carbon atoms, more preferably about 12 carbon atoms. In one embodiment, $R^1$ is an alkyl group of about 10 to about 14 carbon atoms, preferably about 12 carbon atoms, $R^2$ is ethylene or propylene, preferably ethylene, and $R^3$, $R^4$ and $R^5$ are H.

In one embodiment component (i) is an acylated amine represented by the formula (XXV)

In Formula (XXV), $R^1$, $R^2$, $R^3$ and $R^4$ are independently H or hydrocarbyl groups of preferably up to about 40 carbon atoms, more preferably up to about 30 carbon atoms, more preferably up to about 20 carbon atoms. $R^5$ is a hydrocarbylene or hydrocarbylidene, preferably an alkylene or alkylidene, more preferably an alkylene group of preferably up to about 20 carbon atoms, more preferably up to about 10 carbon atoms, more preferably up to about 6 carbon atoms, more preferably from about 2 to about 4 carbon atoms. $R^1$ and $R^2$ are preferably hydrocarbyl groups, more preferably alkyl groups, of from about 6 to about 20 carbon atoms, more preferably about 10 to about 14 carbon atoms, more preferably about 12 carbon atoms. In one embodiment, $R^1$ and $R^2$ are alkyl groups of 10 to about 14 carbon atoms, preferably about 12 carbon atoms, $R^5$ is ethylene or propylene, preferably ethylene, and $R^3$ and $R^4$ are H.

In one embodiment component (i) is an acylated amine represented by the formula

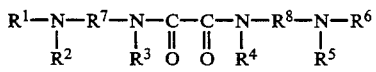

(XXVI)

In Formula (XXVI), $R^1$, $R^2$, $R^3$, $R^4$, $R^5$ and $R^6$ are independently H or hydrocarbyl groups of preferably up to about 200 carbon atoms, more preferably up to about 100 carbon atoms, more preferably up to about 50 carbon atoms, more preferably up to about 30 carbon atoms, more preferably about 6 to about 30 carbon atoms. $R^7$ and $R^8$ are independently hydrocarbylene or hydrocarbylidene groups, preferably alkylene or alkylidene groups, more preferably alkylene groups of preferably up to about 20 carbon atoms, more preferably up to about 10 carbon atoms, more preferably up to about 6 carbon atoms, more preferably from about 2 to about 4 carbon atoms. In one embodiment, $R^1$ and $R^6$ are independently alkyl or alkenyl groups of about 6 to about 30 carbon atoms, more preferably about 12 to about 24 carbon atoms, more preferably about 18 carbon atoms; $R^2$, $R^3$, $R^4$ and $R^5$ are H; and $R^7$ and $R^8$ are independently alkylene groups of 1 to about 4 carbon atoms, preferably ethylene or propylene, more preferably propylene.

(9) Hydroxyazylenes

In one embodiment component (i) is a hydroxyazylene. These compounds are characterized by the presence of at least one hydroxyazylene group, >NOH, and at least one other functional group of the type discussed above. The other functional group can also be a hydroxyazylene group.

In one embodiment component (i) is a hydroxyazylene represented by the formula

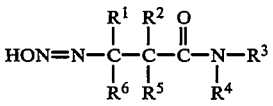

(XXVII)

In Formula (XXVII), $R^1$, $R^2$, $R^3$, $R^4$, $R^5$ and $R^6$ are independently H or hydrocarbyl groups of preferably up to about 200 carbon atoms, more preferably up to about 100 carbon atoms, more preferably up to about 50 carbon atoms, more preferably up to about 30 carbon atoms, more preferably up to about 20 carbon atoms.

In one embodiment component (i) is a hydroxyazylene represented by the formula

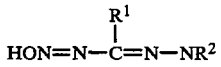

(XXVIII)

In Formula (XXVIII), $R^1$ and $R^2$ are independently H or hydrocarbyl groups of preferably up to about 40 carbon atoms, more preferably about 6 to about 30 carbon atoms, more preferably about 12 to about 20 carbon atoms. The total number of carbon atoms in $R^1$ and $R^2$ must be sufficient to render the resulting organometallic complex formed with this component soluble or stably dispersible in diesel fuel. Preferably, the total number of carbon atoms in $R^1$ and $R^2$ is at least about 6 carbon atoms, more preferably at least about 10 carbon atoms.

(10) Benzotriazoles

In one embodiment component (i) is a benzotriazole which may be substituted or unsubstituted. Examples of suitable compounds are benzotriazole, alkyl-substituted benzotriazole (e.g., tolyltriazole, ethylbenzotriazole, hexylbenzotriazole, octylbenzotriazoles, etc. ) aryl-substituted benzotriazole (e.g., phenylbenzotriazoles, etc.), an alkaryl- or arylalk-substituted benzotriazole, and substituted benzotriazoles wherein the substituents may be, for example, hydroxy, alkoxy, halo (especially chloro), nitro, carboxy or carbalkoxy.

In one embodiment component (i) is a benzotriazole represented by the formula

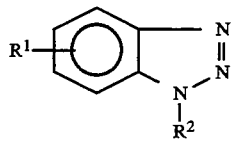

(XXIX)

In Formula (XXIX), $R^1$ and $R^2$ are independently H or hydrocarbyl groups of preferably up to about 200 carbon atoms, more preferably up to about 100 carbon atoms, more preferably up to about 50 carbon atoms, more preferably up to about 30 carbon atoms, more preferably up to about 20 carbon atoms. In one embodiment, $R^1$ is an alkyl group of about 6 to about 18 carbon atoms, more preferably about 10 to about 14 carbon atoms, more preferably about 12 carbon atoms, and $R^2$ is H. An example of a useful compound is dodecyl benzotriazole.

( 11) Amino Acids

In one embodiment component (i) is an amino acid represented by the formula

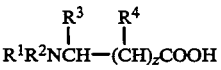

(XXX)

In Formula (XXX), $R^1$ is H or a hydrocarbyl group; $R^2$ is $R^1$ or an acyl group; $R^3$ and $R^4$ are each independently H or lower alkyl groups; and z is 0 or 1. The hydrocarbyl groups $R^1$ and $R^2$ may be any one of the hydrocarbyl groups as broadly defined above. Preferably, $R^1$ and $R^2$ are independently alkyl, cycloalkyl, phenyl, alkyl-substituted phenyl, benzyl or alkyl-substituted benzyl groups. In one embodiment, $R^1$ and $R^2$ are each independently alkyl groups containing from 1 to about 18 carbon atoms; cyclohexyl; phenyl; phenyl groups containing alkyl substituents containing from 1 to about 12 carbon atoms at the 4-position of the phenyl ring; benzyl; or benzyl having an alkyl group of from 1 to about 12 carbon atoms at the 4-position of the phenyl ring. Generally, $R^1$ in Formula (XXX) is a lower alkyl such as a methyl group, and $R^2$ is an alkyl group having from about 4 to about 18 carbon atoms.

In one embodiment, $R^1$ is as defined above and $R^2$ is an acyl group. Although a variety of acyl groups may be utilized as $R^2$, the acyl group generally can be represented by the formula $R^5C(O)$—

$R^5$ is an aliphatic group containing up to about 30 carbon atoms. More generally, $R^5$ contains from about 12 to about 24 carbon atoms. Such acyl-substituted amino carboxylic acids are obtained by reaction of an amino carboxylic acid with a carboxylic acid or carboxylic halide. For example, a fatty acid can be reacted with an amino carboxylic acid to form the desired acyl-substituted amino carboxylic acid. Acids such as dodecanoic acid, oleic acid, stearic acid, linoleic acid, etc., may be reacted with amino carboxylic acids such as represented by Formula (XXX) wherein $R^2$ is H.

The groups $R^3$ and $R^4$ in Formula (XXX) are each independently H or lower alkyl groups. Generally, $R^3$ and $R^4$ will be independently H or methyl groups, and most often, $R^3$ and $R^4$ are H.

In Formula (XXX), z may be 0 or 1. When z is 0, the amino acid compound is glycine, alpha-alanine and derivatives of glycine and alpha-alanine. When z is 1, the amino carboxylic acid represented by Formula (XXX) is beta-alanine or derivatives of beta-alanine.

The amino acid compounds of Formula (XXX) which are useful as component (i) can be prepared by methods described in the prior art, and some of these amino acids are available commercially. For example, glycine, alpha-alanine, beta-alanine, valine, arginine, and 2-methyl-alanine. The preparation of amino acid compounds represented by Formula (XXX) where z is 1 is described in, for example, U.S. Pat. No. 4,077,941. For example, the amino acids can be prepared by reacting an amine of the formula $$R^1R^2NH$$

wherein $R^1$ and $R^2$ are as previously defined relative to Formula (XXX), with a compound of the formula $$R^3CH{=}C(R^4){-}COOR^6$$

wherein $R^3$ and $R^4$ are as defined previously with respect to Formula (XXX), and $R^6$ is a lower alkyl, preferably methyl or ethyl, followed by hydrolysis of the ester with a strong base and acidification. Among the amines which can be reacted with the unsaturated ester are the following: dicyclohexylamine, benzyl- methylamine, aniline, diphenylamine, methylethylamine, cyclohexylamine, n-pentylamine, diisobutylamine, diisopropylamine, dimethylamine, dodecylamine, octadecylamine, N-n-octylamine, aminopentane, sec-butylamine, propylamine, etc.

Amino acid compounds of Formula (XXX) wherein $R^2$ is methyl or an acyl group can be prepared by reacting a primary amine of the formula $$R^1NH_2$$

wherein $R^1$ is as defined previously relative to Formula (XXX) with a compound of the formula $$R^3CH{=}C(R^4){-}COOR^6$$

wherein $R^3$, $R^4$ and $R^6$ are as defined above. Subsequently, this intermediate is converted to the methyl derivative by N-methylation and hydrolysis of the ester followed by acidification. The corresponding acyl derivative is formed by reacting the intermediate with an acid or acid halide such as stearic acid, oleic acid, etc. Specific amino acids of the type represented by Formula (XXX) are illustrated in the following Table I.

TABLE I $$R^1R^2N{-}\overset{R^3}{\overset{|}{C}}H{-}\overset{R^4}{\overset{|}{(C}}H)_zCOOH$$

| $R^1$ | $R^2$ | $R^3$ | z | $R^4$ |
|---|---|---|---|---|
| H | H | H | 0 | — |
| H | H | H | 1 | H |
| H | H | H | 1 | $CH_3$ |
| $CH_3$ | H | H | 1 | H |
| $CH_3$ | $CH_3$ | H | 1 | H |
| H | H | $CH_3$ | 1 | $CH_3$ |
| $CH_3$ | isoamyl | H | 1 | H |
| $CH_3$ | octadecyl | H | 1 | H |
| $CH_3$ | octadecyl | H | 1 | $CH_3$ |
| $CH_3$ | n-butyl | $C_2H_5$ | 1 | H |
| n-octyl | n-octyl | n-propyl | 1 | $CH_3$ |
| cyclohexyl | cyclohexyl | H | 1 | H |

TABLE I-continued $$R^1R^2N{-}\overset{R^3}{\overset{|}{C}}H{-}\overset{R^4}{\overset{|}{(C}}H)_zCOOH$$

| $R^1$ | $R^2$ | $R^3$ | z | $R^4$ |
|---|---|---|---|---|
| $CH_3$ | n-octadecyl | $CH_3$ | 1 | H |
| $CH_3$ | isopropyl | H | 1 | H |
| $CH_3$ | oleyl | H | 1 | H |
| $CH_3$ | $CH_3$ | H | 0 | — |
| H | H | $CH_3$ | 0 | — |
| $CH_3$ | $CH_3$ | $CH_3$ | 0 | — |
| H | oleoyl | H | 0 | — |
| Me | oleoyl | H | 0 | — |
| H | stearoyl | H | 0 | — |
| Me | stearoyl | H | 0 | — |
| H | oleoyl | H | 1 | H |
| Me | stearoyl | H | 1 | H |

(12) Hydroxamic Acids

In one embodiment component (i) is a hydroxamic acid represented by the formula $$R^1{-}C(O){-}NHOH \qquad \text{(XXXI)}$$

In Formula (XXXI), $R^1$ is a hydrocarbyl group of about 6 to about 200 carbon atoms, more preferably about 6 to about 100 carbon atoms, more preferably about 6 to about 50 carbon atoms, more preferably about 6 to about 30 carbon atoms. In one embodiment, $R^1$ is an alkyl or an alkenyl group of about 12 to about 24 carbon atoms, more preferably about 16 to about 20 carbon atoms, more preferably about 18 carbon atoms. Advantageously, $R^1$ is oleyl.

(13) Linked Phenolic Compounds

Component (i) may be a phenolic compound represented by the formula

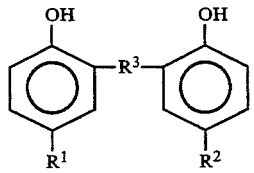

(XXXII)

In Formula (XXXII), $R^1$ and $R^2$ are independently hydrocarbyl groups. $R^3$ is $CH_2$, S, or $CH_2OCH_2$. In one embodiment, $R^1$ and $R^2$ are independently aliphatic groups which generally contain from about 4 to about 20 carbon atoms. Examples of typical $R^1$ and $R^2$ groups include butyl, hexyl, heptyl, 2-ethyl-hexyl, octyl, nonyl, decyl, dodecyl, etc. The phenolic compounds represented by Formula (XXXII) can be prepared by reacting the appropriate substituted phenol with formaldehyde or a sulfur compound such as sulfur dichloride. When one mole of formaldehyde is reacted with two moles of the substituted phenol, the bridging group $R^3$ is $CH_2$. When a molar ratio of formaldehyde to substituted phenol is 1:1, bis-phenolic compounds bridged by the group $CH_2OCH_2$ can be formed. When two moles of a substituted-phenol are reacted with one mole of sulfur dichloride, a bis-phenolic compound is formed which is bridged by a sulfur atom. In one embodiment, $R^1$ and $R^2$ are propylene tetramer and $R^3$ is S.

(14) Aromatic Difunctional Compounds

Component (i) may be an aromatic difunctional compound represented by the formula

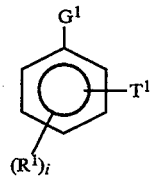

(XXXIII)

In Formula (XXXIII), $R^1$ is a hydrocarbyl group containing 1 to about 100 carbon atoms. i is a number from zero to 4, preferably zero to 2, more preferably zero or 1. $T^1$ is in the ortho or meta position relative to $G^1$. $G^1$ and $T^1$ are independently OH, $NH_2$, $NR_2$, COOR, SH, or C(O)H, wherein R is H or a hydrocarbyl group. In one embodiment, this compound is an amino phenol. Preferably, the amino phenol is an ortho-amino phenol which may contain other substituent groups such as hydrocarbyl groups. In one embodiment, this compound is a nitro phenol. Preferably, the nitro phenol is an ortho-nitro phenol which may contain other substituent groups such as hydrocarbyl groups. In one embodiment the compound represented by Formula (XXXIII) is a nitro phenol wherein $R^1$ is dodecyl, i is 1, $G^1$ is OH, $T^1$ is $NO_2$, and the $NO_2$ is in the ortho position relative to the OH, the compound being dodecyl nitro phenol.

In one embodiment $G^1$ in Formula (XXXIII) is OH, $T^1$ is $NO_2$ and is ortho to the OH, i is 1, and $R^1$ is represented by the formula $$R^2R^3N—R^4—NR^5—R^6—$$

wherein $R^2$, $R^3$ and $R^5$ are independently H or hydrocarbyl groups of up to about 40 carbon atoms, and $R^4$ and $R^6$ are independently alkylene or alkylidene groups of 1 to about 6 carbon atoms. In one embodiment $R^2$ is an alkyl or an alkenyl group of about 16 to about 20 carbon atoms, more preferably about 18 carbon atoms, $R^3$ and $R^5$ are H, $R^4$ is ethylene or propylene, preferably propylene, and $R^6$ is methylene or ethylene, preferably methylene.

(15) Xanthates

Component (i) can be a xanthate which is a compound containing the group $R^1OC(=S)S—$ wherein R is a hydrocarbyl group. These xanthates must contain at least one other functional group of the type discussed above. The other functional group can be a xanthate group. In one embodiment component (i) is a xanthate represented by the formula

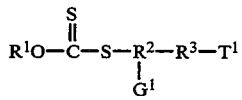

(XXXIV)

In Formula (XXXIV), $R^1$ is a hydrocarbyl group of up to about 40 carbon atoms, more preferably from about 6 to about 30 carbon atoms, more preferably from about 10 to about 20 carbon atoms. $R^1$ is preferably aliphatic, more preferably alkyl. $R^2$ and $R^3$ are alkylene groups of up to about 10 carbon atoms, more preferably up to about 6 carbon atoms, more preferably about 2 or about 3 carbon atoms. $G^1$ and $T^1$ are independently OH or CN. In one embodiment, $R^1$ is an alkyl group of 1 to about 10 carbon atoms; $R^2$ and $R^3$ are ethylene or propylene, preferably each is ethylene; and $G^1$ and $T^1$ are CN. In one embodiment, $R^1$ is $R^5R^6NR^7$— wherein $R^5$ and $R^6$ are independently H or lower alkyl, preferably H, $R^7$ is ethylene or propylene, preferably propylene, $R^2$ and $R^3$ are each ethylene or propylene and $G^1$ and $T^1$ are CN or OH. In one embodiment $R^1$ is $R^5R^6NR^7$— wherein $R^5$ is an alkyl or an alkenyl group of about 16 to about 20 carbon atoms, $R^6$ is H, $R^7$ is ethylene or propylene, $R^2$ and $R^3$ are each ethylene or propylene, and $G^1$ and $T^1$ are CN or OH.

(16) Formazyls

In one embodiment component (i) is a formazyl represented by the formula

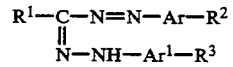

(XXXV)

In Formula (XXXV), Ar and $Ar^1$ are independently aromatic groups which are preferably benzene nuclei or naphthalene nuclei, more preferably benzene nuclei. $R^1$, $R^2$ and $R^3$ are independently H or hydrocarbyl groups containing preferably up to about 200 carbon atoms, more preferably up to about 100 carbon atoms, more preferably up to about 50 carbon atoms, more preferably up to about 30 carbon atoms, more preferably up to about 20 carbon atoms. In one embodiment Ar and $Ar^1$ are each benzene nuclei; $R^1$ is an alkyl group or a branched alkyl group of about 4 to about 12 carbon atoms, more preferably about 6 to about 10 carbon atoms, more preferably about 8 carbon atoms; $R^2$ is H or lower alkyl; and $R^3$ is an alkyl group of about 6 to about 18 carbon atoms, more preferably about 10 to about 14 carbon atoms, more preferably about 12 carbon atoms. In one embodiment, both Ar and $Ar^1$ are benzene nuclei, $R^1$ is 1-ethyl pentyl, $R^2$ is dodecyl and $R^3$ is H.

(17) Pyridines

Component (i) can be pyridine derivative. In one embodiment component (i) is a 2,2'-bypyridine represented by the formula

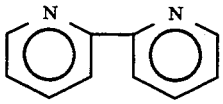

(XXXVI)

In Formula (XXXVI) one or more of the ring carbon atoms can be substituted by a hydrocarbyl group, preferably a lower alkyl group. In one embodiment, component (i) is a substituted pyridine represented by the formula

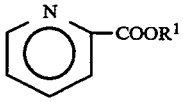

(XXXVII)

In Formula (XXXVII), $R^1$ is H or hydrocarbyl groups preferably containing up to about 200 carbon atoms, more preferably up to about 100 carbon atoms, more preferably up to about 50 carbon atoms, more preferably up to about 30 carbon atoms, more preferably up to about 20 carbon atoms. $R^1$ is preferably H or lower alkyl. In Formula (XXXVII) one or more of the ring carbon atoms can be substituted by a hydrocarbyl group, preferably a lower alkyl group.

(18) Borated Acylated Amines

Component (i) can be a borated acylated amine. These compounds can be prepared by first reacting a hydrocarbyl-substituted succinic acid-producing compound (herein sometimes referred to as the "succinic acylating agent") with at least about one-half equivalent, per equivalent of acid-producing compound, of an amine containing at least one hydrogen attached to a nitrogen group. The nitrogen-containing compositions obtained in this manner are usually complex mixtures. These nitrogen-containing compositions are sometimes referred to herein as "acylated amines". The nitrogen-containing composition is then borated by reacting it with a boron compound selected from the group consisting of boron trioxides, boron halides, boron acids, boron amides, and esters of boron acids.

The acylated amines have been described in many U.S. patents including

| | | |
|---|---|---|
| 3,172,892 | 3,341,542 | 3,630,904 |
| 3,215,707 | 3,346,493 | 3,632,511 |
| 3,272,746 | 3,444,170 | 3,787,374 |
| 3,316,177 | 3,454,607 | 4,234,435 |
| | 3,541,012 | |

The above U.S. patents are expressly incorporated herein by reference for their teaching of the preparation of acylated amines that are useful herein.

In general, a convenient route for the preparation of the acylated amines comprises the reaction of a hydrocarbyl-substituted succinic acid-producing compound ("carboxylic acid acylating agent") with an amine containing at least one hydrogen attached to a nitrogen atom (i.e., H—N=). The hydrocarbonsubstituted succinic acid-producing compounds include the succinic acids, anhydrides, halides and esters. The number of carbon atoms in the hydrocarbon substituent on the succinic acid-producing compound may vary over a wide range provided that the organometallic complex produced therefrom is soluble or stably dispersible in diesel fuel. The hydrocarbon substituent generally will contain an average of at least about 10 aliphatic carbon atoms, preferably at least about 30 aliphatic carbon atoms, more preferably at least about 50 aliphatic carbon atoms.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5propyl-1-hexene. Polymers of media olefins, i.e., olefins in which the olefinic linkage is not at the terminal position, likewise are useful. They are illustrated by 2-butene, 3-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrene; isobutene with butadiene; propene with isoprene; ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene, terpolymer of 80% of isobutene with 1% of 1-pentene and 10% of 1-octene; copolymer of 80% of 1-hexene and 20% of 1-heptene; terpolymer of 90% of isobutene with 2% of cyclohexene and 8% of propene; and copolymer of 80% of ethylene and 20% of propene.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefinic substances.

The use of olefin polymers having number average molecular weights (Mn) of about 700–10,000 is preferred. In one embodiment the substituent is derived from a polyolefin characterized by an Mn value of about 700 to about 10,000, and an Mw/Mn value of 1.0 to about 4.0.

In preparing the substituted succinic acylating agents, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds.

One procedure for preparing the substituted succinic acylating agents of this invention is illustrated, in part, in U.S. Pat. No. 3,219,666 which is expressly incorporated herein by reference for its teachings in regard to preparing succinic acylating agents. This procedure is conveniently designated as the "two-step procedure". This procedure involves first chlorinating the polyalkene, then reacting the chlorinated polyalkene with the maleic reactant.

Another procedure for preparing these substituted succinic acid acylating agents utilizes a process described in U.S. Pat. No. 3,912,764 and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants.

Another process for preparing the substituted succinic acylating agents of this invention is the so-called "one-step" process. This process is described in U.S. Pat. Nos. 3,215,707 and 3,231,587. Both are expressly incorporated herein by reference for their teachings in regard to that process. The one-step process involves preparing a mixture of the polyalkene and the maleic reactant containing the necessary amounts of both to provide the desired substituted succinic acylating agents of this invention. This means that there must be at least one mole of maleic reactant for each mole of polyalkene in order that there can be at least one succinic group for each equivalent weight of substituent groups. Chlorine is then introduced into the mixture, usually by passing chlorine gas through the mixture with agitation.

The amines which are reacted with the succinic acid-producing compounds to form the acylated amines may be any of the amines (A-3) described above for us in preparing the aromatic Mannichs of this invention. A preferred class of such amines are the alkylene polyamines represented by Formula (A-3-3) above.

In addition to the amines (A-3) discussed above, the amines useful herein also include hydroxyl-containing amines represented by the formula $$R^{11}NH-(R^{12}\overset{\overset{R^9}{|}}{N})_nR^{10}$$

wherein each of $R^9$, $R^{10}$ and $R^{11}$ is independently H or a hydrocarbyl, hydroxyhydrocarbyl, aminohydrocarbyl, or hydroxyaminohydrocarbyl group provided that at least one of $R^9$ is a hydroxyhydrocarbyl or a hydroxyaminohydrocarbyl group. $R^{12}$ is preferably an alkylene group, more preferably ethylene or propylene, more preferably ethylene. n is a number from 0 to about 5. Examples include ethanolamine, 2-amino-1-butanol, 2-amino-2-methyl-1-propanol, di-(3-hydroxypropyl)amine, 3-hydroxybutyl-amine, 4-hydroxybutylamine, 2-amino-1-butanol, 2-amino-2-methyl-1-propanol, 2-amino-1-propanol, 3-amino-2-methyl-1-propanol, 3-amino-1-propanol, 2-amino-2-methyl-1,3-propanediol, 2-amino-2-ethyl-1,3-propanediol,diethanolamine, di-(2-hydroxypropyl)-amine, N-(hydroxypropyl)-propylamine, N-(2-hydroxyethyl)-cyclohexylamine, 3-hydroxycyclopentylamine, N-hydroxyethyl piperazine, and the like.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N,N'-bis(2-hydroxyethyl) ethylene diamine, 1-(2-hydroxyethyl)piperazine, monohydroxypropyl-substituted diethylene triamine, 1,4-bis-(2-hydroxypropyl)piperazine, di-hydroxypropyl-substituted tetraethylene pentamine, N-(3-hydroxypropyl)-tetramethylene diamine, and 2-heptadecyl-1(2-hydroxyethyl)imidazoline.

The acylated amines obtained by reaction of the succinic acid-producing compounds and the amines described above may be amine salts, amides, imides, imidazolines as well as mixtures thereof. To prepare the acylated amines, one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present. Thus, octyl amine has an equivalent weight equal to its molecular weight; ethylene diamine has an equivalent weight equal to one-half its molecular weight; and aminoethyl piperazine has an equivalent weight equal to one-third its molecular weight. The number of equivalents of succinic acid-producing compound depends on the number of carboxylic functions present in the hydrocarbon-substituted succinic acid-producing compound. Thus, the number of equivalents of hydrocarbon-substituted succinic acid-producing compound will vary with the number of succinic groups present therein, and generally, there are two equivalents of acylating reagent for each succinic group in the acylating reagents. Conventional techniques may be used to determine the number of carboxyl functions (e.g., acid number, saponification number) and, thus, the number of equivalents of acylating reagent available to react with amine. Additional details and examples of the procedures for preparing these acylated amines are included in, for example, U.S. Pat. Nos. 3,172,892; 3,219,666; 3,272,746; and 4,234,435, the disclosures of which are hereby incorporated by reference.

The acylated amine is then reacted with at least one boron compound selected from the class consisting of boron trioxides, boron halides, boron acids, boron amides and esters of boron acids. The amount of boron compound reacted with the acylated amine intermediate generally is sufficient to provide from about 0.1 atomic proportion of boron for each mole of the acylated amine up to about 10 atomic proportions of boron for each atomic proportion of nitrogen of said acylated amine. More generally the amount of boron compound present is sufficient to provide from about 0.5 atomic proportion of boron for each mole of the acylated amine to about 2 atomic proportions of boron for each atomic proportion of nitrogen used.

The boron compounds that are useful include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl ester, boron trifluoride-phosphoric acid, boron trichloride-chloroacetic acid, boron tribromide-dioxane, and boron trifluoridemethyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include especially mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptylphenol, n-cyclohexylphenol, 2,2-bis-(p-hydroxyphenyl)-propane polyisobutene (molecular weight of 1500)-substituted phenol, ethylene chlorohydrin, o-chlorophenol, m-nitrophenol, 6-bromooctanol, and 7-keto-decanol. Lower alcohols, 1,2-glycols, and 1-3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

The reaction of the acylated amine with the boron compounds can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

The reaction of the acylated amine with the boron compounds results in a product containing boron and substantially all of the nitrogen originally present in the acylated amine reactant. It is believed that the reaction results in the formation of a complex between boron and nitrogen. Such complex may involve in some instances more than one atomic proportion of boron with one atomic proportion of nitrogen and in other instances more than one atomic proportion of nitrogen with one atomic proportion of boron. The nature of the complex is not clearly understood.

Inasmuch as the precise stoichiometry of the complex formation is not known, the relative proportions of the reactants to be used in the process are based primarily upon the consideration of utility of the products for the purposes of this invention. In this regard, useful products are obtained from reaction mixtures in which the reactants are present in relative proportions as to provide from about 0.1 atomic proportions of boron for each mole of the acylated amine to about 10 atomic proportions of boron for each atomic proportion of nitrogen of said acylated amine that is used. Useful amounts of reactants are such as to provide from about 0.5 atomic proportion of boron for each mole of the acylated amine to about 2 atomic proportions of boron for each atomic proportion of nitrogen of said acylated amine. To illustrate, the amount of a boron compound having one boron atom per molecule to be used with one mole of an acylated amine having five nitrogen atoms per molecule is within the range from about 0.1 mole to about 50 moles, preferably from about 0.5 mole to about 10 moles.

In one embodiment, these borated acylated amines are useful as component (i) in the formation of the organometallic complexes of the invention. In another embodiment, these borated acylated amines are useful as the organometallic complexes of the invention.

(19) Phosphorus-Containing Acylated Amines

Component (i) can be a phosphorus-containing acylated amine. These compounds are prepared by the reaction of (P-1) at least one carboxylic acid acylating agent, (P-2) at least one amine characterized by the presence within its structure of at least one H—N= group, and (P-3) at least one phosphorus-containing acid of the formula

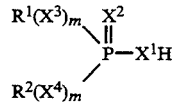

(P-3-1)

In Formula (P-3-1) each $X^1$, $X^2$, $X^3$ and $X^4$ is independently oxygen or sulfur, each m is zero or one, and each $R^1$ and $R^2$ is independently a hydrocarbyl group. The carboxylic acylating agent (P-1) and amine (P-2) are described above with respect to the preparation of borated acylated amines. The phosphorus-containing acids (P-3) include the following:

1. Dihydrocarbyl phosphinodithioic acids corresponding to the formula

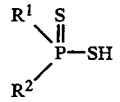

2. S-hydrocarbyl hydrocarbyl phosphonotrithioic acids corresponding to the formula

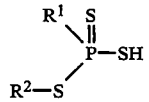

3. O-hydrocarbyl hydrocarbyl phosphonodithioic acids corresponding to the formula

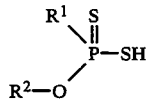

4. S,S-dihydrocarbyl phosphorotetrathioic acids corresponding to the formula

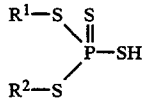

5. O,S -dihydrocarbyl phosphorotrithioic acids corresponding to the formula

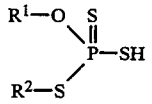

6. O,O-dihydrocarbyl phosphorodithioic acids corresponding to the formula

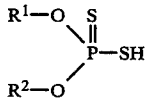

Useful acids of the formula

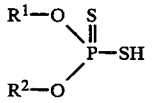

are readily obtainable by the reaction of phosphorus pentasulfide ($P_2S_5$) and an alcohol or a phenol. The reaction involves mixing at a temperature of about 20° to about 200° C., four moles of alcohol or a phenol with one mole of phosphorus pentasulfide. Hydrogen sulfide is liberated in this reaction. The oxygen-containing analogs of these acids are conveniently prepared by treating the dithioic acid with water or stream which, in effect, replaces one or both of the sulfur atoms.

Useful phosphorus-containing acids are phosphorus- and sulfur-containing acids. These acids include those acids wherein at least one $X^1$ or $X^2$ is sulfur, and more preferably both $X^1$ and $X^2$ are sulfur, at least one $X^3$ and $X^4$ is oxygen or sulfur, more preferably both $X^3$ and $X^4$ are oxygen and m is 1. Mixtures of these acids may be employed.

Each $R^1$ and $R^2$ is independently a hydrocarbyl-based group that is preferably free from acetylenic and usually also from ethylenic unsaturation and have from about 1 to about 50 carbon atoms, preferably from about 1 to about 30 carbon atoms, and more preferably from about 3 to about 18 carbon atoms. In one embodiment each $R^1$ and $R^2$ is the same or different and has from about 4 to about 8 carbon atoms. Each $R^1$ and $R^2$ can be, for example, isopropyl, isobutyl, 4-methyl-2-pentyl, 2-ethylhexyl, iso-octyl, etc. Each $R^1$ and $R^2$ can be identical to each other, although they may be different and either or both may be mixtures. Each $R^1$ and $R^2$ is preferably alkyl, and most desirably branched alkyl.

The reaction to form the phosphorus-containing acylated amines may be carried out by mixing the components (P-1), (P-2) and (P-3) in any order. All three reactants may be mixed at room temperature and heated to a temperature above about 80° C. to effect acylation. The reaction may likewise be carried out by first reacting components (P-2) and (P-3) and then acylating the intermediate product with component (P-1), or by acylating the component (P-2) with component (P-1) and then reacting the acylated amine with component (P-3). The preferred temperature for carrying out the acylating is between about 100° C. to about 300° C., preferably about 150° C. and 250° C.

The acylating is accompanied by the formation of water. The removal of the water formed can be effected by heating the reaction mixture to 100° C. or higher. It may be facilitated by blowing the reaction mixture with an inert gas such as nitrogen during such heating. It may be facilitated also by the use in the reaction mixture of an inert solvent which forms a co-distillable azeotropic mixture with water. Examples of such solvents are benzene, n-hexane, toluene, xylene, etc. The use of such solvents permits the removal of water at a substantially lower temperature, e.g., 80° C.

The relative proportions of reactants to be used in the process are based upon the stoichiometry of the reaction involved in the process and the utility of the products obtained therefrom for the purpose of this invention. The minimum amounts of components (P-1) and (P-3) to be used are about 0.5 equivalent of each of said components (P-1) and (P-3) for each mole of component (P-2). The maximum amounts of components (P-1) and (P-3) to be used are based on the total number of equivalents of component (P-2) used.

For purposes of making these phosphorous-containing acylated amines the number of equivalents of an amine (P-2) is based on the number of HN< groups in such amine. An equivalent weight of an amine is the total weight of amine divided by the total number of HN< groups present. Thus, ethylene diamine has an equivalent weight equal to one-half its molecular weight; and tetraethylene pentamine has an equivalent weight equal to one-fifth its molecular weight. Also, for example, the equivalent weight of a commercially available mixture of amines can be determined by dividing the atomic weight of nitrogen (14) by the weight percent of nitrogen contained in the amine. Therefore, an amine mixture having a % N of 34 would have an equivalent weight of 41.2. The number of equivalents of an amine can be determined by dividing its total weight by its equivalent weight.

The number of equivalents of acylating agent (P-1) depends on the number of carboxylic functions (e.g., carboxylic acid groups or functional derivatives thereof) present in the acylating agent. Thus, the number of equivalents of acylating agents will vary with the number of carboxy groups present therein. In determining the number of equivalents of acylating agents, those carboxyl functions which are not capable of reacting as a carboxylic acid acylating agent are excluded. In general, however, there is one equivalent of acylating agent for each carboxy group in the acylating agents. For example, there would be two carboxy groups in the acylating agents derived from the reaction of one mole of olefin polymer and one mole of maleic anhydride. Conventional techniques are readily available for determining the number of carboxyl functions (e.g., acid number, saponification number) and, thus, the number of equivalents of acylating agent available to react with amine.

The equivalent weight of component (P-3) can be determined by dividing the molecular weight of component (P-3) by the number of —PXXH groups. These can usually be determined from the structural formula of component (P-3) or empirically through well known titration procedures. The number of equivalents of component (P-3) can be determined by dividing the weight of component (P-3) by its equivalent weight.

The maximum combined equivalents of components (P-1) and (P-3) which can react with one mole of component (P-2) is equal to the number of HN< groups. If an excess of components (P-1) and (P-3) is used, this excess will not take part in the reaction. On the other hand, if the total amount of components (P-1) and (P-3) used is less than the maximum amount, the products will contain unreacted free amino nitrogen atoms. Useful products are those obtained by the use of components (P-1) and (P-3) in relative amounts within the limits of ratio of equivalents from about 0.5:4.5 to about 4.5:0.5. A specific example illustrating the limits of the relative proportions of the reactants is as follows: one mole of a tetraalkylene pentamine is reacted with from about 0.5 to about 4.5 equivalents of a polyisobutene-substituted succinic anhydride and from about 0.5 to about 4.5 equivalents of a phosphorodithioic acid.

(20) Pyrrole Derivatives

Component (i) can be a pyrrole derivative represented by the formula

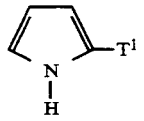

(XXXVIII)

In Formula (XXXVIII), $T^1$ is OH, $NH_2$, $NR_2$, COOR, SH, or C(O)H, wherein R is H or a hydrocarbyl group, preferably a lower alkyl group. Each of the ring carbon atoms can be substituted with hydrocarbyl groups, preferably lower alkyl groups.

(21) Porphyrin

Component (i) can be one or more porphyrins. The porphyrins are a class of heterocyclic compounds containing 4 pyrrole rings united by methylene groups. These compounds may be represented by the formula

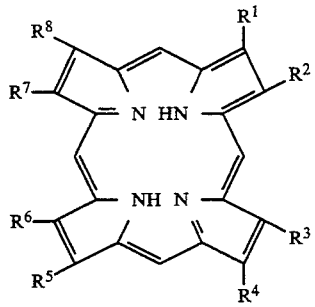

(XXXIX)

In Formula (XXXIX), $R^1$, $R^2$, $R^3$, $R^4$, $R^5$, $R^6$, $R^7$ and $R^8$ are independently H or hydrocarbyl groups of preferably up to about 200 carbon atoms, more preferably up to about 100 carbon atoms, more preferably up to about 50 carbon atoms, more preferably up to about 30 carbon atoms, more preferably up to about 10 carbon atoms. In one embodiment each of $R^1$, $R^2$, $R^3$, $R^4$, $R^5$, $R^6$, $R^7$ and $R^8$ are independent H, lower alkyl, lower alkenyl, lower hydroxy-substituted alkyl, or —COOH-substituted lower alkyl. Examples include: pyrroporphyrin, rhodoporphyrin, phylloporphyrin, phylloerythrin, dueteroporphyrin, etioporphyrin III, protoporphyrin, hematoporphyrin, mesoporphyrin IX, coproporphyrin, uroporphyrin and bilirubin.

(22) EDTA Derivatives

Component (i) can be an ethylene diamine tetraacetic acid (EDTA) derivative represented by the formula

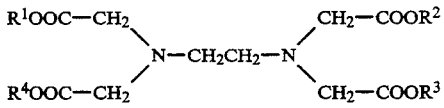

(XL)

In Formula (XL), $R^1$, $R^2$, $R^3$ and $R^4$ are independently H or hydrocarbyl groups of preferably up to about 200 carbon atoms, more preferably up to about 100 carbon atoms, more preferably up to about 50 carbon atoms, more preferably up to about 30 carbon atoms, more preferably up to about 20 carbon atoms. In one embodiment, $R^1$, $R^2$, $R^3$ and $R^4$ are independently H or lower aliphatic hydrocarbyl groups, preferably H or lower alkyl groups.

Component (ii)

The metal employed in the copper-containing organometallic complex is Cu or Cu in combination with one or more of Na, K, Mg, Ca, Sr, Ba, V, Cr, Mo, Fe, Co, Zn, B, Pb, Sb, Ti, Mn, Zr or a mixture of two or more thereof. The metal can comprise Cu in combination with one or more of Fe, V, or Mn. The metal can be Cu in combination with one or more of Fe, B, Zn, Mg, Ca, Na, K, Sr, Ti, Mn or Zr.

The metal reactant (ii) can be a nitrate, nitrite, halide, carboxylate, phosphate, phosphite, sulfate, sulfite, carbonate, borate, hydroxide or oxide. The copper compounds that are useful as the metal reactant (ii) include cupric propionate, cupric acetate, cupric metaborate, cupric benzoate, cupric formate, cupric laurate, cupric nitrite, cupric oxychloride, cupric palmitate, cupric salicylate, copper carbonate, copper naphthenate.

The metal reactants (ii) that are useful when other metals are used in combination with copper include cobaltous nitrate, cobaltous oxide, cobaltic oxide, cobalt nitrite, cobaltic phosphate, cobaltous chloride, cobaltous carbonate, chromous acetate, chromic acetate, chromic bromide, chromous chloride, chromic fluoride, chromous oxide, chromic sulfite, chromous sulfate heptahydrate, chromic sulfate, chromic formate, chromic hexanoate, chromium oxychloride, chromic phosphate, ferrous acetate, ferric benzoate, ferrous bromide, ferrous carbonate, ferric formate, ferrous lactate, ferrous oxide, ferric oxide, ferric hypophosphite, ferric sulfate. ferrous sulfite, ferric hydrosulfite, zinc benzoate, zinc borate, zinc bromide, zinc iodide, zinc lactate, zinc oxide, zinc stearate, zinc sulfite, sodium acetate, sodium benzoate, sodium bicarbonate, sodium bisulfate, sodium bisulfite, sodium bromide, sodium carbonate, sodium chloride, sodium citrate, sodium hydroxide, sodium hypophosphite, sodium iodide, sodium metabisulfite, sodium naphthenate, sodium nitrite, sodium phosphate, sodium sulfite, potassium acetate, potassium benzoate, potassium bicarbonate, potassium bisulfate, potassium bisulfite, potassium bromide, potassium carbonate, potassium chloride, potassium citrate, potassium hydroxide, potassium hypophosphite, potassium iodide, potassium metabisulfite, potassium naphthenate, potassium nitrite, potassium pentaborate, potassium phosphate, potassium sulfite, boron oxide, boron tribromide, boron trichloride, boron trifluoride, calcium acetate, calcium bisulfite, calcium bromide, calcium carbonate, calcium chloride, calcium dioxide, calcium fluoride, calcium hydroxide, calcium iodide, calcium laurate, calcium naphthenate, calcium nitrate, calcium nitrite, calcium oxalate, calcium peroxide, calcium phosphate, calcium phosphite, calcium stearate, calcium sulfate, calcium sulfite, magnesium acetate, magnesium bisulfite, magnesium bromide, magnesium carbonate, magnesium chloride, magnesium fluoride, magnesium hydroxide, magnesium iodide, magnesium laurate, magnesium naphthenate, magnesium nitrite, magnesium oxalate, magnesium phosphate, magnesium phosphite, magnesium stearate, magnesium sulfate, magnesium sulfite, strontium acetate, strontium bisulfite, strontium bromide, strontium carbonate, strontium chloride, strontium fluoride, strontium hydroxide, strontium iodide, strontium laurate, strontium naphthenate, strontium nitrite, strontium oxalate, strontium phosphate, strontium phosphite, strontium stearate, strontium sulfate, strontium sulfite, barium acetate, barium bisulfite, barium bromide, barium carbonate, barium chloride, barium fluoride, barium hydroxide, barium iodide, barium laurate, barium naphthenate, barium nitrite, barium oxalate, barium phosphate, barium phosphite, barium stearate, barium sulfate, barium sulfite, manganous acetate, manganous benzoate, manganous carbonate, manganese dichloride, manganese trichloride, manganous citrate, manganous formate, manganous nitrate, manganous oxalate, manganic phosphate, manganous pyrophosphate, manganic metaphosphate, manganous valerate, titanium dioxide, titanium monoxide, titanium oxalate, titanium sulfate, titanium tetrachloride, zirconium acetate, zirconium oxide, zirconium carbonate, zirconium chloride, zirconium fluoride, zirconium hydroxide, zirconium lactate, zirconium naphthenate, zirconium nitrate, zirconium orthophosphate, zirconium phosphate, zirconium pyrophosphate, zirconium sulfate, zirconium tetrachloride and zirconium tetrafluoride. Hydrates of the above compounds are useful.

Reaction Forming the Organometallic Complex

The reaction by which the organometallic complexes of this invention are formed from components (i) and (ii) may be effected simply by mixing the reactants at the desired temperature. The reaction can be carried out at a temperature of at least about 80° C. In some instances the reaction temperature may be as low as room temperature such as about 20° C. The upper limit for the reaction temperature is the decomposition point of the reaction mixture although a temperature higher than 250° C. is rarely necessary.

The reaction is preferably carried out in the presence of a diluent or solvent in which the reactants are soluble or the product is soluble. The solvent may be any fluid, inert solvent such as benzene, xylene, toluene, kerosene, mineral oil, chlorobenzene, dioxane or the like.

The relative amounts of the components (i) and (ii) vary within wide ranges. Usually at least about 0.1 equivalent of component (ii) is used per equivalent of component (i). The amount of component (ii) preferably can be from about 0.05 to about 1, more preferably from about 0.1 to about 0.4 equivalents of component (ii) per equivalent of component (i). The equivalent weight of component (i) is based on the number of functional groups in component (i) that are capable of forming a complex with the metal in component (ii). Thus, the weight of an equivalent of propylene tetramer nitrophenol is equal to one-half its molecular weight. The equivalent weight of component (ii) is based on the number of metal atoms in its molecule. Thus, the weight of an equivalent of cuprous oxide is one-half its molecular weight and the weight of an equivalent of cupric hydroxide is its molecular weight. Also, the relative amount of component (ii) is based to some extent upon the coordination number of the metal of in component (ii) reactant. For instance, as many as six equivalents of component (i) may combine with one equivalent of a metal reactant in which the metal has a coordination number of six.

The product obtained by the reaction of component (i) with component (ii) is an "organometallic complex". That is, it results from the combination of the functional groups in component (i) with the metal of component (ii) by means of the secondary valence of the metal. The precise nature of the organometallic complex is not known. For purposes of this invention it is only necessary that such complexes be sufficiently stable in diesel fuel to permit use in a diesel engine equipped with an exhaust system particulate trap to lower the ignition temperature of exhaust particles collected in said trap.

In one embodiment the organometallic complex is other than a transition metal complex of an aromatic Mannich in combination with a Schiff base, the Mannich being derived from an aromatic phenol, an aldehyde or ketone, and a hydroxyl- and/or thiol-containing amine.

In one embodiment the organometallic complex is other than a transition metal complex of an aromatic Mannich in combination with an oxime, the Mannich being derived from an aromatic phenol, an aldehyde or ketone, and a hydroxyl- and/or thiol-containing amine.

In one embodiment the organometallic complex is other than a copper complex of an aromatic Mannich in combination with dodecyl salicylaldoxime, the Mannich being derived from dodecylphenol, ethanolamine and paraformaldehyde.

The following examples illustrate the preparation of organometallic complexes that are used in accordance with the invention. Unless otherwise indicated, in the following examples as well as throughout the entire specification and in the appended claims, all parts and percentages are by weight, all pressures are atmospheric, and all temperatures are in degrees Centigrade.

EXAMPLE 1

Part A: 290 grams of 8-hydroxyquinoline, 66 grams of paraformaldehyde, 556 grams of Armeen OL (a product of Armak identified as a mixture of fatty amines having a primary amine content of about 95% by weight, the remainder being secondary and tertiary amines, and a chain length ranging from $C_{12}$ to $C_{18}$, about 79% by weight being $C_{18}$) and 80 ml. of toluene are mixed together, heated to the reflux temperature and maintained under reflux conditions for 2–3 hours in a flask equipped with a water condenser. 45 grams of water are collected in the condenser. Solvent is stripped from the mixture using a vacuum. The mixture is filtered over diatomaceous earth to provide 848 grams of product which is in the form of an oil.

Part B: 212 grams of the product of Part A, 28 grams of copper carbonate and 250 ml. of toluene are mixed together in a flask equipped with a water condenser. The mixture is heated to the reflux temperature and maintained under reflux conditions for 2 hours. Solvent is removed and the residue is filtered over diatomaceous earth to provide 255 grams of product which is in the form of an oil and has a copper content of 5.3% by weight.

EXAMPLE 2

78 grams of Aloxime 200 (a product of Henkel identified as 7-dodecyl-8-hydroxy quinoline), 14 grams of copper carbonate, 55 grams of 100N mineral oil and 100 ml. of toluene are mixed together in a flask equipped with a water condenser. The mixture is heated to the reflux temperature and maintained under reflux conditions for 2 hours. 4 grams of water are collected in the condenser. Solvent is stripped from the mixture using a vacuum to provide 120 grams of product which is in the form of a green oil and has a copper content of 4.3% by weight.

EXAMPLE 3

Part A: 203 grams of p-heptyl phenol, 350 grams of Duomeen T (a product of Armak identified as N-tallow-1,3-diaminopropane), 33 grams of paraformaldehyde and 250 ml. of toluene are mixed together in a flask equipped with a water condenser. The mixture heated to the reflux temperature and maintained under reflux conditions for 2 hours. 23 grams of water are collected in the water condenser. Solvent is stripped from the mixture using a vacuum to provide 500 grams of product which is in the form of a brown oil.

Part B: 141 grams of the product of Part A, 157 grams of copper naphthenate having a copper content of 8% by weight, and 200 ml. of toluene are mixed together in a flask equipped with a water condenser. The mixture is heated to 60° C. and maintained at that temperature for 2 hours. The mixture is then heated to the reflux temperature and maintained under reflux conditions for 2 hours. Solvent is stripped from the mixture by heating the mixture up to 150° C. vacuum at an absolute pressure of 20 mm. Hg. The mixture is filtered to provide 260 grams of product which is in the form of a green-brownish oil and has a copper content of 4.6% by weight.

EXAMPLE 4

Part A: 530 grams of propylene tetramer phenol and 400 grams of acetic acid are mixed in a flask which is equipped with a water condenser and is submerged in a cooling bath. 140 ml. of a 70% nitric acid solution are added to the mixture while maintaining the temperature of the mixture at less than 15° C. The mixture is heated to room temperature, and maintained at room temperature with stirring for 2–3 hours. The mixture is heated to 100° C. Acetic acid and water are stripped from the mixture by heating the mixture to a temperature of 130°–140° C. at an absolute pressure of 20 mm. Hg. The mixture is filtered over diatomaceous earth to provide 600 grams of product which is in the form of an orange-brown oil.

Part B: 200 grams of the product from Part A, 255 grams of copper naphthenate having a copper content of 8% by weight, and 250 ml. of toluene are mixed together under a nitrogen blanket in a flask equipped with a water condenser. The mixture is heated to the reflux temperature and maintained under reflux conditions for 2 hours. Solvent stripped from the mixture using a vacuum. The mixture is filtered over diatomaceous earth to provide 390 grams of product which is in the form of a green oil and has a copper content of 4.8% by weight.

EXAMPLE 5

Part A: 203 grams of p-heptyl phenol, 66 grams of paraformaldehyde, 206 grams of tetraethylene pentamine and 250 ml. of toluene are mixed in a flask equipped with a water condenser. The mixture is heated to the reflux temperature and maintained under reflux conditions for 2 hours. 40 grams of water are collected in the condenser. 150 grams of 100N mineral oil are added. The mixture is filtered over diatomaceous earth to provide 560 grams of product which is in the form of an oil.

Part B: 242 grams of the product from Part A and 393 grams of copper naphthenate having a copper content of 8% by weight are heated to a temperature of 100°–120° C. and maintained at that temperature for 2 hours with stirring. 25 grams of volatiles are removed from the mixture using evaporation under vacuum. The mixture is filtered over diatomaceous earth at a temperature of 120° F. to provide 563 grams of product which is in the form of a green-blue oil and has a copper content of 3.84% by weight.

EXAMPLE 6

Part A: 406 grams of p-heptyl phenol, 66 grams of paraformaldehyde, 31 grams of ethylenediamine and 250 ml. of toluene are mixed in a flask equipped with a water condenser. The mixture is heated up to the reflux temperature and maintained under reflux conditions for 2 hours. 40 grams of water are collected in the condenser. Solvent is evaporated using a vacuum to provide 470 grams of product.

Part B: 270 grams of the product from Part A, and 459 grams of copper naphthenate having an 8% by weight copper content are mixed, heated up to a temperature of 100°–120° C. and maintained at that temperature for 2 hours. The mixture is filtered over diatomaceous earth to provide 653 grams of product which is in the form of a green oil and has a copper content of 5.06% by weight.

EXAMPLE 7

Part A: 406 grams of p-heptyl phenol, 204 grams of dimethylpropylenediamine, 66 grams of paraformaldehyde and 250 ml. of toluene are mixed in a flask equipped with a water condenser. The mixture is heated up to the reflux temperature and maintained under reflux conditions for 2–3 hours. 37 grams of water are collected in the condenser. Solvent is removed and the mixture is filtered to provide 580 grams of product which is in the form of an oil.

Part B: 178 grams of the product from Part A and 196 grams of copper naphthenate having a copper content of 8% by weight are mixed, heated up to a temperature of 90°–100° C. and maintained at that temperature for 2 hours with stirring. The mixture is filtered over diatomaceous earth to provide 360 grams of product which is in the form of a green oil and has a copper content of 4.4% by weight.

EXAMPLE 8

.Part A: 406 grams of p-heptyl phenol, 145 grams of 3,3'-diamino-N-methyldipropylamine, 66 grams of paraformaldehyde and 200 ml. of toluene are mixed in a flask equipped with a water condenser, heated up to the reflux temperature and maintained under reflux conditions for 2–3 hours. 35 grams of water are collected in the condenser. Solvent is removed using a vacuum. The mixture is filtered over diatomaceous earth to provide 510 grams of product which is in the form of an oil.

Part B: 290 grams of the product from Part A and 393 grams of copper naphthenate having an 8% by weight copper content are heated up to a temperature of 90°–100° C. and maintained at that temperature for 2 hours with stirring. The mixture is filtered over diatomaceous earth to provide 628 grams of product which is in the form of an oil and has a copper content of 4.9% by weight.

EXAMPLE 9

Part A: 262 grams of dodecyl succinic anhydride, 266 grams of a hydroxy thioether of t-dodecyl mercaptan and propylene oxide having a sulfur content of 12% by weight, 5 grams of p-toluene sulfonic acid and 200 ml. of toluene are mixed, heated to the reflux temperature and maintained under reflux conditions for 8–10 hours. Solvent is removed and the mixture is filtered over diatomaceous earth to provide 520 grams of product which is in the form of a light-yellow oil.

Part B: 396 grams of the product from Part A, 41 grams of copper carbonate, 200 grams of 100N mineral oil and 250 ml. of toluene are mixed in a flask equipped with a water condenser and heated to a temperature of 50°–60° C. 50 grams of aqueous ammonium hydroxide are added to the mixture. The mixture is heated to a temperature of 90°–110° C. with nitrogen blowing. 50 grams of water are collected in the condenser. The mixture is heated to the reflux temperature and maintained under reflux conditions for 2 hours. Solvent is removed using a vacuum. The mixture is filtered over diatomaceous earth to provide 590 grams of product which is in the form of a green oil and has a copper content of 3.64% by weight.

EXAMPLE 10

410 grams of the reaction product of sulfur dichloride with propylene tetramer phenol, 55 grams of copper carbonate and 250 ml. of toluene are mixed in a flask equipped with a water condenser and heated to a temperature of 50° C. 58 grams of aqueous ammonium hydroxide having an ammonia content of 28.9% by weight are added to the mixture with stirring. The mixture is heated to the reflux temperature and maintained under reflux conditions for 2 hours. 40 grams of water are collected in the condenser. Solvent is removed using evaporation. The mixture is filtered over diatomaceous earth to provide 390 grams of product which is in the form of a dark-brown oil and has a copper content of 7.14% by weight.

EXAMPLE 11

262 grams of dodecyl succinic anhydride, 2 grams of p-toluene sulfonic acid and 150 ml. of toluene are mixed in a flask equipped with a water condenser. 106 grams of diethylene glycol are added to the mixture with stirring. The mixture is heated to 70°–80 ° C. and maintained at that temperature for 1 hour. The temperature of the mixture is reduced to 50° C. and 55 grams of copper carbonate are added with stirring. 58 grams of aqueous ammonium hydroxide are added to the mixture. The mixture is heated to a temperature of 90° C. and maintained at that temperature for 2 hours. 42 grams of water are collected in the condenser. Solvent is stripped from the mixture by heating the mixture to 120° C. at an absolute pressure of 20 mm. Hg. SC-100 Solvent is added to the mixture to reduce viscosity. The mixture is filtered over diatomaceous earth to provide 515 grams of product which is in the form of a blue-green oil and has a copper content of 3.7% by weight.

EXAMPLE 12

Part A: 609 grams of p-heptyl phenol, 282 grams of paraformaldehyde and 150 grams of 100N mineral oil are added to a flask equipped with a water condenser. 5.4 grams of a 36% by weight aqueous sodium hydroxide solution are added to the mixture. The mixture is heated to the reflux temperature and maintained under reflux conditions for 4 hours with nitrogen blowing. 23 grams of water are collected in the condenser. The mixture is diluted with toluene and a 5% hydrochloric acid solution is added to provide the mixture with a pH of 7. Water is removed from the mixture. The mixture is heated to the reflux temperature and maintained under reflux conditions to remove the remaining water. Solvent is removed using a vacuum to provide 815 grams of product.

Part B: 268 grams of product from Part A and 275 grams of copper naphthenate having an 8% by weight copper content are heated to a temperature of 100° C. and maintained at that temperature for 2 hours with stirring. The mixture is filtered over diatomaceous earth to provide 415 grams of product which is in the form of a green oil and has a copper content of 4.39% by weight.

EXAMPLE 13

46 grams of glyoxylic acid and 250 ml. toluene are mixed in a flask equipped with a water condenser. 140 grams of Armeen OL are added to the mixture with stirring. The mixture exotherms from room temperature to 50° C. The mixture is heated up to the reflux temperature and maintained under reflux conditions for 2 hours. 16 grams of water are collected in the condenser. The mixture is cooled to 50° C. 28 grams of copper carbonate are added with stirring. 28 ml. of aqueous ammonium hydroxide having an ammonia content of 29% by weight are added to the mixture. The mixture is heated to a temperature of 80°-90° C. and maintained at that temperature for 2 hours. 21 grams of water are collected in the condenser. Solvent is evaporated using a vacuum. 100 grams of SC-100 Solvent are added to the mixture. The mixture is filtered over diatomaceous earth to provide 150 grams of product which is in the form of a green oil and has a copper content of 4.15% by weight.

EXAMPLE 14

Part A: 74 grams of glycidol, 95 grams of carbon disulfide and 200 ml. of toluene are mixed in a flask equipped with a water condenser. The flask is maintained in an ice bath at a temperature below 20° C. 390 grams of Armeen 2C (a product of Armak identified as a mixture of fatty secondary amines) are added dropwise over 1-1.5 hours. The mixture is stirred at room temperature for 2-3 hours. Solvent is removed using a vacuum. The mixture is filtered over diatomaceous earth to provide 519 grams of product which is in the form of a light-yellow oil.

Part B: 135 grams of the product from Part A and 196 grams of copper naphthenate having an 8% by weight copper content are added to a flask, heated to a temperature 80°-90° C. and maintained at that temperature for 2 hours with stirring. The mixture is filtered over diatomaceous earth to provide 325 grams of product which is in the form of a brownish oil and has a copper content of 4.68% by weight.

EXAMPLE 15

131 grams of dodecyl succinic anhydride, 69 grams of anthranilic acid and 250 ml. of toluene are mixed in a flask equipped with a water condenser, heated to the reflux temperature and maintained under reflux conditions for 2-3 hours. Solvent is evaporated from the mixture. 394 grams of copper naphthenate having an 8% by weight copper content are added to the mixture. The mixture is heated to a temperature of 80° C. and maintained at that temperature for 2 hours with stirring. The mixture is filtered over diatomaceous earth to provide 500 grams of product which is in the form of a green oil and has a copper content of 4.3% by weight.

EXAMPLE 16

Part A: 318 grams of 2-methylene glutaronitrile, 342 grams of carbon disulfide and 250 ml. of toluene are mixed in a flask. 387 grams of dibutyl amine are added dropwise over a period of 2 hours while maintaining the temperature of the mixture at 10°-15° C. The mixture is maintained at room temperature with stirring for 2 hours. The mixture is heated to 50° C. and maintained at that temperature for 1 hour. Solvent is evaporated from the mixture. The mixture is filtered over diatomaceous earth to provide 855 grams of product which is in the form of an oil.

Part B: 80 grams of the product from Part A and 99 grams of copper naphthenate having an 8% by weight copper content are heated to a temperature of 80° C. and maintained at that temperature for 2 hours with stirring. The mixture is filtered to provide 155 grams of product which is in the form of a green oil and has a copper content of 4.34% by weight.

EXAMPLE 17

Part A: 145 grams of an aqueous solution of glyoxal containing 40% by weight glyoxal and 69 grams of $NH_2OH.HCl$ are mixed together in 200 ml. of water and cooled to less than 15° C. using dry ice. 84 grams of sodium bicarbonate are added to the mixture over a period of 1.5 hours. The mixture is heated to room temperature and maintained at that temperature for 10 hours with stirring. 278 grams of Armeen OL and 500 ml. of toluene are mixed together and added to the mixture. The mixture is heated to the reflux temperature and maintained under reflux conditions to distill out the water. Solvent is separated from the mixture. The mixture is filtered over diatomaceous earth to provide 285 grams of product which is in the form of an oil.

Part B: 167 grams of the product from Part A and 196 grams of copper naphthenate having a copper content of 8% by weight are mixed together heated to a temperature of 70°-80° C. and maintained at that temperature for 2 hours with stirring. The mixture is filtered over diatomaceous earth to provide 350 grams of product which is in the form of a brownish oil and has a copper content of 3.1% by weight.

EXAMPLE 18

Part A: 530 grams of propylene tetramer phenol, 66 grams of paraformaldehyde, 60 grams of ethylene diamine and 500 ml. of toluene are mixed in a flask equipped with a water condenser. The mixture is heated to the reflux temperature and maintained under reflux conditions for 2 hours. 43 grams of water are collected in the condenser. Solvent is removed using a vacuum. The mixture is filtered over diatomaceous earth to provide 580 grams of product which is in the form of an oil.

Part B: 307 grams of the product from Pan A, 100 grams of 100N mineral oil and 100 ml. of toluene are added to a flask equipped with a water condenser. The mixture is heated to 60°-70° C., and 28 grams of copper carbonate are added. The mixture exotherms to 90° C. The mixture is heated to the reflux temperature and maintained under reflux conditions for 1 hour. 4.3 grams of water are collected in the condenser. The mixture is maintained at 140° C. for 0.5 hour. Solvent is removed using a vacuum. The mixture is filtered over diatomaceous earth to provide 390 grams of product which is in the form of a green oil and has a copper content of 3.9% by weight.

EXAMPLE 19

287 grams of dodecylbenzotriazole and 236 grams of copper naphthenate having a copper content of 8% by weight are mixed together, heated to a temperature of 90° C. and maintained at that temperature for 2 hours with stirring. The mixture is filtered over a diatomaceous earth to provide 495 grams of product which is in the form of a green oil and has a copper content of 3.41% by weight.

EXAMPLE 20

Part A: 265 grams of propylene tetramer phenol, 123 grams of $NH(CH_2CH_2CN)_2$, 33 grams of paraformaldehyde and 250 ml. of toluene are mixed in a flask equipped with a water condenser. The mixture is heated to the reflux temperature and maintained under reflux conditions for 3 hours. 20 grains of water are collected in the condenser. The mixture is heated to the reflux temperature and maintained. Solvent is evaporated using a vacuum. The mixture is filtered over diatomaceous earth to provide 370 grams of product which is in the form of an oil.

Part B: 200 grams of the product from Part A, 158 grams of copper naphthenate having a copper content of 8% by weight, and 35 grams of the reaction product of polyisobutenyl (number average molecular weight of 950) succinic anhydride and a commercially available polyamine bottoms product are mixed, heated to a temperature of 80° C. and maintained at that temperature for 1 hour with stirring. The mixture is filtered to provide 370 grams of product which is in the form of a dark-green oil and has a copper content of 2.24% by weight.

EXAMPLE 21

Part A: 69 grams of $NH_2OH.HCl$ are mixed with 300 ml. of methanol, 80 grams of sodium hydroxide are mixed with 300 ml. of methanol. The sodium hydroxide-methanol solution is added to the $NH_2OH.HCl$-methanol solution dropwise over a period of 2 hours while maintaining the mixture at below a temperature of 15° C. 269 grams of methyl oleate are added dropwise to the mixture over a period of 0.5 hour while maintaining the mixture at less than 15° C. The mixture is heated to room temperature and maintained at that temperature for 3–5 hours with stirring. The mixture is filtered to provide 210 grams of product.

Part B: 81 grams of the product from Part A, 79 grams of copper naphthenate having an 8% by weight copper content, and 40 grams of SC-100 Solvent are mixed, heated to a temperature of 80°–90° C. and maintained at that temperature 2 hours with stirring to provide 175 grams of product which is in the form of a green gel and has a copper content of 1.93% by weight.

EXAMPLE 22

Part A: 795 grams of propylene tetramer phenol and 99 grams of paraformaldehyde are mixed with toluene in a flask equipped with a water condenser. 109 grams of butyl amine are added to the mixture. The mixture is heated to the reflux temperature and maintained under reflux conditions for 2 hours. 60 grams of water are collected in the condenser. Solvent is removed using a vacuum. The mixture is filtered over diatomaceous earth to provide 938 grams of product which is in the form of an oil.

Part B: 188 grams of the product from Part A, 11 grams of copper carbonate and 150 ml. of toluene are mixed together and heated to a temperature of 50° C. in a flask equipped with a water condenser. 10 ml. of a 30% aqueous solution of ammonium hydroxide are added to the mixture. The mixture is heated to the reflux temperature and maintained under reflux conditions for 2 hours. 12 grams of water are collected in the condenser. Solvent is removed from the mixture using a vacuum. The mixture is filtered over diatomaceous earth to provide 155 grams of product which is in the form of a dark brown-green viscous oil and has a copper content of 3.98% by weight.

EXAMPLE 23

Part A: 1143 grams of propylene tetramer phenol and 482 grams of acetic anhydride are mixed together, heated to 120° C. and maintained at that temperature for 5 hours. The mixture is vacuum stripped at 125° C. and 10 mm. Hg. absolute for 1.5 hours to provide 1319 grams of product which is in the form of a brown liquid.

Part B: 44.7 grams of $AlCl_3$ and 200 grams of mineral spirits are mixed together at room temperature under a nitrogen blanket. 154 grams of the product from Part A are added over a period of 0.5 hour. The mixture exotherms to 37° C. The mixture is then heated to 142° C. and maintained at that temperature for 25 hours. The mixture is cooled to 80° C. and 50 grams of water are added. The mixture is heated to 110°–115° C. and maintained at that temperature for 1.25 hours then cooled to room temperature. The mixture is washed using water, mineral spirits and isopropyl alcohol. The mixture is stripped by heating it to 147° C. at a pressure of 7 mm. Hg. absolute. The mixture is filtered using diatomaceous earth to provide 121 grams of product which is in the form of a clear, dark-red liquid.

Part C: 17.7 grams of sodium hydroxide are dissolved in 108.8 grams of water. 40 grams of the product from Part B, 32 ml. of n-butyl alcohol, and 27.7 grams of $(HONH_2)_2.H_2SO_4$ are mixed together at room temperature. The sodium hydroxide solution is added to the mixture, and the mixture is heated to 35° C. and maintained at that temperature for 5 hours under a nitrogen blanket. The mixture is cooled to room temperature and maintained at that temperature overnight. The mixture is heated to 35 ° C. and maintained at that temperature for 1 hour. 26.55 grams of acetic acid are added over a period of 0.05 hour. The mixture exotherms to 40° C. The mixture is cooled to room temperature with stirring. 100 ml. of toluene are added. The mixture is washed three times using 100 ml. of water with each wash. The mixture is placed in a flask equipped with a water condenser, stirred, heated under a nitrogen blanket to the reflux temperature and maintained under reflux conditions to remove water. The mixture is cooled and filtered. The filtrate is stripped to provide 41 grams of product which is in the form of a clear, dark-brown liquid.

Part D: 4.62 grams of copper carbonate and 50 grams of toluene are mixed in a flask equipped with a water condenser. 38 grams of the product from Part C are mixed with 90 grams of toluene and added to the copper carbonate-toluene mixture with stirring over a period of 0.2 hour while maintaining the temperature of the mixture at room temperature. The mixture is heated to the reflux temperature and maintained under reflux conditions for 1 hour and then cooled to 50° C. 4.5 grams of ammonium hydroxide are added to the mixture. The mixture is heated to the reflux temperature and maintained under reflux conditions until 4.6 grams of water are collected in the condenser. The mixture is cooled to room temperature and filtered over diatomaceous earth to provide 42 grams of product which is in the form of a dark-brown viscous liquid and has a copper content of 6.04% by weight.

EXAMPLE 24

Part A: 175 grams of Duomeen O (a product of Armak identified as N-oleyl-1,3-diaminopropane) are added to a flask equipped with a water condenser. 36.5 grams of diethyloxalate are added and the mixture exotherms to 69° C. The mixture is heated to 120° C. and maintained at that temperature for 2 hours. 17.9 grams of ethanol are collected in the condenser. The mixture is cooled to room temperature provide 190.8 grams of product which is in the form of a white solid.

Part B: 177.9 grams of the product from Part A are heated to a temperature of 80° C. in a flask equipped with a water condenser. 70 grams of toluene and 21.7 grams of copper carbonate having a copper content of 56.2% by weight are added to the mixture. 28.2 grams of concentrated aqueous ammonium hydroxide are added to the mixture dropwise over a period of 0.1 hour. The mixture is heated to the reflux temperature and maintained at that temperature for 2 hours. The mixture is subjected to nitrogen blowing at a rate of 0.5 standard cubic feet per hour for 0.5 hour. 30 grams of SC-100 Solvent and 10 grams of diatomaceous earth are added to the mixture. 27 grams of decyl alcohol are added to the mixture. The mixture is heated to 100 ° C. and filtered to provide 286.5 grams of product which is in the form of a blue gel having a copper content of 3.34% by weight.

EXAMPLE 25

Part A: 304 grams of p-heptylphenol, 525 grams of Duomeen T, 50 grams of paraformaldehyde and 350 ml. of toluene are mixed together in a flask equipped with a water condenser. The mixture is heated to the reflux temperature and maintained under reflux conditions for 3 hours. 35 grams of water are collected in the condenser. Solvent is stripped from the mixture using a vacuum. The mixture is filtered over diatomaceous earth to provide 729 grams of product which is in the form of a light-brown oil.

Part B: 112 grams of the product from Part A of this Example 25, 24 grams of the product from Part A of Example 22, 23 grams of 30% Cu Cem All, and 40 grams of SC-100 Solvent are heated to 80° C. with stirring and maintained at that temperature for 2 hours under a nitrogen blanket. The product is filtered over diatomaceous earth to provide 185 grams of product which is in the form of a brown oil having a copper content of 3.5% by weight.

EXAMPLE 26

25 grams of the product from Part A of Example 22, 112 grams of the product from Part A of Example 25, and 79 grams of copper naphthenate having a copper content of 8% by weight are mixed together, heated to a temperature of 80°-90° C. with stirring and maintained at that temperature under a nitrogen blanket for 2 hours. The mixture is filtered over diatomaceous earth to provide 200 grams of product which is in the form of a dark-green oil having a copper content of 2.55% by weight.

EXAMPLE 27

Part A: 262 grams of dodecylsuccinic anhydride and 150 ml. of toluene are mixed together in a flask equipped with a water condenser and heated to a temperature of 70°-80° C. 60 grams of ethylene diamine are mixed with 50 ml. of toluene. The ethylene diamine-toluene mixture is added to the dodecyl succinic anhydride-toluene mixture over a period of 0.5-1 hour. The mixture is heated to the reflux temperature and maintained under reflux conditions for 1 hour. Solvent is stripped from the mixture by heating the mixture to a temperature of 130° C. at a pressure of 20 mm. Hg. absolute. 50 grams of 100N mineral oil are added to the mixture with stirring to provide 350 grams of product which is in the form of a light orange oil.

Part B: 186 grams of the product from Part A and 118 grams of copper naphthenate having a copper content of 8% by weight are mixed together, heated to a temperature of 70°-80° C. with stirring, and maintained at that temperature for 2 hours to provide 300 grams of product which is in the form of a blue oil having a copper content of 3.27% by weight.

EXAMPLE 28

Part A: 175 grams of Duomeen O and 76 grams of carbon disulfide are mixed with 150 ml. of toluene and 100 ml. of isopropyl alcohol at a temperature below 15° C. 53 grams of 2,4-dicyano butene-1 are added to the mixture. The mixture is heated to room temperature and maintained at that temperature for 1 hour. The mixture is then heated to 40°-50° C. and maintained at that temperature for 2 hours. Solvent is removed using a vacuum. The mixture is filtered over diatomaceous earth to provide 245 grams of product which is in the form of a dark orange oil.

Part B: 133 grams of the product from Part A and 157 grams of copper naphthenate having a copper content of 8% by weight are mixed together, heated to a temperature of 80° C. and maintained at that temperature with stirring for 2 hours. The mixture is filtered over diatomaceous earth to provide 266 grams of product which is in the form of a dark oil having a copper content of 3.5% by weight.

EXAMPLE 29

200 grams of the product from Part A of Example 4, 36 grams of copper carbonate and 250 ml. of toluene are mixed together in a flask equipped with a water condenser. The mixture is heated to 60° C. and 38 grams of aqueous ammonium hydroxide are added. The mixture is subjected to nitrogen blowing at a rate of 3 standard cubic feet per hour for 2 hours. The mixture is heated to 80°-90° C. 25 grams of water are collected in the condenser. The mixture is heated to the reflux temperature and maintained under reflux conditions for 0.5 hour. Toluene is stripped from the mixture by heating the mixture to a temperature of 120° C. at a pressure of 20 mm. Hg. absolute. The mixture is filtered to provide 150 grams of product which is in the form of a brownish oil having a copper content of 0.77% by weight.

EXAMPLE 30

37 grams of glycidol, 76 grams of carbon disulfide and 100 ml. of toluene are mixed in a flask equipped with a water condenser. The flask is maintained in an ice bath at a temperature below 15° C. 100 ml. of isopropyl alcohol are added. 175 grams of Duomeen O are added dropwise over one hour. The mixture is stirred at room temperature for one hour. The mixture is heated to 40°-50° C. and maintained at that temperature for 2 hours. Solvent is removed using a vacuum. 393 grams of copper naphthenate having an 8% by weight copper content are added to the mixture. The mixture is heated to a temperature 70°-80° C. and maintained at that temperature for 2 hours with stirring, The mixture is filtered to provide 630 grams of product which is in the form of an oil having a copper content of 4.88% by weight.

EXAMPLE 31

103 grams of o-nitrophenol and 33 grams of paraformaldehyde are mixed in toluene in a flask equipped with a water condenser. 262 grams of Duomeen O are added over a period of 0.5 hour, The mixture is heated to the reflux temperature and maintained under reflux conditions for 2-3 hours. 15 grams of water are collected in the condenser, The mixture is cooled to room temperature. 33 grams of copper carbonate are added.

The mixture is heated to the reflux temperature and maintained at that temperature for 2 hours to remove water. 25 ml. of volatiles are removed from the mixture using evaporation under vacuum, The mixture is filtered over diatomaceous earth to provide 380 grams of product which is in the form of a green oil having a copper content of 4.14% by weight.

EXAMPLE 32

Part A: 108 grams of phenyl hydrazine are mixed with 200 ml. of ethanol at room temperature. 128 grams of 2-ethylhexanal are added dropwise to the mixture with stirring. The mixture exotherms to about 25° C. The mixture is stirred for 0.5 hour and cooled to room temperature. Additional ethanol is added until a clear yellow solution is obtained.

Part B: 130 grams of dodecylaniline are mixed with 300 ml. of ethanol at room temperature. The mixture is cooled to 0° C. 60 grams of concentrated (38% by weight) hydrochloric acid are added to the mixture and the mixture exotherms to 22° C. The mixture is cooled to 0° C. 40 grams of $NaNO_2$ are dissolved in 100 ml. of water. The resulting $NaNO_2$ solution is added to the mixture dropwise over a period of 0.75 hour while the temperature of the mixture is maintained below 5° C. 100 ml. of textile spirits (a low-boiling hydrocarbon solvent) are added to the mixture to facilitate dissolution of the $NaNO_2$.

Part C: 300 grams of concentrated aqueous NaOH (50% by weight) are mixed with 1000 ml. of ethanol to form a solution. 109 grams of the product from Part A and 136 grams of the product from Part B are added to the NaOH-ethanol solution simultaneously with stirring. The resulting mixture is maintained at room temperature overnight. 500 ml. of hexane and 500 ml. of water are added to the mixture with the result being the formation of an aqueous layer and an organic layer. The organic layer is separated from the aqueous layer, washed three times in water, dried, filtered and stripped to provide 60 grams of product.

Part D: 48.8 grams of the product from Part C are dissolved in 50 ml. of acetone and heated to 50° C. to form a first solution. 10 grams of cupric acetate are dissolved in a mixture of 150 ml. of water and 50 ml. of methanol to form a second solution. The second solution is heated to 50° C. The first solution is mixed with the second solution to form a third solution. 100 ml. of water and 100 ml. of naphtha are added to the third solution with the result being the formation of an aqueous layer and an organic layer. The organic layer is separated from the aqueous layer. 100 ml. of water and 100 ml. of naphtha are added to the separated organic layer with the result being the formation of an aqueous layer and an organic layer. The organic layer is separated from the aqueous layer. The separated organic layer is dried, filtered and stripped to provide 44 grams of product having a copper content of 2.21% by weight.

EXAMPLE 33

Part A: 265 grams of propylene tetramer phenol, 350 grams of Duomeen O, 33 grams of paraformaldehyde and 200 ml. of toluene are mixed together in a flask equipped with a water condenser. The mixture is heated under reflux conditions for 3–4 hours. 22 grams of water are collected in the condenser. Solvent is stripped from the mixture using a vacuum. The mixture is filtered over a diatomaceous earth to provide 628 grams of product which is in the form of an oil.

Part B: 63 grams of the product from Part A of this Example 46, 63 grams of the product from Part A of Example 30, and 78.7 grams of copper naphthenate having a copper content of 8% by weight are mixed together, heated to a temperature of 70°–80° C. with stirring and maintained at that temperature for 2 hours. The mixture is filtered over diatomaceous earth to provide 195 grams of product which is in the form of a dark-green oil and has a copper content of 2.98% by weight.

EXAMPLE 34

144 grams of the borated reaction product of ethylene polyamine and polyisobutenyl (number average molecular weight of 950) succinic anhydride and 196 grams of copper naphthenate having a copper content of 8% by weight are mixed together in 250 ml. of toluene, heated to the reflux temperature and maintained at that temperature under a nitrogen blanket for 1 hour. The mixture is stripped using a vacuum and filtered over diatomaceous earth to provide 305 grams of product which is in the form of a green oil.

EXAMPLE 35

Part A: 561 grams of the reaction product of polyisobutenyl (number average molecular weight of 950) succinic anhydride and a commercially available polyamine bottoms product are mixed with 500 ml. of toluene. 93 grams of $H_3BO_3$ are added. The mixture is heated to 60° C. with stirring in a flask equipped with a water condenser. The mixture is heated to the reflux temperature and maintained under reflux conditions until 30 grams of water are collected in the condenser. The temperature of the mixture is adjusted to 200° C., and an additional 5 grams of water are collected in the condenser. The solvent is stripped from the mixture using a vacuum. The mixture is filtered over diatomaceous earth to provide 722 grams of product which is in the form of a brown oil.

Part B: 152 grams of the product from Part A and 158 grams of copper naphthenate having a copper content of 8% by weight are mixed, heated to a temperature of 80°–90° C. and maintained at that temperature under nitrogen for 2–3 hours with stirring. The mixture is filtered over diatomaceous earth to provide 320 grams of product which is in the form of a green oil.

EXAMPLE 36

Part A: 212.5 grams of propylene tetramer phenol and 60 grams of t-butyl amine are mixed in a flask equipped with a water condenser. The mixture is heated to 70° C. and 27.8 grams of para formaldehyde are added. The mixture begins to foam and a foam trap is added. The mixture is heated to 90° C. and maintained at that temperature for 15 minutes. 150 ml. of foam are collected in the foam trap. The foamed-over material is added back into the flask. The mixture is purged with nitrogen at a rate of 2.5 standard cubic feet per hour, the final temperature being 140° C. 14.8 grams of water are collected in the condenser. 104.2 ml. of toluene are stripped from the mixture to provide 339 grams of product which is in the form of a yellow-golden liquid.

Part B: 169.5 grams of the product from Part A, 15.03 grams of copper carbonate having a copper content of 56.2% by weight, 34.5 grams of isooctanol and 67.8 grams of toluene are mixed in a flask equipped with a water condenser. The mixture is heated to 50° C., and 36.6 grams of aqueous ammonium hydroxide (29% by weight ammonia) are added to the mixture dropwise over a period of 15 minutes. The mixture is blown with air at a rate of 0.5 standard cubic feet per hour and heated to the reflux temperature of 120° C. The mixture is maintained at 120° C. for 2 hours, then cooled to room temperature. The mixture is then heated to the reflux temperature and maintained at that temperature for 7 hours. The mixture is cooled to room temperature and maintained at room temperature for 3 days. The mixture is heated to 150° C. 31.4 grams of water are removed. The mixture is cooled to 80° C., and 57.5 grams of SC-100 solvent are added. The mixture is filtered over diatomaceous earth to provide 215 grams of product having a copper content of 2.88% by weight.

EXAMPLE 37

169.5 grams of the product from Part A of Example 36, 26.61 grams of copper acetate and 103.4 grams toluene are mixed in a flask equipped with a water condenser. Air is blown through the mixture at a rate of 0.5 standard cubic feet per hour. The mixture is heated to the reflux temperature of 120° C. and maintained under reflux conditions for 3 hours. The mixture is cooled to room temperature, then heated to the reflux temperature and maintained at that temperature for 7 hours. The mixture is cooled to room temperature and maintained at that temperature for 3 days. The mixture is heated to 145° C. with 9.35 grams of a mixture of acetic acid and water being collected in the water condenser. 57.5 grams of SC-100 solvent, 34.5 grams of isooctanol and 5 grams of diatomaceous earth are added to the mixture. The mixture is filtered to provide 237.5 grams of product having a copper content of 1.20% by weight.

Diesel Fuels.

The diesel fuels that are useful with this invention can be any diesel fuel. In one embodiment the diesel fuel has a sulfur content of no more than about 0.1% by weight, preferably no more than about 0.05% by weight as determined by the test method specified in ASTM D 2622-87 entitled "Standard Test Method for Sulfur in Petroleum Products by X-Ray Spectrometry". Any fuel having a boiling range and viscosity suitable for use in a diesel-type engine can be used. These fuels typically have a 90% Point distillation temperature in the range of about 300° C. to about 390° C., preferably about 330° C. to about 350° C. The viscosity for these fuels typically ranges from about 1.3 to about 24 centistokes at 40° C. These diesel fuels can be classified as any of Grade Nos. 1-D, 2-D or 4-D as specified in ASTM D 975 entitled "Standard Specification for Diesel Fuel Oils". These diesel fuels can contain alcohols and esters.

The inventive diesel fuel compositions contain an effective amount of one or more of the copper-containing organometallic complexes described above to lower the ignition temperature of exhaust particulates formed on burning of the diesel fuel. The concentration of these organometallic complexes in the inventive diesel fuels is usually expressed in terms of the level of addition of the metal from such complexes. These diesel fuels preferably contain from 1 to about 5000 parts of such metal per million parts of fuel, more preferably from about 1 to about 500 parts of metal per million parts of fuel, more preferably from 1 to about 100 parts per million parts of fuel.

The inventive diesel fuel compositions can contain, in addition to the above-indicated organometallic complexes, other additives which are well known to those of skill in the art. These include antioxidants, dyes, cetane improvers, rust inhibitors such as alkylated succinic acids and anhydrides, bacteriostatic agents, gum inhibitors, metal deactivators, demulsifiers, upper cylinder lubricants and anti-icing agents.

These diesel fuel compositions can be combined with an ashless dispersant. Suitable ashless dispersants include esters of mono- or polyols and high molecular weight mono- or polycarboxylic acid acylating agents containing at least about 30 carbon atoms in the acyl moiety. Such esters are well known to those skilled in the art. See, for example, French Patent 1,396,645; British Patents 981,850; 1,055,337 and 1,306,529; and U.S. Pat. Nos. 3,255,108; 3,311,558; 3,331,776; 3,346,354; 3,522,179; 3,579,450; 3,542,680; 3,381,022; 3,639,242; 3,697,428; and 3,708,522. These patents are expressly incorporated herein by reference for their disclosure of suitable esters and methods for their preparation. When such dispersants are used, the weight ratio of the above-described organometallic complexes to the aforesaid ashless dispersant can be between about 0.1:1 and about 10:1, preferably between about 1:1 and about 10:1.

The organometallic complexes of this invention can be added directly to the fuel, or they can be diluted with a substantially inert, normally liquid organic diluent such as naphtha, benzene, toluene, xylene or a normally liquid fuel, to form an additive concentrate. Similarly, the above-described antioxidants can be added directly to the fuel or they can also be incorporated into the concentrate. These concentrates generally contain from about 1% to about 90% by weight of the organometallic complexes of this invention. The concentrates may also contain from about up to about 90% by weight, generally from about 1% to about 90% by weight of one or more of the above-described antioxidants. These concentrates may also contain one or more other conventional additives known in the art or described hereinabove.

In one embodiment of the invention the copper-containing organometallic complex is combined with the diesel fuel by direct addition, or as part of a concentrate as discussed above, and the diesel fuel is used to operate a diesel engine equipped with an exhaust system particulate trap. The diesel fuel containing the organometallic complex is contained in a fuel tank, transmitted to the diesel engine where it is burned, and the organometallic complex reduces the ignition temperature of exhaust particles collected in the exhaust system particulate trap. In another embodiment, the foregoing operational procedure is used except that the organometallic complex is maintained on board the apparatus being powered by the diesel engine (e.g., automobile, bus, truck, etc.) in a separate fuel additive dispenser apart from the diesel fuel. The organometallic complex is combined or blended with the diesel fuel during operation of the diesel engine. In this latter embodiment, the organometallic complex that is maintained in the fuel additive dispenser can form a pan of a fuel additive concentrate of the type discussed above, the concentrate being combined with the diesel fuel during operation of the diesel engine.

The following concentrate formulations are provided for purposes of exemplifying the invention. In each formulation the indicated copper complex from Examples 1–37 is used, the treatment level being expressed in pans by weight based on the amount of the product from said examples that is added to the concentrate. For each of the products from Examples 1–37, two concentrate formulations are provided, one being formulation- 1 (e.g., concentrate formulation A-1) which contains an antioxidant, and the other being formulation-2 (e.g., concentrate formulation A-2) which does not contain an antioxidant. The antioxidant is 5-dodecyl salicylaldoxime. The treatment level for the antioxidant is expressed in parts by weight. With all formulations the remainder is xylene which is expressed in terms of parts by weight.

| Concentrate Formulation | Copper Complex Example | Copper Complex Treatment (parts) | Antioxidant (parts) | Xylene (parts) |
|---|---|---|---|---|
| A-1 | 1 | 377 | 35 | 412 |
| A-2 | 1 | 377 | — | 377 |
| B-1 | 2 | 465 | 35 | 500 |
| B-2 | 2 | 465 | — | 465 |
| C-1 | 3 | 435 | 35 | 470 |
| C-2 | 3 | 435 | — | 435 |
| D-1 | 4 | 417 | 35 | 452 |
| D-2 | 4 | 417 | — | 417 |
| E-1 | 5 | 521 | 35 | 556 |
| E-2 | 5 | 521 | — | 521 |
| F-1 | 6 | 395 | 35 | 430 |
| F-2 | 6 | 395 | — | 395 |
| G-1 | 7 | 455 | 35 | 490 |
| G-2 | 7 | 455 | — | 455 |
| H-1 | 8 | 408 | 35 | 443 |
| H-2 | 8 | 408 | — | 408 |
| I-1 | 9 | 549 | 35 | 584 |
| I-2 | 9 | 549 | — | 549 |
| J-1 | 10 | 280 | 35 | 315 |
| J-2 | 10 | 280 | — | 280 |
| K-1 | 11 | 541 | 35 | 576 |
| K-2 | 11 | 541 | — | 541 |
| L-1 | 12 | 456 | 35 | 491 |
| L-2 | 12 | 456 | — | 456 |
| M-1 | 13 | 417 | 35 | 452 |
| M-2 | 13 | 417 | — | 417 |
| N-1 | 14 | 427 | 35 | 462 |
| N-2 | 14 | 427 | — | 427 |
| O-1 | 15 | 465 | 35 | 500 |
| O-2 | 15 | 465 | — | 465 |
| P-1 | 16 | 461 | 35 | 496 |
| P-2 | 16 | 461 | — | 461 |
| Q-1 | 17 | 645 | 35 | 680 |
| Q-2 | 17 | 645 | — | 645 |
| R-1 | 18 | 513 | 35 | 548 |
| R-2 | 18 | 513 | — | 513 |
| S-1 | 19 | 587 | 35 | 622 |
| S-2 | 19 | 587 | — | 587 |
| T-1 | 20 | 893 | 35 | 928 |
| T-2 | 20 | 893 | — | 893 |
| U-1 | 21 | 1036 | 35 | 1071 |
| U-2 | 21 | 1036 | — | 1036 |
| V-1 | 22 | 503 | 35 | 538 |
| V-2 | 22 | 503 | — | 503 |
| W-1 | 23 | 331 | 35 | 366 |
| W-2 | 23 | 331 | — | 331 |
| X-1 | 24 | 599 | 35 | 634 |
| X-2 | 24 | 599 | — | 599 |
| Y-1 | 25 | 571 | 35 | 606 |
| Y-2 | 25 | 571 | — | 571 |
| Z-1 | 26 | 784 | 35 | 819 |
| Z-2 | 26 | 784 | — | 784 |
| AA-1 | 27 | 612 | 35 | 647 |
| AA-2 | 27 | 612 | — | 612 |
| BB-1 | 28 | 571 | 35 | 606 |
| BB-2 | 28 | 571 | — | 571 |
| CC-1 | 29 | 2597 | 35 | 2632 |
| CC-2 | 29 | 2597 | — | 2597 |
| DD-1 | 30 | 410 | 35 | 445 |
| DD-2 | 30 | 410 | — | 410 |
| EE-1 | 31 | 483 | 35 | 518 |
| EE-2 | 31 | 483 | — | 483 |
| FF-1 | 32 | 905 | 35 | 940 |
| FF-2 | 32 | 905 | — | 905 |
| GG-1 | 33 | 671 | 35 | 706 |
| GG-2 | 33 | 671 | — | 671 |
| HH-1 | 34 | 417 | 35 | 452 |
| HH-2 | 34 | 417 | — | 417 |

-continued

| Concentrate Formulation | Copper Complex Example | Copper Complex Treatment (parts) | Antioxidant (parts) | Xylene (parts) |
|---|---|---|---|---|
| II-1 | 35 | 488 | 35 | 523 |
| II-2 | 35 | 488 | — | 488 |
| JJ-1 | 36 | 694 | 35 | 729 |
| JJ-2 | 36 | 694 | — | 694 |
| KK-1 | 37 | 1667 | 35 | 1702 |
| KK-2 | 37 | 1667 | — | 1667 |

The following diesel fuel formulations are provided for purposes of exemplifying the invention. In each of the following diesel fuel formulations a Grade 2-D diesel fuel having a sulfur content of 0.05% by weight is used. In each formulation the indicated copper complex from Examples 1–37 is used, the treatment level being expressed in parts per million (ppm) based on the amount of the product from said examples that is added to the fuel. For each of the products from Examples 1–37 two diesel fuel formulations are provided, one being formulation -1 (e.g., diesel fuel formulation A-1) which contains an antioxidant, and the other being formulation-2 (e.g., diesel fuel formulation A -2) which does not contain an antioxidant. The antioxidant is 5-dodecyl salicylaldoxime. The treatment level for the antioxidant is expressed in parts per million. With all formulations the remainder is the above-indicated low-sulfur diesel fuel which is expressed in terms of percent by weight.

| Fuel Formulation | Copper Complex Example | Copper Complex Treatment (ppm) | Antioxidant (ppm) | Diesel Fuel (Wt %) |
|---|---|---|---|---|
| A-1 | 1 | 377 | 35 | 99.9588 |
| A-2 | 1 | 377 | — | 99.9623 |
| B-1 | 2 | 465 | 35 | 99.9500 |
| B-2 | 2 | 465 | — | 99.9535 |
| C-1 | 3 | 435 | 35 | 99.9530 |
| C-2 | 3 | 435 | — | 99.9565 |
| D-1 | 4 | 417 | 35 | 99.9548 |
| D-2 | 4 | 417 | — | 99.9583 |
| E-1 | 5 | 521 | 35 | 99.9444 |
| E-2 | 5 | 521 | — | 99.9479 |
| F-1 | 6 | 395 | 35 | 99.9570 |
| F-2 | 6 | 395 | — | 99.9605 |
| G-1 | 7 | 455 | 35 | 99.9510 |
| G-2 | 7 | 455 | — | 99.9545 |
| H-1 | 8 | 408 | 35 | 99.9557 |
| H-2 | 8 | 408 | — | 99.9592 |
| I-1 | 9 | 549 | 35 | 99.9416 |
| I-2 | 9 | 549 | — | 99.9451 |
| J-1 | 10 | 280 | 35 | 99.9685 |
| J-2 | 10 | 280 | — | 99.9720 |
| K-1 | 11 | 541 | 35 | 99.9424 |
| K-2 | 11 | 541 | — | 99.9459 |
| L-1 | 12 | 456 | 35 | 99.9509 |
| L-2 | 12 | 456 | — | 99.9544 |
| M-1 | 13 | 417 | 35 | 99.9548 |
| M-2 | 13 | 417 | — | 99.9583 |
| N-1 | 14 | 427 | 35 | 99.9538 |
| N-2 | 14 | 427 | — | 99.9573 |
| O-1 | 15 | 465 | 35 | 99.9500 |
| O-2 | 15 | 465 | — | 99.9535 |
| P-1 | 16 | 461 | 35 | 99.9504 |
| P-2 | 16 | 461 | — | 99.9539 |
| Q-1 | 17 | 645 | 35 | 99.9320 |
| Q-2 | 17 | 645 | — | 99.9355 |
| R-1 | 18 | 513 | 35 | 99.9452 |
| R-2 | 18 | 513 | — | 99.9487 |
| S-1 | 19 | 587 | 35 | 99.9378 |
| S-2 | 19 | 587 | — | 99.9413 |
| T-1 | 20 | 893 | 35 | 99.9072 |
| T-2 | 20 | 893 | — | 99.9107 |
| U-1 | 21 | 1036 | 35 | 99.9929 |

-continued

| Fuel Formulation | Copper Complex Example | Copper Complex Treatment (ppm) | Antioxidant (ppm) | Diesel Fuel (Wt %) |
|---|---|---|---|---|
| U-2 | 21 | 1036 | — | 99.9964 |
| V-1 | 22 | 503 | 35 | 99.9462 |
| V-2 | 22 | 503 | — | 99.9497 |
| W-1 | 23 | 331 | 35 | 99.9634 |
| W-2 | 23 | 331 | — | 99.9669 |
| X-1 | 24 | 599 | 35 | 99.9366 |
| X-2 | 24 | 599 | — | 99.9401 |
| Y-1 | 25 | 571 | 35 | 99.9394 |
| Y-2 | 25 | 571 | — | 99.9429 |
| Z-1 | 26 | 784 | 35 | 99.9181 |
| Z-2 | 26 | 784 | — | 99.9216 |
| AA-1 | 27 | 612 | 35 | 99.9353 |
| AA-2 | 27 | 612 | — | 99.9388 |
| BB-1 | 28 | 571 | 35 | 99.9394 |
| BB-2 | 28 | 571 | — | 99.9429 |
| CC-1 | 29 | 2597 | 35 | 99.7368 |
| CC-2 | 29 | 2597 | — | 99.7403 |
| DD-1 | 30 | 410 | 35 | 99.9555 |
| DD-2 | 30 | 410 | — | 99.9590 |
| EE-1 | 31 | 483 | 35 | 99.9482 |
| EE-2 | 31 | 483 | — | 99.9517 |
| FF-1 | 32 | 905 | 35 | 99.9060 |
| FF-2 | 32 | 905 | — | 99.9095 |
| GG-1 | 33 | 671 | 35 | 99.9294 |
| GG-2 | 33 | 671 | — | 99.9329 |
| HH-1 | 34 | 417 | 35 | 99.9548 |
| HH-2 | 34 | 417 | — | 99.9583 |
| II-1 | 35 | 488 | 35 | 99.9477 |
| II-2 | 35 | 488 | — | 99.9512 |
| JJ-1 | 36 | 694 | 35 | 99.9271 |
| JJ-2 | 36 | 694 | — | 99.9306 |
| KK-1 | 37 | 1667 | 35 | 99.8298 |
| KK-2 | 37 | 1667 | — | 99.8333 |

While the invention has been explained in relation to its preferred embodiments, it is to be understood that various modifications thereof will become apparent to those skilled in the an upon reading the specification. Therefore, it is to be understood that the invention disclosed herein is intended to cover such modifications as fall within the scope of the appended claims.

We claim:

1. A composition comprising at least one organometallic complex wherein the metal is Cu or Cu in combination with one or more metals selected from the group consisting of Na, K, Mg, Ca, Sr, Ba, V, Cr, Mo, Fe, Co, Zn, B, Pb, Sb, Ti, Mn and Zr, the metal in said organometallic complex being sufficiently active so that when said organometallic complex is dispersed in a diesel fuel and said diesel fuel is used in a diesel engine equipped with an exhaust system particulate trap the metal from said organometallic complex reduces the ignition temperature of exhaust particles collected in said trap, said complex being derived from (i) at least one organic compound containing a hydrocarbon linkage and at least two functional groups, each of said functional groups being independently selected from the group consisting of =X, —XR, —$NR_2$, —$NO_2$, =NR, =NXR, =N—R*—XR, $$-\underset{\underset{R}{|}}{N}-(\underset{\underset{R}{|}}{R^*N})_a-R,\ -\underset{\underset{R}{|}}{P}(X)XR,\ -\underset{\underset{XR}{|}}{P}(X)XR,\ -N{=}CR_2,$$

—CN and —N=NR, wherein

X is O or S,

R is H or hydrocarbyl,

R* is hydrocarbylene or hydrocarbylidene, a is a number ranging from zero to about 10; and said organic compound being selected from the group consisting of: aromatic Mannichs derived from amines other than hydroxyl- and/or thiol-containing amines or other than alkylene polyamines wherein the alkylene is ethylene or propylene; hydroxyaromatic ketoximes; Schiff bases other than hydroxyaromatic Schiff bases; calixarenes; α-substituted phenols wherein the substituent is $NR^1_2$, $SR^1$ or $NO_2$ and $R^1$ is H or a hydrocarbyl group; β-substituted phenols represented by either of the formulae

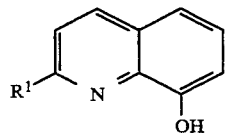

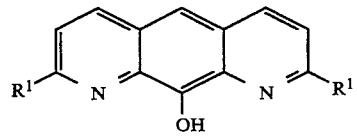

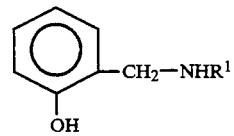

wherein each $R^1$ is H or a hydrocarbyl group, or each $R^1$ is a group represented by the formula $R^2R^3NR^4$— wherein $R^2$ and $R^3$ are independently H or hydrocarbyl groups, and $R^4$ is a hydrocarbylene or hydrocarbylidene group; carboxylic acid esters characterized by the presence of at least one carboxylic acid ester group and at least one additional functional group, said additional functional group being one of said functional groups or another carboxylic acid ester group; acylated amines characterized by at least one acyl group and at least one amino group and being other than the product made by the reaction of a hydrocarbon-substituted succinic acid compound having at least 50 aliphatic carbon atoms in the hydrocarbon substituent with an alkylene amine; hydroxyazylenes; benzotriazoles; amino acids; hydroxamic acids; linked phenolic compounds wherein the linking group is —$CH_2$— or —$CH_2OCH_2$—; aromatic difunctional compounds wherein the functional groups are independently —OH, —$NO_2$, —$NH_2$, —COOR, —SH or —C(O)H; xanthates; formazyls; pyridines; borated acylated amines; phosphorous-containing acylated amines; substituted pyrroles wherein the substituent is —OH, —$NH_2$, —$NR_2$, —COOR, —SH or —C(O)H; porphyrins; or ethylene diamine tetraacetic acids or acid esters;

(ii) at least one metal reactant containing said metal.

2. The composition of claim 1 wherein said metal complex is soluble or stably dispersible in said diesel fuel.

3. The composition of claim 1 wherein said functional groups are on different carbon atoms of the hydrocarbon linkage.

4. The composition of claim 1 wherein said functional groups are in vicinal or beta position relative to each other.

5. The composition of claim 1 wherein said functional groups are =X, —OH, —$NR_2$, —$NO_2$, =NR, =NOH,

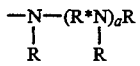

or —CN.

6. The composition of claim 1 wherein component (i) is an aromatic Mannich, said aromatic Mannich being the reaction product of (A-1) a hydroxy and/or thiol-containing aromatic compound having the formula

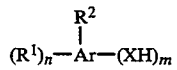

(A-1)

wherein in Formula (A-1) Ar is an aromatic group; m is 1, 2 or 3; n is a number from 1 to about 4; each $R^1$ independently is H or a hydrocarbyl group having from 1 to about 100 carbon atoms; $R^2$ is H, amino or carboxyl; and X is O, S, or both when m is 2 or greater;

(A-2) an aldehyde or ketone having the formula

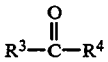

(A-2)

or a precursor thereof; wherein in Formula (A-2) $R^3$ and $R^4$ independently are H, saturated hydrocarbyl groups having from 1 to about 18 carbon atoms, and $R^4$ can also be a carbonyl-containing hydrocarbyl group having from 1 to about 18 carbon atoms; and (A-3) an amine which contains at least one primary or secondary amino group, said amine being characterized by the absence of hydroxyl and/or thiol groups, said amine being other than an ethylene polyamine or a propylene polyamine, said reaction between components (A-1), (A-2) and (A-3) being conducted at a temperature below about 120° C.

7. The composition of claim 1 wherein component (i) is an aromatic Mannich represented by the formula

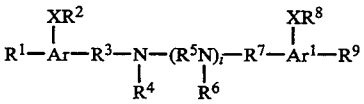

(III)

wherein in Formula (III), Ar and $Ar^1$ are independently aromatic groups, $R^1$, $R^2$, $R^4$, $R^6$, $R^8$ and $R^9$ are independently H or aliphatic hydrocarbyl groups, $R^4$ can be a hydroxy-substituted aliphatic hydrocarbyl group, $R^3$, $R^5$ and $R^7$ are independently hydrocarbylene or hydrocarbylidene groups, with the proviso that $R^5$ is other than ethylene or propylene, X is O or S, and i is a number that is 5 or higher.

8. The composition of claim 1 wherein component (i) is an aromatic Mannich represented by the formula:

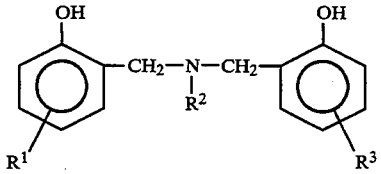

(IV)

wherein in Formula (IV), $R^1$ and $R^3$ are independently H or aliphatic hydrocarbyl groups, and $R^2$ is a hydrocarbyl group.

9. The composition of claim 1 wherein component (i) is an aromatic Mannich represented by the formula

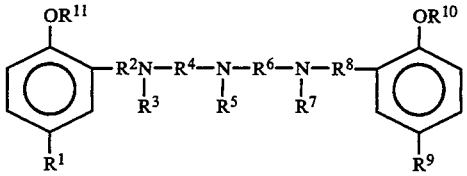

(V)

wherein in Formula (V), $R^1$, $R^3$, $R^5$, $R^7$, $R^9$, $R^{10}$ and $R^{11}$ are independently H or aliphatic hydrocarbyl groups; and $R^2$ and $R^8$ are independently hydrocarbylene or hydrocarbylidene groups; and $R^4$ and $R^6$ are independently hydrocarbylene or hydrocarbylidene groups of 3 to about 20 carbon atoms, with the proviso that $R^4$ and $R^6$ are other than propylene.

10. The composition of claim 1 wherein component (i) is an aromatic Mannich represented by the formula

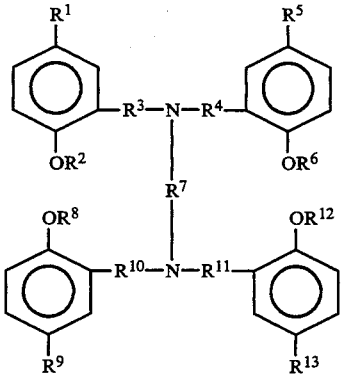

(VI)

wherein in Formula (VI), $R^1$, $R^2$ $R^5$, $R^6$, $R^8$, $R^9$, $R^{12}$ and $R^{13}$ are independently H or aliphatic hydrocarbyl groups, and $R^3$, $R^4$, $R^7$, $R^{10}$ and $R^{11}$ are independently hydrocarbylene or hydrocarbylidene groups.

11. The composition of claim 1 wherein component (i) is a compound represented by the formula

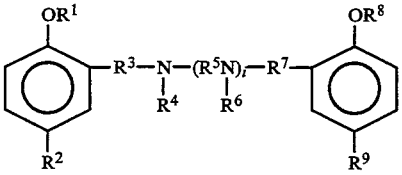

(VII)

wherein in Formula (VII), $R^1$, $R^2$, $R^4$, $R^6$, $R^8$ and $R^9$ are independently H or aliphatic hydrocarbyl groups, $R^3$, $R^5$ and R 7 are independently hydrocarbylene or hydrocarbylidene groups with the proviso that $R^5$ is other than ethylene or propylene, and i is a number ranging from zero to about 10, with the proviso that i is 5 or higher when $R^1$ and $R^8$ and H and $R^5$ is ethylene.

12. The composition of claim 1 wherein component (i) is an aromatic Mannich represented by the formula

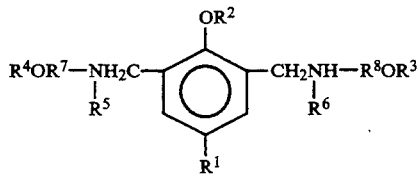

(VIII)

wherein in Formula (VIII), $R^1$, $R^2$, $R^3$, $R^4$, $R^5$ and $R^6$ are independently H or hydrocarbyl groups, and $R^7$ and $R^8$ are independently hydrocarbylene or hydrocarbylidene groups.

13. The composition of claim 1 wherein component (i) is an aromatic Mannich represented by the formula

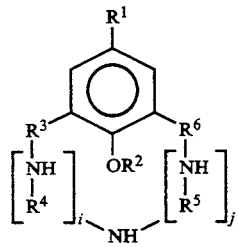

(IX)

wherein in Formula (IX), $R^1$ and $R^2$ are independently H or hydrocarbyl groups, $R^3$, $R^4$, $R^5$ and $R^6$ are independently alkylene or alkylidene groups, and i and j are independently numbers in the range of 1 to about 6.

14. The composition of claim 1 wherein component (i) is an aromatic Mannich represented by the formula:

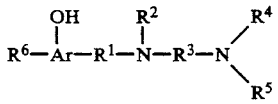

(X)

wherein in Formula (X), Ar is an aromatic group; $R^1$ and $R^3$ are, independently, hydrocarbylene or hydrocarbylidene groups; $R^2$ is H or a lower hydrocarbyl group; $R^4$ and $R^5$ are, independently, H, aliphatic hydrocarbyl groups, hydroxy-substituted aliphatic hydrocarbyl groups, amine-substituted aliphatic hydrocarbyl groups or alkoxy-substituted aliphatic hydrocarbyl groups; and $R^6$ is H or an aliphatic hydrocarbyl group.

15. The composition of claim 1 wherein component (i) is an aromatic Mannich represented by the formula

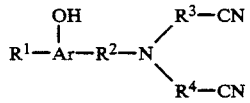

(XI)

wherein in Formula (XI), Ar is an aromatic group, $R^1$ is H or aliphatic hydrocarbyl group, and $R^2$, $R^3$ and $R^4$ are independently hydrocarbylene or hydrocarbylidene groups.

16. The composition of claim 1 wherein said metal is copper.

17. The composition of claim 1 wherein said metal is Cu in combination with one or more of Fe, V or Mn.

18. The composition of claim 1 wherein said metal is Cu in combination with one or more of Fe, B, Zn, Mg, Ca, Na, K, Sr or Ba.

19. The composition of claim 1 wherein said metal reactant (ii) is a nitrate, nitrite, halide, carboxylate, phosphate, phosphite, sulfate, sulfite, carbonate, borate, hydroxide or oxide.

20. A concentrate comprising a normally liquid organic diluent and from about 1 to about 90% by weight of the composition of claim 1.

21. A diesel fuel comprising a major amount of a diesel fuel and a minor property-improving amount of the composition of claim 1.

22. A method of operating a diesel engine equipped with an exhaust system particulate trap to reduce build-up of exhaust particles collected in said trap comprising operating said diesel engine with a diesel fuel containing an effective amount of the composition of claim 1 to lower the ignition temperature of the exhaust particulates collected in said trap.

23. A method of operating an apparatus powered by a diesel engine and equipped with a fuel additive dispenser and an exhaust system particulate trap comprising:

operating said engine using a diesel fuel;

maintaining a fuel additive comprising the composition of claim 1 in said fuel additive dispenser;

blending an effective amount of said fuel additive with said diesel fuel to reduce the ignition temperature of exhaust particulates collected in said trap.

24. A composition comprising at least one organocopper complex, said complex being derived from (i) at least one aromatic Mannich, said aromatic Mannich being the reaction product of (A-1) a hydroxy and/or thiol-containing aromatic compound having the formula

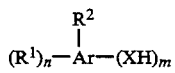

(A-1)

wherein in Formula (A-1) Ar is an aromatic group; m is 1, 2 or 3; n is a number from 1 to about 4; each $R^1$ independently is H or a hydrocarbyl group having from 1 to about 100 carbon atoms; $R^2$ is H, amino or carboxyl; and X is O, S, or both when m is 2 or greater;

(A-2) an aldehyde or ketone having the formula

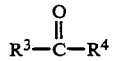

(A-2)

or a precursor thereof; wherein in Formula (A-2) $R^3$ and $R^4$ independently are H, saturated hydrocarbyl groups having from 1 to about 18 carbon atoms, and $R^4$ can also be a carbonyl-containing hydrocarbyl group having from 1 to about 18 carbon atoms; and (A-3) an amine which contains at least one primary or secondary amino group, said amine being characterized by the absence of hydroxyl and/or thiol groups, said amine being other than an ethylene polyamine or a propylene polyamine, said reaction between components (A-1), (A-2) and (A-3) being conducted at a temperature below about 120° C.; and (ii) at least one copper reactant.

25. A concentrate comprising a normally liquid organic diluent and from about 1 to about 90% by weight of the composition of claim 24.

26. A diesel fuel composition comprising a major amount of a diesel fuel and a minor property-improving amount of the composition of claim 24.

27. A method of operating a diesel engine equipped with an exhaust system particulate trap to reduce build-up of exhaust particles collected in said trap comprising operating said diesel engine with a diesel fuel containing an effective amount of the composition of claim 24 to lower the ignition temperature of the exhaust particulates collected in said trap.

28. A method of operating an apparatus powered by a diesel engine and equipped with a fuel additive dispenser and an exhaust system particulate trap comprising:

operating said engine using a diesel fuel;

maintaining a fuel additive comprising the composition of claim 24 in said fuel additive dispenser;

blending an effective amount of said fuel additive with said diesel fuel to reduce the ignition temperature of exhaust particulates collected in said trap.

29. A composition comprising at least one copper-containing organometallic complex, the metal in said organometallic complex being Cu or Cu in combination with one or more metals selected from the group consisting of Na, K, Mg, Ca, Sr, Ba, V, Cr, Mo, Fe, Co, Zn, B, Pb, Sb, Ti, Mn and Zr, the metal in said organometallic complex being sufficiently active so that when said organometallic complex is dispersed in a diesel fuel and said diesel fuel is used in a diesel engine equipped with an exhaust system particulate trap the metal from said complex reduces the ignition temperature of exhaust particles collected in said trap, said complex being derived from (i) at least one aromatic Mannich made by the reaction of a hydroxy and/or thiol-containing aromatic compound, an aldehyde or ketone, and an amine other than a hydroxyl- and/or thiol-containing amine and other than an alkylene polyamine wherein the alkylene is ethylene or propylene; and (ii) at least one metal reactant containing said metal.

30. A concentrate comprising a normally liquid organic diluent and from about 1 to about 90% by weight of the composition of claim 29.

31. A diesel fuel composition comprising a major amount of a diesel fuel and a minor property-improving amount of the composition of claim 29.

32. A method of operating a diesel engine equipped with an exhaust system particulate trap to reduce build-up of exhaust particles collected in said trap comprising operating said diesel engine with a diesel fuel containing an effective amount of the composition of claim 29 to lower the ignition temperature of the exhaust particulates collected in said trap.

33. A method of operating an apparatus powered by a diesel engine and equipped with a fuel additive dispenser and an exhaust system particulate trap comprising:

operating said engine using a diesel fuel;

maintaining a fuel additive comprising the composition of claim 29 in said fuel additive dispenser;

blending an effective amount of said fuel additive with said diesel fuel to reduce the ignition temperature of exhaust particulates collected in said trap.

34. A composition comprising a copper-containing complex made by contacting:

(i) an aromatic Mannich compound derived from p-heptyl phenol, paraformaldehyde and 3,3'-diamino-N-methyldipropylamine; with (ii) a copper reactant.

35. A concentrate comprising a normally liquid organic diluent and from about 1 to about 90% by weight of the composition of claim 34.

36. A diesel fuel composition comprising a major amount of a diesel fuel and a minor property-improving amount of the composition of claim 34.

37. A method of operating a diesel engine equipped with an exhaust system particulate trap to reduce build-up of exhaust particles collected in said trap comprising operating said diesel engine with a diesel fuel containing an effective amount of the composition of claim 34 to lower the ignition temperature of the exhaust particulates collected in said trap.

38. A method of operating an apparatus powered by a diesel engine and equipped with a fuel additive dispenser and an exhaust system particulate trap comprising:

operating said engine using a diesel fuel;

maintaining a fuel additive comprising the composition of claim 34 in said fuel additive dispenser;

blending an effective amount of said fuel additive with said diesel fuel to reduce the ignition temperature of exhaust particulates collected in said trap.

* * * * *

UNITED STATES PATENT AND TRADEMARK OFFICE

CERTIFICATE OF CORRECTION

PATENT NO. : 5,360,459

DATED : November 1, 1994

INVENTOR(S) : Kolp et al.

It is certified that error appears in the above-identified patent and that said Letters Patent is hereby corrected as shown below:

Title Page, Inventors, delete "Scott T. Jolley, Mentor;" "Stephen H. Stoldt, Concord Township, Ashtabula County;", "Reed H. Walsh, Mentor;", and "Richard A. Denis, Auburn Township, Ashtabula County".

Title Page, Notice, change "The portion of the term of this patent subsequent to May 13, 2008 has been disclaimed." to --The portion of the term of this patent subsequent to August 23, 2011 has been disclaimed.--

IN THE CLAIMS:

Claim 1, Column 62, lines 8-58, delete "hydroxyaromatic ketoximes; Schiff bases other than hydroxyaromatic Schiff bases; calixarenes; $\alpha$-substituted phenols wherein the substituent is $NR^1_2$, $SR^1$ or $NO_2$ and $R^1$ is H or a hydrocarbyl group; $\beta$-substituted phenols represented by either of the formulae It is certified that error appears in the above-identified patent and that said Letters Patent is hereby corrected as shown below:

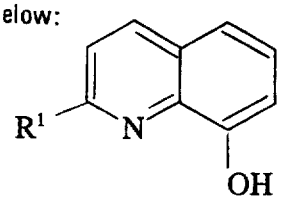

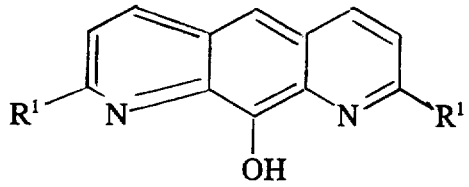

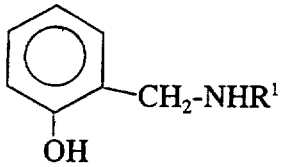

wherein each $R^1$ is H or a hydrocarbyl group, or each $R^1$ is a group represented by the formula $R^2R^3NR^4$- wherein $R^2$ and $R^3$ are independently H or hydrocarbyl groups, and $R^4$ is a hydrocarbylene or hydrocarbylidene group; carboxylic acid esters characterized by the presence of at least one carboxylic acid ester group and at least one additional functional group, said additional functional group being one of said functional groups It is certified that error appears in the above-identified patent and that said Letters Patent is hereby corrected as shown below:

or another carboxylic acid ester group; acylated amines characterized by at least one acyl group and at least one amino group and being other than the product made by the reaction of a hydrocarbon-substituted succinic acid compound having at least 50 aliphatic carbon atoms in the hydrocarbon substituent with an alkylene amine; hydroxyazylenes; benzotriazoles; amino acids; hydroxamic acids; linked phenolic compounds wherein the linking group is $-CH_2-$ or $-CH_2OCH_2-$; aromatic difunctional compounds wherein the functional groups are independently -OH, $-NO_2$, $-NH_2$, -COOR, -SH or -C(O)H; xanthates; formazyls; pyridines; borated acylated amines; phosphorous-containing acylated amines; substituted pyrroles wherein the substituent is -OH, $-NH_2$, $-NR_2$, -COOR, -SH or -C(O)H; porphyrins; or ethylene diamine tetraacetic acids or acid esters;"

UNITED STATES PATENT AND TRADEMARK OFFICE

CERTIFICATE OF CORRECTION

PATENT NO. : 5,360,459
DATED : November 1, 1994
INVENTOR(S) : Kolp et al.

It is certified that error appears in the above-indentified patent and that said Letters Patent is hereby corrected as shown below:

Claim 1, Column 62, line 8, after "propylene;" add --and--.

Claim 11, Column 64, line 67, change "R7" to --$R^7$".

Signed and Sealed this

Twenty-third Day of May, 1995

*Attest:*

Bruce Lehman

BRUCE LEHMAN

*Attesting Officer*

*Commissioner of Patents and Trademarks*